US012055028B2

(12) United States Patent
Benson

(10) Patent No.: US 12,055,028 B2
(45) Date of Patent: Aug. 6, 2024

(54) SYSTEM AND METHOD FOR WELL DRILLING CONTROL BASED ON BOREHOLE CLEANING

(71) Applicant: Motive Drilling Technologies, Inc., Dallas, TX (US)

(72) Inventor: Todd W. Benson, Dallas, TX (US)

(73) Assignee: Motive Drilling Technologies, Inc., Dallas, TX (US)

( * ) Notice: Subject to any disclaimer, the term of this patent is extended or adjusted under 35 U.S.C. 154(b) by 1383 days.

(21) Appl. No.: 16/450,599

(22) Filed: Jun. 24, 2019

(65) Prior Publication Data

US 2019/0309614 A1 Oct. 10, 2019

Related U.S. Application Data

(63) Continuation-in-part of application No. 16/252,439, filed on Jan. 18, 2019, now Pat. No. 11,613,983.
(Continued)

(51) Int. Cl.
*E21B 44/02* (2006.01)
*E21B 7/04* (2006.01)
(Continued)

(52) U.S. Cl.
CPC ..... *E21B 44/02* (2013.01); *E21B 7/04* (2013.01); *E21B 21/08* (2013.01); *E21B 45/00* (2013.01); *E21B 49/005* (2013.01); *E21B 37/00* (2013.01)

(58) Field of Classification Search
CPC . E21B 44/02; E21B 7/04; E21B 21/08; E21B 45/00; E21B 49/005; E21B 37/00
See application file for complete search history.

(56) References Cited

U.S. PATENT DOCUMENTS 2,742,265 A 4/1956 Snyder
4,794,534 A 12/1988 Millheim
(Continued)

FOREIGN PATENT DOCUMENTS

GB 2236782 4/1991
WO 2009039448 3/2009

OTHER PUBLICATIONS

International Search Report and Written Opinion; PCT/US2019/038764, Oct. 18, 2019.
(Continued)

*Primary Examiner* — Robert E Fuller
*Assistant Examiner* — Neel Girish Patel
(74) *Attorney, Agent, or Firm* — Kilpatrick Townsend & Stockton LLP

(57) ABSTRACT

Systems and methods for determining the cleaning effectiveness of a well borehole during drilling. A control system may monitor various parameters, including the volume of drilling mud and any materials entering a borehole, including by a flow rate, and the volume of fluids and materials (such as drilling mud and rock) exiting a borehole, including by a flow rate, and determining if there is a difference, the value of any such difference, whether the value is within one or more target ranges, falls below a threshold therefor, or exceeds a threshold therefor. If the control system determines that the value of the difference in volumes indicates that corrective action is appropriate, then taking such corrective action by modifying one or more drilling parameters.

20 Claims, 28 Drawing Sheets

Related U.S. Application Data

(60) Provisional application No. 62/748,996, filed on Oct. 22, 2018, provisional application No. 62/689,631, filed on Jun. 25, 2018, provisional application No. 62/619,247, filed on Jan. 19, 2018.

(51) Int. Cl.

| | |
|---|---|
| ***E21B 21/08*** | (2006.01) |
| ***E21B 37/00*** | (2006.01) |
| ***E21B 45/00*** | (2006.01) |
| ***E21B 49/00*** | (2006.01) |

(56) References Cited

U.S. PATENT DOCUMENTS

| | | | | |
|---|---|---|---|---|
| 5,193,628 | A | 3/1993 | Hill et al. | |
| 5,220,963 | A | 6/1993 | Patton | |
| 5,390,748 | A | 2/1995 | Goldman | |
| 5,465,799 | A | 11/1995 | Ho | |
| 5,812,068 | A | 9/1998 | Wisler et al. | |
| 5,857,531 | A | 1/1999 | Estep et al. | |
| 6,088,294 | A | 7/2000 | Balogh | |
| 6,233,524 | B1 | 5/2001 | Harrell et al. | |
| 6,257,356 | B1 | 7/2001 | Wassell | |
| 6,272,434 | B1 | 8/2001 | Wisler | |
| 6,279,702 | B1 | 8/2001 | Koh | |
| 6,405,808 | B1 | 6/2002 | Edwards et al. | |
| 6,408,953 | B1 | 6/2002 | Goldman et al. | |
| 6,424,919 | B1 | 7/2002 | Moran et al. | |
| 6,470,977 | B1 | 10/2002 | Chen et al. | |
| 6,523,623 | B1 | 2/2003 | Schuh | |
| 6,577,954 | B2 | 6/2003 | Alft et al. | |
| 6,581,699 | B1 | 6/2003 | Chen et al. | |
| 6,601,658 | B1 | 8/2003 | Downton | |
| 6,612,382 | B2 | 9/2003 | King | |
| 6,732,052 | B2 | 5/2004 | MacDonald et al. | |
| 6,736,221 | B2 | 5/2004 | Chia et al. | |
| 7,000,710 | B1 | 2/2006 | Umbach | |
| 7,003,439 | B2 | 2/2006 | Aldred et al. | |
| 7,011,156 | B2 | 3/2006 | Von Gynz-Rekowski | |
| 7,032,689 | B2 | 4/2006 | Goldman et al. | |
| 7,054,750 | B2 | 5/2006 | Rodney et al. | |
| 7,085,696 | B2 | 8/2006 | King | |
| 7,136,795 | B2 | 11/2006 | Downton | |
| 7,142,986 | B2 | 11/2006 | Moran | |
| 7,243,719 | B2 | 7/2007 | Baron et al. | |
| 7,264,050 | B2 | 9/2007 | Koithan et al. | |
| 7,342,504 | B2 | 3/2008 | Crane et al. | |
| 7,460,957 | B2 | 12/2008 | Prange et al. | |
| 7,606,666 | B2 | 10/2009 | Repin et al. | |
| 7,653,563 | B2 | 1/2010 | Veeningen et al. | |
| 7,684,929 | B2 | 3/2010 | Prange et al. | |
| 7,725,263 | B2 | 5/2010 | Sugiura | |
| 7,823,655 | B2 | 11/2010 | Boone et al. | |
| 7,860,593 | B2 | 12/2010 | Boone | |
| 7,938,197 | B2 | 5/2011 | Boone et al. | |
| 7,945,488 | B2 | 5/2011 | Karr et al. | |
| 7,957,946 | B2 | 6/2011 | Pirovolou | |
| 8,010,290 | B2 | 8/2011 | Ilfelder | |
| 8,210,283 | B1 | 7/2012 | Benson et al. | |
| 8,463,550 | B1 | 6/2013 | Selman | |
| 9,424,667 | B2 | 8/2016 | Pena et al. | |
| 9,470,052 | B2 | 10/2016 | Edbury et al. | |
| 9,494,030 | B2 | 11/2016 | Benson et al. | |
| 9,908,148 | B2 | 3/2018 | Torrione | |
| 2001/0042642 | A1 | 11/2001 | King | |
| 2001/0054514 | A1 | 12/2001 | Sullivan et al. | |
| 2002/0070050 | A1 | 6/2002 | Wassell | |
| 2002/0103630 | A1 | 8/2002 | Alfred | |
| 2002/0139581 | A1 | 10/2002 | Schultz et al. | |
| 2003/0024738 | A1 | 2/2003 | Schuh | |
| 2003/0079912 | A1* | 5/2003 | Leuchtenberg | E21B 44/00 175/48 |
| 2004/0047234 | A1 | 3/2004 | Armstrong et al. | |
| 2004/0168811 | A1 | 9/2004 | Aeschbacher | |
| 2005/0006145 | A1 | 1/2005 | Downton | |
| 2005/0150689 | A1 | 7/2005 | Jogi et al. | |
| 2005/0194130 | A1 | 9/2005 | Best | |
| 2005/0194185 | A1 | 9/2005 | Gleitman | |
| 2005/0269082 | A1 | 12/2005 | Baron et al. | |
| 2006/0074561 | A1 | 4/2006 | Xia | |
| 2006/0151214 | A1 | 7/2006 | Prange | |
| 2007/0163810 | A1 | 7/2007 | Umderwood et al. | |
| 2007/0221375 | A1 | 9/2007 | Baron et al. | |
| 2008/0172272 | A1 | 7/2008 | Back et al. | |
| 2008/0230272 | A1 | 9/2008 | Chen et al. | |
| 2008/0271925 | A1 | 11/2008 | Misselbrook et al. | |
| 2009/0000823 | A1 | 1/2009 | Pirovolou | |
| 2009/0062804 | A1* | 3/2009 | Runquist | E21B 44/02 128/898 |
| 2009/0076873 | A1 | 3/2009 | Johnson et al. | |
| 2009/0090555 | A1 | 4/2009 | Boone et al. | |
| 2009/0120690 | A1 | 5/2009 | Phillips | |
| 2010/0139977 | A1 | 6/2010 | Watkins et al. | |
| 2010/0017592 | A1 | 7/2010 | Ignova et al. | |
| 2010/0191516 | A1 | 7/2010 | Benish | |
| 2010/0252327 | A1 | 10/2010 | Beuershausen et al. | |
| 2010/0259415 | A1 | 10/2010 | Strachan | |
| 2011/0067928 | A1 | 3/2011 | Huldren | |
| 2011/0153300 | A1 | 6/2011 | Holl | |
| 2011/0186353 | A1 | 8/2011 | Turner | |
| 2011/0213601 | A1 | 9/2011 | Pirovolou | |
| 2012/0027516 | A1 | 2/2012 | Day et al. | |
| 2012/0048621 | A1 | 3/2012 | Stewart et al. | |
| 2012/0285701 | A1 | 11/2012 | Cheng | |
| 2013/0032401 | A1 | 2/2013 | Edbury et al. | |
| 2013/0032402 | A1 | 2/2013 | Byreddy et al. | |
| 2013/0092441 | A1 | 4/2013 | Hummes | |
| 2013/0112484 | A1 | 5/2013 | Chen | |
| 2013/0126239 | A1 | 5/2013 | Pamchal et al. | |
| 2013/0133948 | A1 | 5/2013 | Lovorn | |
| 2013/0138409 | A1* | 5/2013 | Lee | G06F 17/13 703/2 |
| 2013/0140037 | A1 | 6/2013 | Sequeira | |
| 2013/0161096 | A1 | 6/2013 | Benson et al. | |
| 2013/0262048 | A1 | 10/2013 | Tang et al. | |
| 2013/0277111 | A1* | 10/2013 | Edbury | E21B 37/00 175/27 |
| 2013/0340999 | A1 | 12/2013 | Benson | |
| 2014/0291023 | A1* | 10/2014 | Edbury | E21B 37/00 345/440.2 |
| 2015/0211350 | A1* | 7/2015 | Norman | E21B 21/00 702/9 |
| 2015/0232272 | A1 | 8/2015 | Magnuson | |
| 2016/0053604 | A1* | 2/2016 | Abbassian | E21B 44/00 702/6 |
| 2016/0090799 | A1* | 3/2016 | Geehan | E21B 21/065 210/85 |
| 2016/0102541 | A1* | 4/2016 | Kronenberger | E21B 21/001 73/152.18 |
| 2016/0130889 | A1 | 5/2016 | Torrione | |
| 2016/0130917 | A1 | 5/2016 | Torrione | |
| 2016/0134843 | A1 | 5/2016 | Torrione | |
| 2016/0305230 | A1 | 10/2016 | Benson et al. | |
| 2017/0370151 | A1* | 12/2017 | Banirazi-Motlagh | E21B 47/022 |
| 2018/0171731 | A1* | 6/2018 | Bingham | B07B 1/4681 |
| 2018/0202246 | A1* | 7/2018 | Kleinguetl | E21B 49/082 |
| 2020/0190959 | A1* | 6/2020 | Gooneratne | E21B 47/00 |

OTHER PUBLICATIONS

Saputelli, et al., "Real-Time Decision-Making for Value Creation While Drilling," SPE/IADC 85314; Middle East Drilling Technology Conference & Exhibition held in Abu Dhabi, UAE, Oct. 20-22, 2003, 19 pages.

Patent Cooperation Treaty: International Preliminary Report on Patentability for PCT/US2013/047054; Dec. 23, 2014, Brassart, P., 9 pages.

Pastusek et al, "A Fundamental Model for Prediction of Hole Curvature and Build Rates With Steerable Bottomhole Assemblies,"

(56) References Cited

OTHER PUBLICATIONS

Society of Petroleum Engineers, 2005 SPE Annual Technical Conference and Exhibit, copyright 2005.
Schlumberger Oilfield Glossary entry for "ROP" or "rate of penetration," accessed via www.glossary.oilfield.slb.com on Aug. 4, 2014.
Dictionary definition of "system," accessed via thefreedictionary.com on Aug. 4, 2014.
PCT/US2019/038764, "International Preliminary Report on Patentability", Jan. 7, 2021, 13 pages.

* cited by examiner

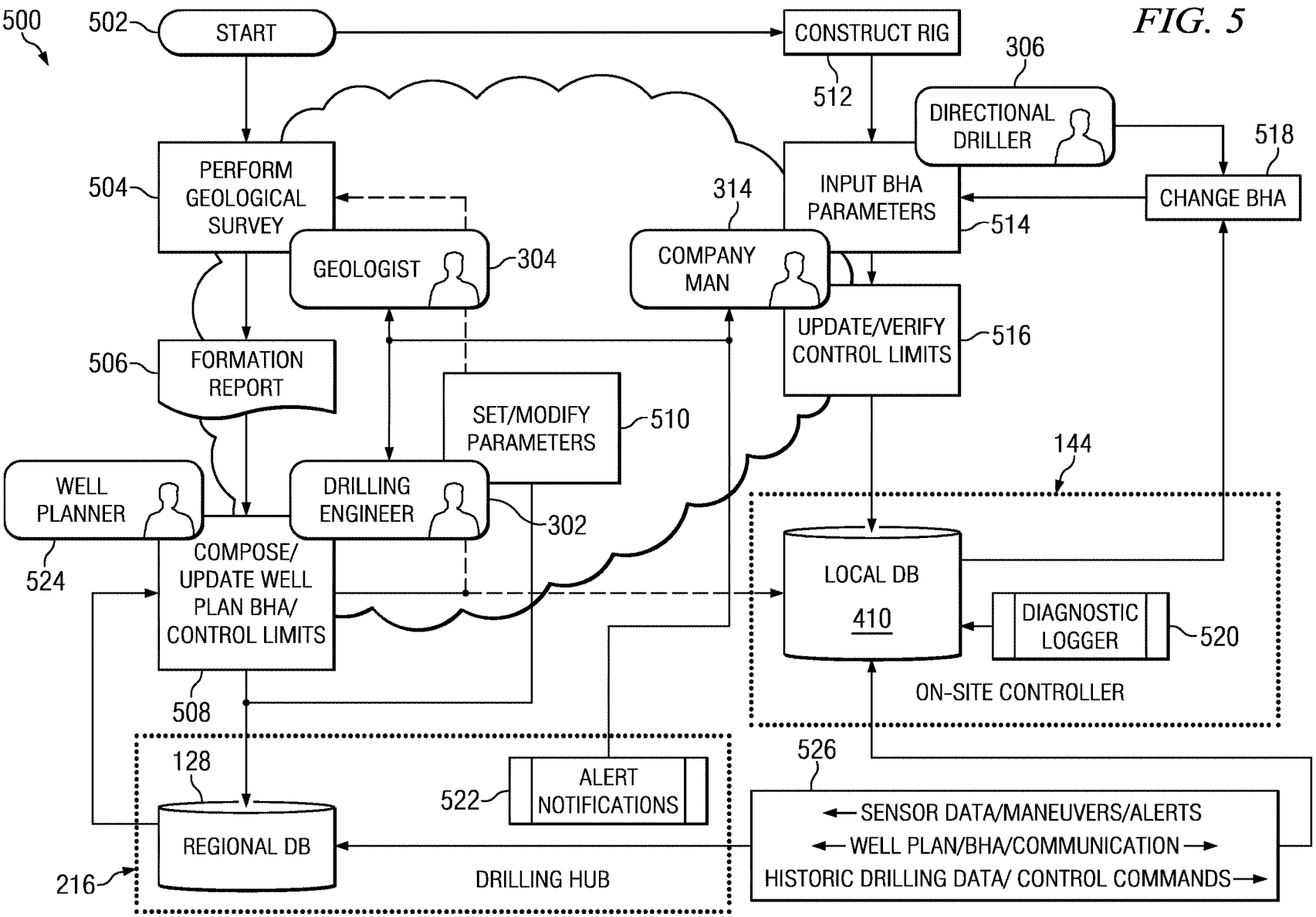
FIG. 5
500
START
502
CONSTRUCT RIG
512
PERFORM GEOLOGICAL SURVEY
504
FORMATION REPORT
506
WELL PLANNER
524
COMPOSE/ UPDATE WELL PLAN BHA/ CONTROL LIMITS
508
DIRECTIONAL DRILLER
306
INPUT BHA PARAMETERS
514
CHANGE BHA
518
UPDATE/VERIFY CONTROL LIMITS
516
COMPANY MAN
314
GEOLOGIST
304
SET/MODIFY PARAMETERS
510
DRILLING ENGINEER
302
144
LOCAL DB
410
DIAGNOSTIC LOGGER
520
ON-SITE CONTROLLER
526
SENSOR DATA/MANEUVERS/ALERTS
WELL PLAN/BHA/COMMUNICATION
HISTORIC DRILLING DATA/ CONTROL COMMANDS
ALERT NOTIFICATIONS
522
DRILLING HUB
128
REGIONAL DB
216

SYSTEM AND METHOD FOR WELL DRILLING CONTROL BASED ON BOREHOLE CLEANING

CROSS REFERENCE TO RELATED APPLICATIONS

This is a continuation-in-part application and claims the benefit of priority of U.S. patent application Ser. No. 16/252,439, filed on Jan. 18, 2019, which claims the benefit of priority of U.S. Provisional Patent Application No. 62/619,247, which was filed on Jan. 19, 2018. This application also claims the benefit of priority of U.S. Provisional Patent Application No. 62/689,631, which was filed on Jun. 25, 2018, and also U.S. Provisional Patent Application No. 62/748,996, which was filed on Oct. 22, 2018. Each of U.S. patent application Ser. Nos. 16/252,439, 62/619,247, 62/689,631, and 62/748,996 are hereby incorporated by reference as if fully set forth herein.

TECHNICAL FIELD

This application is directed to the creation of wells, such as oil and gas wells, and more particularly to the monitoring and controlling of the drilling of such wells.

BACKGROUND

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Current technologies and methods do not adequately address the complicated nature of drilling. Accordingly, what is needed are a system and method to improve drilling operations and minimize drilling errors.

During drilling operations, the drill bit penetrates through rock by cutting and crushing it. The rock cuttings typically are removed from the well by the drilling fluid (usually referred to as drilling "mud"), which irrigates the bottom of the borehole of the well and then carries the cuttings back to the surface where the cuttings can be removed from the fluid, such as by screening or filtering. An excessive build-up of cuttings, such as due to a failure to effectively remove the cuttings from the borehole, can impede the efficiency and effectiveness of the drilling operations, and in some cases will lead to the drill bit getting stuck, which leads to costly and time-consuming efforts to remove the bit and clean the borehole. Due to the nature of the drilling muds often used and the pressures at which they are used during drilling operations, there may be practical limits on the ability to pump additional volumes of drilling mud into a well without damaging the wellbore or one or more geological formations.

Methods and systems have been developed to monitor hole cleaning effectiveness based on the mass of cuttings removed from a well, the mass of rock excavated in a well, and the mass of cuttings remaining in a well as disclosed in U.S. Pat. No. 9,470,052, issued to Edbury et al. on Oct. 28, 2016, which is hereby incorporated by reference as if fully set forth herein.

BRIEF DESCRIPTION OF THE DRAWINGS

For a more complete understanding, reference is now made to the following description taken in conjunction with the accompanying Drawings in which:

FIG. 5 illustrates one embodiment of data flow that may be supported by the surface steerable system of FIG. 2A;

DETAILED DESCRIPTION

Figure 1A:
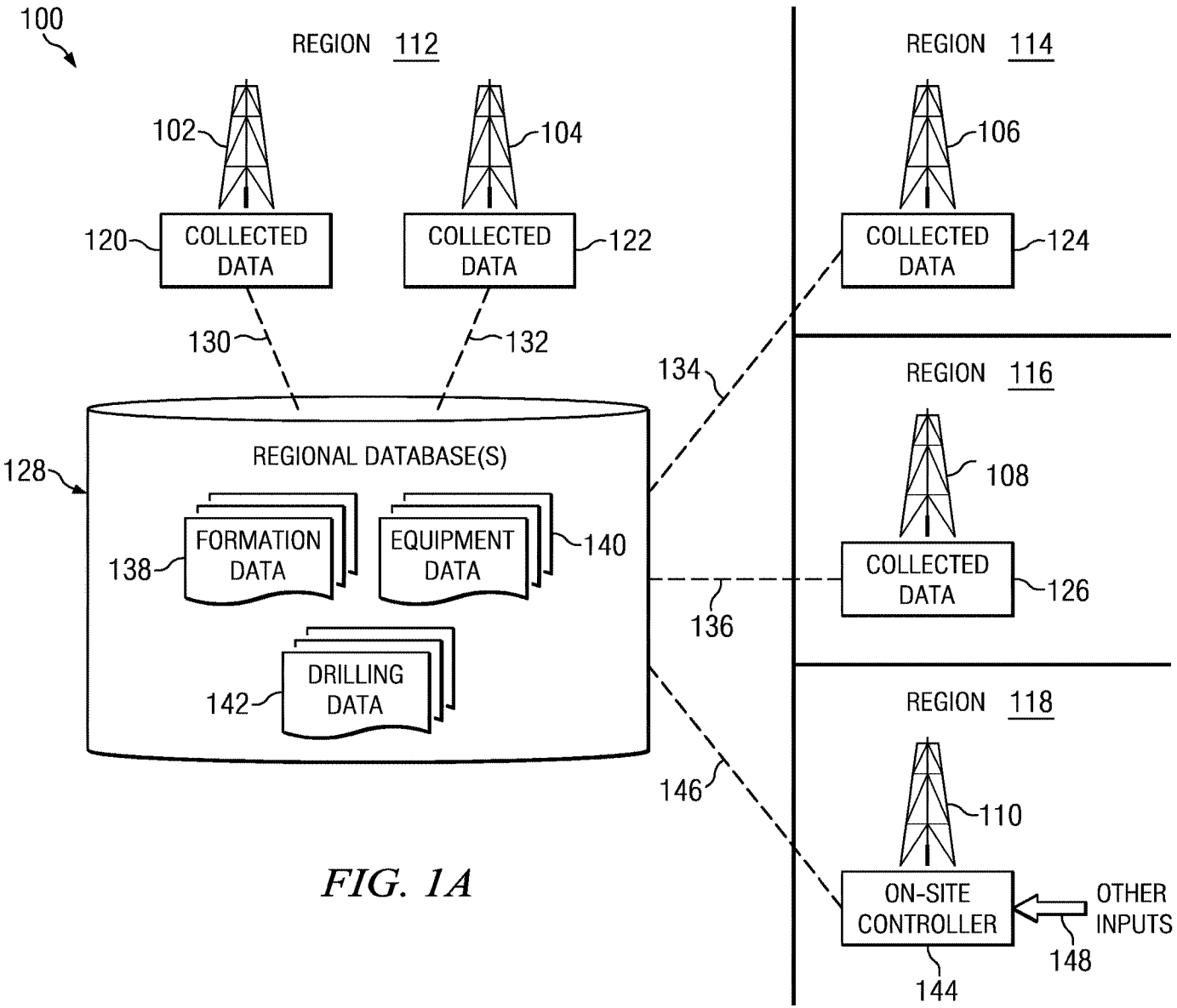
FIG. 1A illustrates one embodiment of a drilling environment in which a surface steerable system may operate.

Referring now to the drawings, wherein like reference numbers are used herein to designate like elements throughout, the various views and embodiments of a system and method for surface steerable drilling are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring to FIG. 1A, one embodiment of an environment 100 is illustrated with multiple wells 102, 104, 106, 108, and a drilling rig 110. In the present example, the wells 102 and 104 are located in a region 112, the well 106 is located in a region 114, the well 108 is located in a region 116, and the drilling rig 110 is located in a region 118. Each region 112, 114, 116, and 118 may represent a geographic area having similar geological formation characteristics. For example, region 112 may include particular formation characteristics identified by rock type, porosity, thickness, and other geological information. These formation characteristics affect drilling of the wells 102 and 104. Region 114 may have formation characteristics that are different enough to be classified as a different region for drilling purposes, and the different formation characteristics affect the drilling of the well 106. Likewise, formation characteristics in the regions 116 and 118 affect the well 108 and drilling rig 110, respectively.

It is understood the regions 112, 114, 116, and 118 may vary in size and shape depending on the characteristics by which they are identified. Furthermore, the regions 112, 114, 116, and 118 may be sub-regions of a larger region. Accordingly, the criteria by which the regions 112, 114, 116, and 118 are identified is less important for purposes of the present disclosure than the understanding that each region 112, 114, 116, and 118 includes geological characteristics that can be used to distinguish each region from the other regions from a drilling perspective. Such characteristics may be relatively major (e.g., the presence or absence of an entire rock layer in a given region) or may be relatively minor (e.g., variations in the thickness of a rock layer that extends through multiple regions).

Accordingly, drilling a well located in the same region as other wells, such as drilling a new well in the region 112 with already existing wells 102 and 104, means the drilling process is likely to face similar drilling issues as those faced when drilling the existing wells in the same region. For similar reasons, a drilling process performed in one region is likely to face issues different from a drilling process performed in another region. However, even the drilling processes that created the wells 102 and 104 may face different issues during actual drilling as variations in the formation are likely to occur even in a single region.

Drilling a well typically involves a substantial amount of human decision making during the drilling process. For example, geologists and drilling engineers use their knowledge, experience, and the available information to make decisions on how to plan the drilling operation, how to accomplish the plan, and how to handle issues that arise during drilling. However, even the best geologists and drilling engineers perform some guesswork due to the unique nature of each borehole. Furthermore, a directional driller directly responsible for the drilling may have drilled other boreholes in the same region and so may have some similar experience, but it is impossible for a human to mentally track all the possible inputs and factor those inputs into a decision. This can result in expensive mistakes, as errors in drilling can add hundreds of thousands or even millions of dollars to the drilling cost and, in some cases, drilling errors may permanently lower the output of a well, resulting in substantial long term losses.

In the present example, to aid in the drilling process, each well 102, 104, 106, and 108 has corresponding collected data 120, 122, 124, and 126, respectively. The collected data may include the geological characteristics of a particular formation in which the corresponding well was formed, the attributes of a particular drilling rig, including the bottom hole assembly (BHA), and drilling information such as weight-on-bit (WOB), drilling speed, and/or other information pertinent to the formation of that particular borehole. The drilling information may be associated with a particular depth or other identifiable marker so that, for example, it is recorded that drilling of the well 102 from 1000 feet to 1200 feet occurred at a first ROP through a first rock layer with a first WOB, while drilling from 1200 feet to 1500 feet occurred at a second ROP through a second rock layer with a second WOB. The collected data may be used to recreate the drilling process used to create the corresponding well 102, 104, 106, or 108 in the particular formation. It is understood that the accuracy with which the drilling process can be recreated depends on the level of detail and accuracy of the collected data.

The collected data 120, 122, 124, and 126 may be stored in a centralized database 128 as indicated by lines 130, 132, 134, and 136, respectively, which may represent any wired and/or wireless communication channel(s). The database 128 may be located at a drilling hub (not shown) or elsewhere. Alternatively, the data may be stored on a removable storage medium that is later coupled to the database 128 in order to store the data. The collected data 120, 122, 124, and 126 may be stored in the database 128 as formation data 138, equipment data 140, and drilling data 142 for example. Formation data 138 may include any formation information, such as rock type, layer thickness, layer location (e.g., depth), porosity, gamma readings, etc. Equipment data 140 may include any equipment information, such as drilling rig configuration (e.g., rotary table or top drive), bit type, mud composition, etc. Drilling data 142 may include any drilling information, such as drilling speed, WOB, differential pressure, toolface orientation, etc. The collected data may also be identified by well, region, and other criteria, and may be sortable to enable the data to be searched and analyzed. It is understood that many different storage mechanisms may be used to store the collected data in the database 128.

Figure 1B:
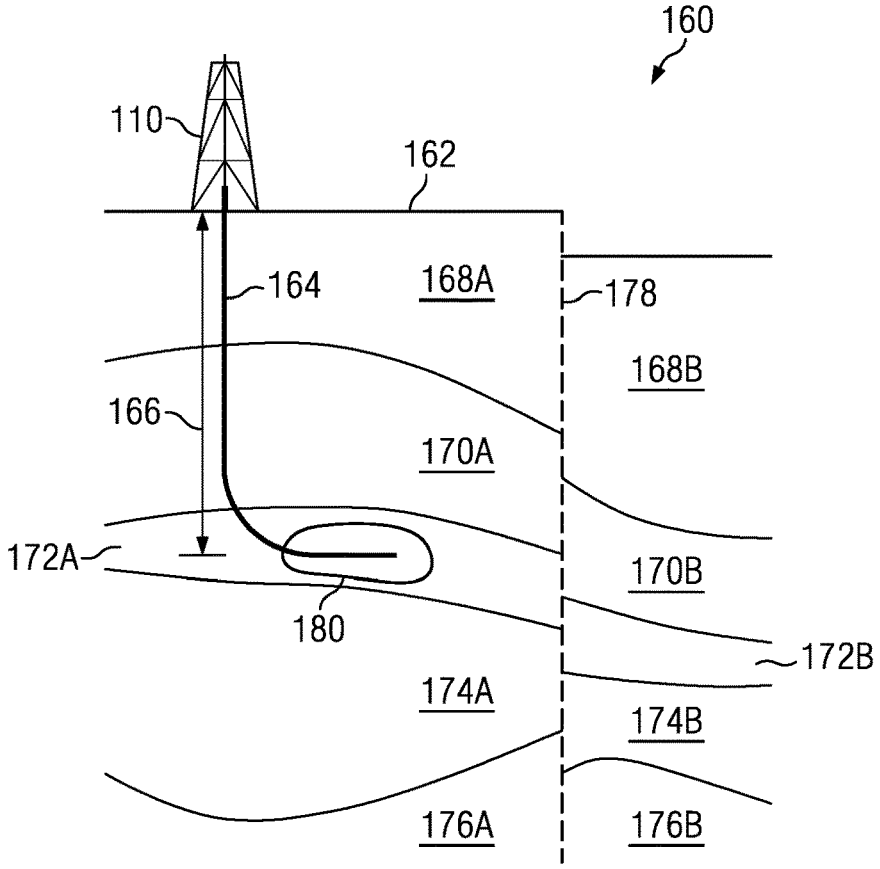
FIG. 1B illustrates one embodiment of a more detailed portion of the drilling environment of FIG. 1A.

With additional reference to FIG. 1B, an environment 160 (not to scale) illustrates a more detailed embodiment of a portion of the region 118 with the drilling rig 110 located at the surface 162. A drilling plan has been formulated to drill a borehole 164 extending into the ground to a true vertical depth (TVD) 166. The borehole 164 extends through strata layers 168 and 170, stopping in layer 172, and not reaching underlying layers 174 and 176. The borehole 164 may be directed to a target area 180 positioned in the layer 172. The target 180 may be a subsurface point or points defined by coordinates or other markers that indicate where the borehole 164 is to end or may simply define a depth range within which the borehole 164 is to remain (e.g., the layer 172 itself). It is understood that the target 180 may be any shape and size, and may be defined in any way. Accordingly, the target 180 may represent an endpoint of the borehole 164 or may extend as far as can be realistically drilled. For example, if the drilling includes a horizontal component and the goal is to follow the layer 172 as far as possible, the target may simply be the layer 172 itself and drilling may continue until a limit is reached, such as a property boundary or a physical limitation to the length of the drillstring. A fault 178 has shifted a portion of each layer downwards. Accordingly, the borehole 164 is located in non-shifted layer portions 168A-176A, while portions 168B-176B represent the shifted layer portions.

Current drilling techniques frequently involve directional drilling to reach a target, such as the target 180. The use of directional drilling generally increases the amount of reserves that can be obtained and also increases production rate, sometimes significantly. For example, the directional drilling used to provide the horizontal portion shown in FIG. 1B increases the length of the borehole in the layer 172, which is the target layer in the present example. Directional drilling may also be used alter the angle of the borehole to address faults, such as the fault 178 that has shifted the layer portion 172B. Other uses for directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not confined to a straight horizontal borehole, but may involve staying within a rock layer that varies in depth and thickness as illustrated by the layer 172. As such, directional drilling may involve multiple vertical adjustments that complicate the path of the borehole.

Figure 1C:
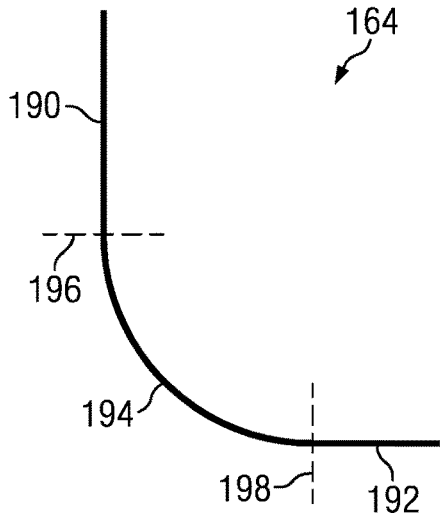
FIG. 1C illustrates one embodiment of a more detailed portion of the drilling environment of FIG. 1B.

With additional reference to FIG. 1C, which illustrates one embodiment of a portion of the borehole 164 of FIG. 1B, the drilling of horizontal wells clearly introduces significant challenges to drilling that do not exist in vertical wells. For example, a substantially horizontal portion 192 of the well may be started off of a vertical borehole 190 and one drilling consideration is the transition from the vertical portion of the well to the horizontal portion. This transition is generally a curve that defines a build up section 194 beginning at the vertical portion (called the kick off point and represented by line 196) and ending at the horizontal portion (represented by line 198). The change in inclination per measured length drilled is typically referred to as the build rate and is often defined in degrees per one hundred feet drilled. For example, the build rate may be 6°/100 ft, indicating that there is a six degree change in inclination for every one hundred feet drilled. The build rate for a particular build up section may remain relatively constant or may vary.

The build rate depends on factors such as the formation through which the borehole 164 is to be drilled, the trajectory of the borehole 164, the particular pipe and drill collars/BHA components used (e.g., length, diameter, flexibility, strength, mud motor bend setting, and drill bit), the mud type and flow rate, the required horizontal displacement, stabilization, and inclination. An overly aggressive built rate can cause problems such as severe doglegs (e.g., sharp changes in direction in the borehole) that may make it difficult or impossible to run casing or perform other needed tasks in the borehole 164. Depending on the severity of the mistake, the borehole 164 may require enlarging or the bit may need to be backed out and a new passage formed. Such mistakes cost time and money. However, if the built rate is too cautious, significant additional time may be added to the drilling process as it is generally slower to drill a curve than to drill straight. Furthermore, drilling a curve is more complicated and the possibility of drilling errors increases (e.g., overshoot and undershoot that may occur trying to keep the bit on the planned path).

Two modes of drilling, known as rotating and sliding, are commonly used to form the borehole 164. Rotating, also called rotary drilling, uses a topdrive or rotary table to rotate the drillstring. Rotating is used when drilling is to occur along a straight path. Sliding, also called steering, uses a downhole mud motor with an adjustable bent housing and does not rotate the drillstring. Instead, sliding uses hydraulic power to drive the downhole motor and bit. Sliding is used in order to control well direction.

To accomplish a slide, the rotation of the drill string is stopped. Based on feedback from measuring equipment such as a MWD tool, adjustments are made to the drill string. These adjustments continue until the downhole toolface that indicates the direction of the bend of the motor is oriented to the direction of the desired deviation of the borehole. Once the desired orientation is accomplished, pressure is applied to the drill bit, which causes the drill bit to move in the direction of deviation. Once sufficient distance and angle have been built, a transition back to rotating mode is accomplished by rotating the drill string. This rotation of the drill string neutralizes the directional deviation caused by the bend in the motor as it continuously rotates around the centerline of the borehole.

Referring again to FIG. 1A, the formulation of a drilling plan for the drilling rig 110 may include processing and analyzing the collected data in the database 128 to create a more effective drilling plan. Furthermore, once the drilling has begun, the collected data may be used in conjunction with current data from the drilling rig 110 to improve drilling decisions. Accordingly, an on-site controller 144 is coupled to the drilling rig 110 and may also be coupled to the database 128 via one or more wired and/or wireless communication channel(s) 146. Other inputs 148 may also be provided to the on-site controller 144. In some embodiments, the on-site controller 144 may operate as a standalone device with the drilling rig 110. For example, the on-site controller 144 may not be communicatively coupled to the database 128. Although shown as being positioned near or at the drilling rig 110 in the present example, it is understood that some or all components of the on-site controller 144 may be distributed and located elsewhere in other embodiments.

The on-site controller 144 may form all or part of a surface steerable system. The database 128 may also form part of the surface steerable system. As will be described in greater detail below, the surface steerable system may be used to plan and control drilling operations based on input information, including feedback from the drilling process itself. The surface steerable system may be used to perform such operations as receiving drilling data representing a drill path and other drilling parameters, calculating a drilling solution for the drill path based on the received data and other available data (e.g., rig characteristics), implementing the drilling solution at the drilling rig 110, monitoring the drilling process to gauge whether the drilling process is within a defined margin of error of the drill path, and/or calculating corrections for the drilling process if the drilling process is outside of the margin of error.

Figure 2A:
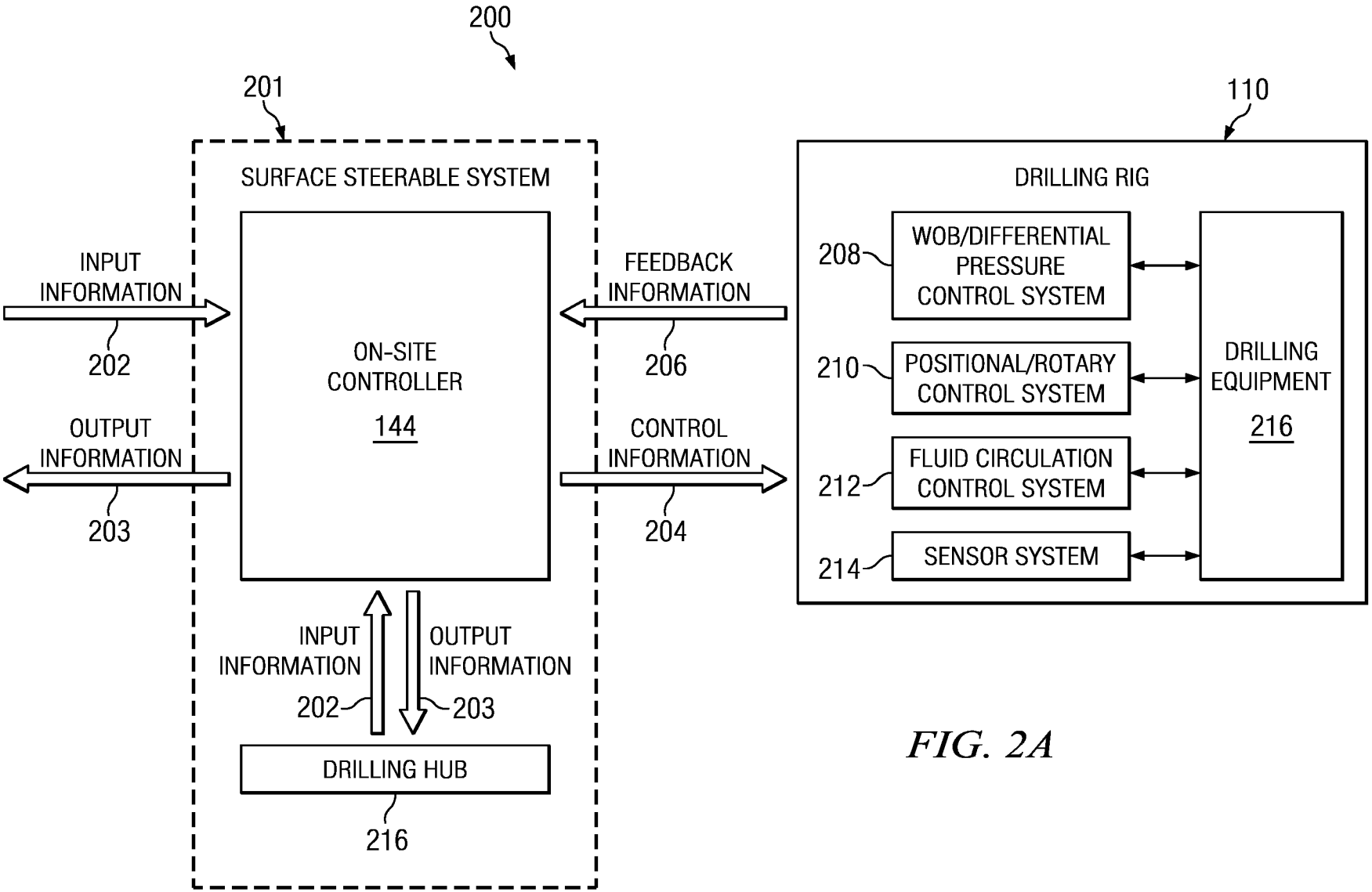
FIG. 2A illustrates one embodiment of the surface steerable system of FIG. 1A and how information may flow to and from the system.

Referring to FIG. 2A, a diagram 200 illustrates one embodiment of information flow for a surface steerable system 201 from the perspective of the on-site controller 144 of FIG. 1A. In the present example, the drilling rig 110 of FIG. 1A includes drilling equipment 216 used to perform the drilling of a borehole, such as top drive or rotary drive equipment that couples to the drill string and BHA and is configured to rotate the drill string and apply pressure to the drill bit. The drilling rig 110 may include control systems such as a WOB/differential pressure control system 208, a positional/rotary control system 210, and a fluid circulation control system 212. The control systems 208, 210, and 212 may be used to monitor and change drilling rig settings, such as the WOB and/or differential pressure to alter the ROP or the radial orientation of the toolface, change the flow rate of drilling mud, and perform other operations.

The drilling rig 110 may also include a sensor system 214 for obtaining sensor data about the drilling operation and the drilling rig 110, including the downhole equipment. For example, the sensor system 214 may include measuring while drilling (MWD) and/or logging while drilling (LWD) components for obtaining information, such as toolface and/or formation logging information, that may be saved for later retrieval, transmitted with a delay or in real time using any of various communication means (e.g., wireless, wireline, or mud pulse telemetry), or otherwise transferred to the on-site controller 144. Such information may include information related to hole depth, bit depth, inclination, azimuth, true vertical depth, gamma count, standpipe pressure, mud flow rate, rotary rotations per minute (RPM), bit speed, ROP, WOB, and/or other information. It is understood that all or part of the sensor system 214 may be incorporated into one or more of the control systems 208, 210, and 212, and/or in the drilling equipment 216. As the drilling rig 110 may be configured in many different ways, it is understood that these control systems may be different in some embodiments, and may be combined or further divided into various subsystems.

The on-site controller 144 receives input information 202. The input information 202 may include information that is pre-loaded, received, and/or updated in real time. The input information 202 may include a well plan, regional formation history, one or more drilling engineer parameters, MWD tool face/inclination information, LWD gamma/resistivity information, economic parameters, reliability parameters, and/or other decision guiding parameters. Some of the inputs, such as the regional formation history, may be available from a drilling hub 216, which may include the database 128 of FIG. 1A and one or more processors (not shown), while other inputs may be accessed or uploaded from other sources. For example, a web interface may be used to interact directly with the on-site controller 144 to upload the well plan and/or drilling engineer parameters. The input information 202 feeds into the on-site controller 144 and, after processing by the on-site controller 144, results in control information 204 that is output to the drilling rig 110 (e.g., to the control systems 208, 210, and 212). The drilling rig 110 (e.g., via the systems 208, 210, 212, and 214) provides feedback information 206 to the on-site controller 144. The feedback information 206 then serves as input to the on-site controller 144, enabling the on-site controller 144 to verify that the current control information is producing the desired results or to produce new control information for the drilling rig 110.

The on-site controller 144 also provides output information 203. As will be described later in greater detail, the output information 203 may be stored in the on-site controller 144 and/or sent offsite (e.g., to the database 128). The output information 203 may be used to provide updates to the database 128, as well as provide alerts, request decisions, and convey other data related to the drilling process.

Figure 2B:
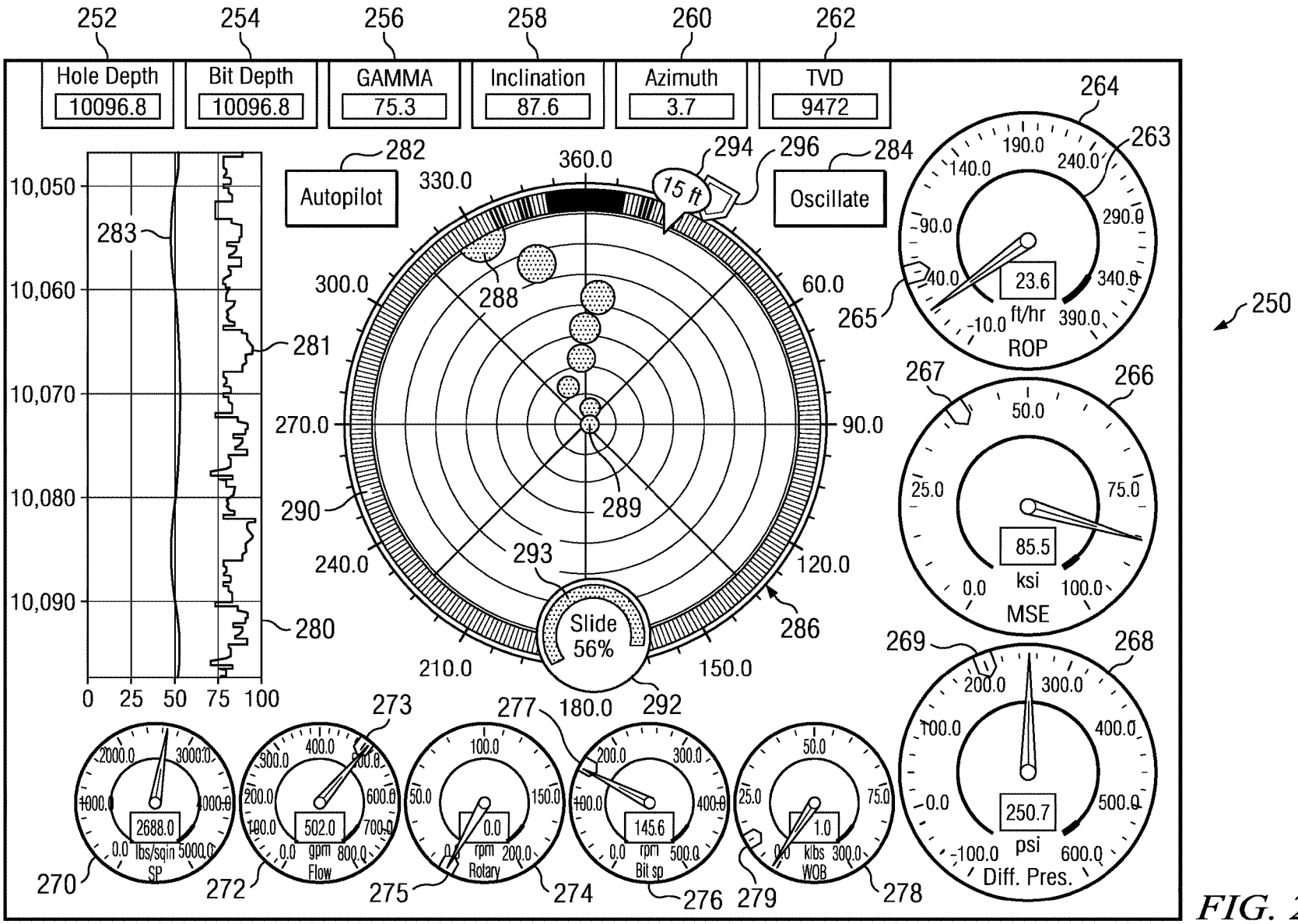
FIG. 2B illustrates one embodiment of a display that may be used with the surface steerable system of FIG. 2A.

Referring to FIG. 2B, one embodiment of a display 250 that may be provided by the on-site controller 144 is illustrated. The display 250 provides many different types of information in an easily accessible format. For example, the display 250 may be a viewing screen (e.g., a monitor) that is coupled to or forms part of the on-site controller 144.

The display 250 provides visual indicators such as a hole depth indicator 252, a bit depth indicator 254, a GAMMA indicator 256, an inclination indicator 258, an azimuth indicator 260, and a TVD indicator 262. Other indicators may also be provided, including a ROP indicator 264, a mechanical specific energy (MSE) indicator 266, a differential pressure indicator 268, a standpipe pressure indicator 270, a flow rate indicator 272, a rotary RPM indicator 274, a bit speed indicator 276, and a WOB indicator 278.

Some or all of the indicators 264, 266, 268, 270, 272, 274, 276, and/or 278 may include a marker representing a target value. For purposes of example, markers are set as the following values, but it is understood that any desired target value may be representing. For example, the ROP indicator 264 may include a marker 265 indicating that the target value is fifty ft/hr. The MSE indicator 266 may include a marker 267 indicating that the target value is thirty-seven ksi. The differential pressure indicator 268 may include a marker 269 indicating that the target value is two hundred psi. The ROP indicator 264 may include a marker 265 indicating that the target value is fifty ft/hr. The standpipe pressure indicator 270 may have no marker in the present example. The flow rate indicator 272 may include a marker 273 indicating that the target value is five hundred gpm. The rotary RPM indicator 274 may include a marker 275 indicating that the target value is zero RPM (due to sliding). The bit speed indicator 276 may include a marker 277 indicating that the target value is one hundred and fifty RPM. The WOB indicator 278 may include a marker 279 indicating that the target value is ten klbs. Although only labeled with respect to the indicator 264, each indicator may include a colored band 263 or another marking to indicate, for example, whether the respective gauge value is within a safe range (e.g., indicated by a green color), within a caution range (e.g., indicated by a yellow color), or within a danger range (e.g., indicated by a red color). Although not shown, in some embodiments, multiple markers may be present on a single indicator. The markers may vary in color and/or size.

A log chart 280 may visually indicate depth versus one or more measurements (e.g., may represent log inputs relative to a progressing depth chart). For example, the log chart 280 may have a y-axis representing depth and an x-axis representing a measurement such as GAMMA count 281 (as shown), ROP 283 (e.g., empirical ROP and normalized ROP), or resistivity. An autopilot button 282 and an oscillate button 284 may be used to control activity. For example, the autopilot button 282 may be used to engage or disengage an autopilot, while the oscillate button 284 may be used to directly control oscillation of the drill string or engage/disengage an external hardware device or controller via software and/or hardware.

A circular chart 286 may provide current and historical toolface orientation information (e.g., which way the bend is pointed). For purposes of illustration, the circular chart 286 represents three hundred and sixty degrees. A series of circles within the circular chart 286 may represent a timeline of toolface orientations, with the sizes of the circles indicating the temporal position of each circle. For example, larger circles may be more recent than smaller circles, so the largest circle 288 may be the newest reading and the smallest circle 289 may be the oldest reading. In other embodiments, the circles may represent the energy and/or progress made via size, color, shape, a number within a circle, etc. For example, the size of a particular circle may represent an accumulation of orientation and progress for the period of time represented by the circle. In other embodiments, concentric circles representing time (e.g., with the outside of the circular chart 286 being the most recent time and the center point being the oldest time) may be used to indicate the energy and/or progress (e.g., via color and/or patterning such as dashes or dots rather than a solid line).

The circular chart 286 may also be color coded, with the color coding existing in a band 290 around the circular chart 286 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular toolface orientation with little deviation. For purposes of illustration, the color blue extends from approximately 22-337 degrees, the color green extends from approximately 15-22 degrees and 337-345 degrees, the color yellow extends a few degrees around the 13 and 345 degree marks, and the color red extends from approximately 347-10 degrees. Transition colors or shades may be used with, for example, the color orange marking the transition between red and yellow and/or a light blue marking the transition between blue and green.

This color coding enables the display 250 to provide an intuitive summary of how narrow the standard deviation is and how much of the energy intensity is being expended in the proper direction. Furthermore, the center of energy may be viewed relative to the target. For example, the display 250 may clearly show that the target is at ninety degrees but the center of energy is at forty-five degrees.

Other indicators may be present, such as a slide indicator 292 to indicate how much time remains until a slide occurs and/or how much time remains for a current slide. For example, the slide indicator may represent a time, a percentage (e.g., current slide is fifty-six percent complete), a distance completed, and/or a distance remaining. The slide indicator 292 may graphically display information using, for example, a colored bar 293 that increases or decreases with the slide's progress. In some embodiments, the slide indicator may be built into the circular chart 286 (e.g., around the outer edge with an increasing/decreasing band), while in other embodiments the slide indicator may be a separate indicator such as a meter, a bar, a gauge, or another indicator type.

An error indicator 294 may be present to indicate a magnitude and/or a direction of error. For example, the error indicator 294 may indicate that the estimated drill bit position is a certain distance from the planned path, with a location of the error indicator 294 around the circular chart 286 representing the heading. For example, FIG. 2B illustrates an error magnitude of fifteen feet and an error direction of fifteen degrees. The error indicator 294 may be any color but is red for purposes of example. It is understood that the error indicator 294 may present a zero if there is no error and/or may represent that the bit is on the path in other ways, such as being a green color. Transition colors, such as yellow, may be used to indicate varying amounts of error. In some embodiments, the error indicator 294 may not appear unless there is an error in magnitude and/or direction. A marker 296 may indicate an ideal slide direction. Although not shown, other indicators may be present, such as a bit life indicator to indicate an estimated lifetime for the current bit based on a value such as time and/or distance.

It is understood that the display 250 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) if a serious problem occurs. The indicators may also flash or otherwise indicate an alert. The gauge indicators may include colors (e.g., green, yellow, and red) to indicate operational conditions and may also indicate the target value (e.g., an ROP of 100 ft/hr). For example, the ROP indicator 264 may have a green bar to indicate a normal level of operation (e.g., from 10-300 ft/hr), a yellow bar to indicate a warning level of operation (e.g., from 300-360 ft/hr), and a red bar to indicate a dangerous or otherwise out of parameter level of operation (e.g., from 360-390 ft/hr). The ROP indicator 264 may also display a marker at 100 ft/hr to indicate the desired target ROP.

Furthermore, the use of numeric indicators, gauges, and similar visual display indicators may be varied based on factors such as the information to be conveyed and the personal preference of the viewer. Accordingly, the display 250 may provide a customizable view of various drilling processes and information for a particular individual involved in the drilling process. For example, the surface steerable system 201 may enable a user to customize the display 250 as desired, although certain features (e.g., standpipe pressure) may be locked to prevent removal. This locking may prevent a user from intentionally or accidentally removing important drilling information from the display. Other features may be set by preference. Accordingly, the level of customization and the information shown by the display 250 may be controlled based on who is viewing the display and their role in the drilling process.

Referring again to FIG. 2A, it is understood that the level of integration between the on-site controller 144 and the drilling rig 110 may depend on such factors as the configuration of the drilling rig 110 and whether the on-site controller 144 is able to fully support that configuration. One or more of the control systems 208, 210, and 212 may be part of the on-site controller 144, may be third-party systems, and/or may be part of the drilling rig 110. For example, an older drilling rig 110 may have relatively few interfaces with which the on-site controller 144 is able to interact. For purposes of illustration, if a knob must be physically turned to adjust the WOB on the drilling rig 110, the on-site controller 144 will not be able to directly manipulate the knob without a mechanical actuator. If such an actuator is not present, the on-site controller 144 may output the setting for the knob to a screen, and an operator may then turn the knob based on the setting. Alternatively, the on-site controller 144 may be directly coupled to the knob's electrical wiring.

However, a newer or more sophisticated drilling rig 110, such as a rig that has electronic control systems, may have interfaces with which the on-site controller 144 can interact for direct control. For example, an electronic control system may have a defined interface and the on-site controller 144 may be configured to interact with that defined interface. It is understood that, in some embodiments, direct control may not be allowed even if possible. For example, the on-site controller 144 may be configured to display the setting on a screen for approval, and may then send the setting to the appropriate control system only when the setting has been approved.

Figure 3:
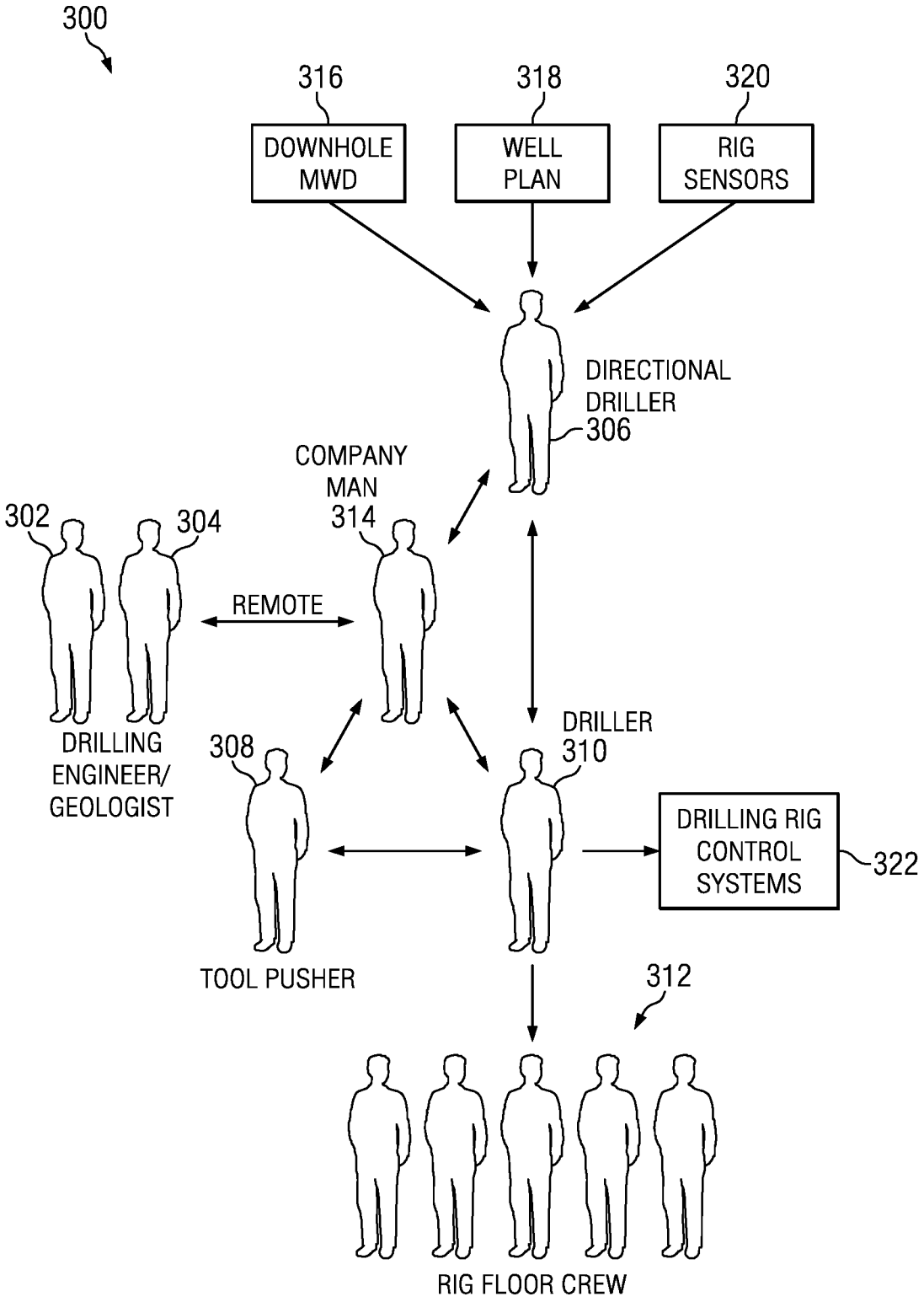
FIG. 3 illustrates one embodiment of a drilling environment that does not have the benefit of the surface steerable system of FIG. 2A and possible communication channels within the environment.

Referring to FIG. 3, one embodiment of an environment 300 illustrates multiple communication channels (indicated by arrows) that are commonly used in existing directional drilling operations that do not have the benefit of the surface steerable system 201 of FIG. 2A. The communication channels couple various individuals involved in the drilling process. The communication channels may support telephone calls, emails, text messages, faxes, data transfers (e.g., file transfers over networks), and other types of communications.

The individuals involved in the drilling process may include a drilling engineer 302, a geologist 304, a directional driller 306, a tool pusher 308, a driller 310, and a rig floor crew 312. One or more company representatives (e.g., company men) 314 may also be involved. The individuals may be employed by different organizations, which can further complicate the communication process. For example, the drilling engineer 302, geologist 304, and company man 314 may work for an operator, the directional driller 306 may work for a directional drilling service provider, and the tool pusher 308, driller 310, and rig floor crew 312 may work for a rig service provider.

The drilling engineer 302 and geologist 304 are often located at a location remote from the drilling rig (e.g., in a home office/drilling hub). The drilling engineer 302 may develop a well plan 318 and may make drilling decisions based on drilling rig information. The geologist 304 may perform such tasks as formation analysis based on seismic, gamma, and other data. The directional driller 306 is generally located at the drilling rig and provides instructions to the driller 310 based on the current well plan and feedback from the drilling engineer 302. The driller 310 handles the actual drilling operations and may rely on the rig floor crew 312 for certain tasks. The tool pusher 308 may be in charge of managing the entire drilling rig and its operation.

The following is one possible example of a communication process within the environment 300, although it is understood that many communication processes may be used. The use of a particular communication process may depend on such factors as the level of control maintained by various groups within the process, how strictly communication channels are enforced, and similar factors. In the present example, the directional driller 306 uses the well plan 318 to provide drilling instructions to the driller 310. The driller 310 controls the drilling using control systems such as the control systems 208, 210, and 212 of FIG. 2A. During drilling, information from sensor equipment such as downhole MWD equipment 316 and/or rig sensors 320 may indicate that a formation layer has been reached twenty feet higher than expected by the geologist 304. This information is passed back to the drilling engineer 302 and/or geologist 304 through the company man 314, and may pass through the directional driller 306 before reaching the company man 314.

The drilling engineer 302/well planner (not shown), either alone or in conjunction with the geologist 306, may modify the well plan 318 or make other decisions based on the received information. The modified well plan and/or other decisions may or may not be passed through the company man 314 to the directional driller 306, who then tells the driller 310 how to drill. The driller 310 may modify equipment settings (e.g., toolface orientation) and, if needed, pass orders on to the rig floor crew 312. For example, a change in WOB may be performed by the driller 310 changing a setting, while a bit trip may require the involvement of the rig floor crew 312. Accordingly, the level of involvement of different individuals may vary depending on the nature of the decision to be made and the task to be performed. The proceeding example may be more complex than described. Multiple intermediate individuals may be involved and, depending on the communication chain, some instructions may be passed through the tool pusher 308.

The environment 300 presents many opportunities for communication breakdowns as information is passed through the various communication channels, particularly given the varying types of communication that may be used. For example, verbal communications via phone may be misunderstood and, unless recorded, provide no record of what was said. Furthermore, accountability may be difficult or impossible to enforce as someone may provide an authorization but deny it or claim that they meant something else. Without a record of the information passing through the various channels and the authorizations used to approve changes in the drilling process, communication breakdowns can be difficult to trace and address. As many of the communication channels illustrated in FIG. 3 pass information through an individual to other individuals (e.g., an individual may serve as an information conduit between two or more other individuals), the risk of breakdown increases due to the possibility that errors may be introduced in the information.

Even if everyone involved does their part, drilling mistakes may be amplified while waiting for an answer. For example, a message may be sent to the geologist 306 that a formation layer seems to be higher than expected, but the geologist 306 may be asleep. Drilling may continue while waiting for the geologist 306 and the continued drilling may amplify the error. Such errors can cost hundreds of thousands or millions of dollars. However, the environment 300 provides no way to determine if the geologist 304 has received the message and no way to easily notify the geologist 304 or to contact someone else when there is no response within a defined period of time. Even if alternate contacts are available, such communications may be cumbersome and there may be difficulty in providing all the information that the alternate would need for a decision.

Figure 4:
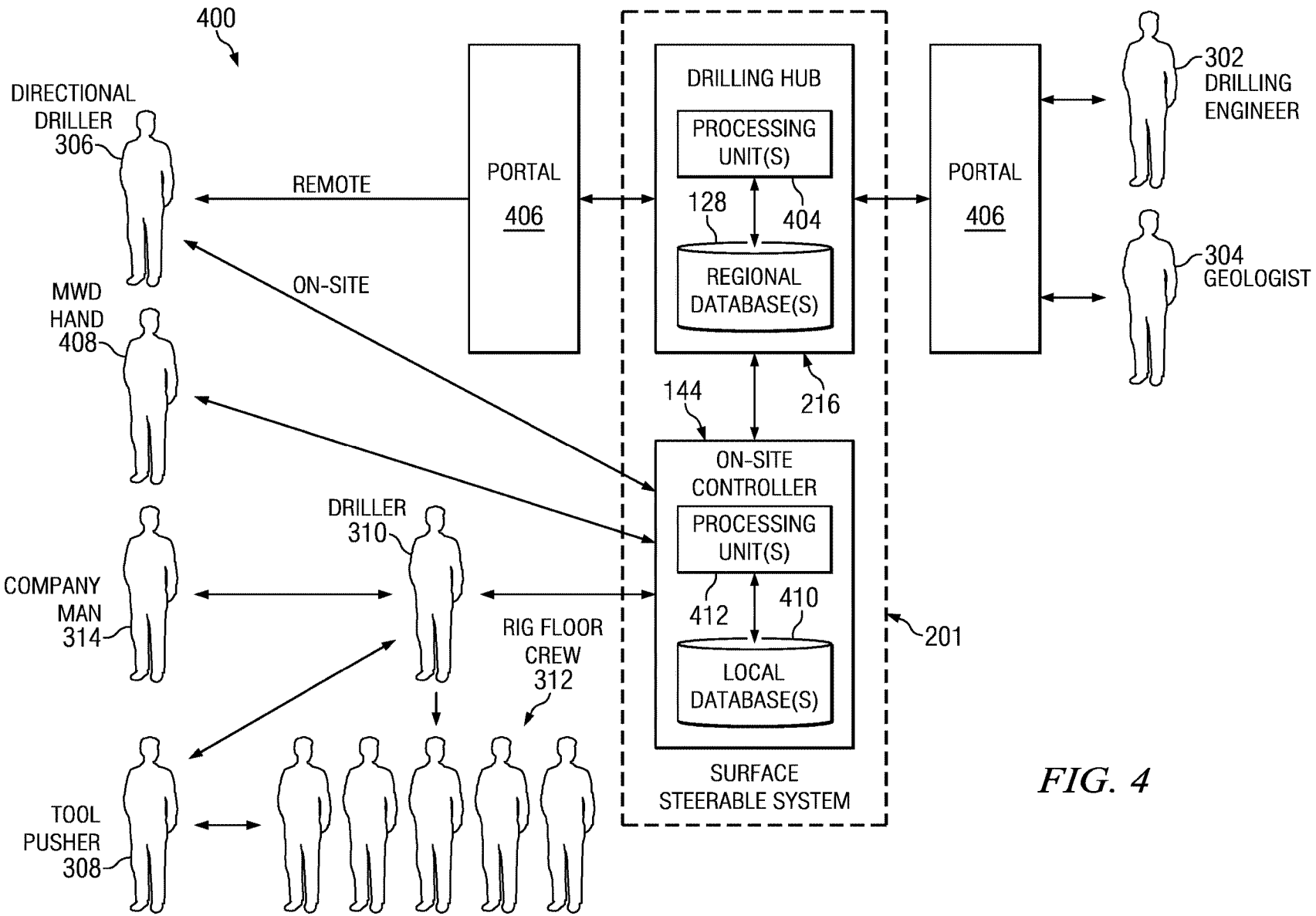
FIG. 4 illustrates one embodiment of a drilling environment that has the benefit of the surface steerable system of FIG. 2A and possible communication channels within the environment.

Referring to FIG. 4, one embodiment of an environment 400 illustrates communication channels that may exist in a directional drilling operation having the benefit of the surface steerable system 201 of FIG. 2A. In the present example, the surface steerable system 201 includes the drilling hub 216, which includes the regional database 128 of FIG. 1A and processing unit(s) 404 (e.g., computers). The drilling hub 216 also includes communication interfaces (e.g., web portals) 406 that may be accessed by computing devices capable of wireless and/or wireline communications, including desktop computers, laptops, tablets, smart phones, and personal digital assistants (PDAs). The on-site controller 144 includes one or more local databases 410 (where "local" is from the perspective of the on-site controller 144) and processing unit(s) 412.

The drilling hub 216 is remote from the on-site controller 144, and various individuals associated with the drilling operation interact either through the drilling hub 216 or through the on-site controller 144. In some embodiments, an individual may access the drilling project through both the drilling hub 216 and on-site controller 144. For example, the directional driller 306 may use the drilling hub 216 when not at the drilling site and may use the on-site controller 144 when at the drilling site.

The drilling engineer 302 and geologist 304 may access the surface steerable system 201 remotely via the portal 406 and set various parameters such as rig limit controls. Other actions may also be supported, such as granting approval to a request by the directional driller 306 to deviate from the well plan and evaluating the performance of the drilling operation. The directional driller 306 may be located either at the drilling rig 110 or off-site. Being off-site (e.g., at the drilling hub 216 or elsewhere) enables a single directional driller to monitor multiple drilling rigs. When off-site, the directional driller 306 may access the surface steerable system 201 via the portal 406. When on-site, the directional driller 306 may access the surface steerable system via the on-site controller 144.

The driller 310 may get instructions via the on-site controller 144, thereby lessening the possibly of miscommunication and ensuring that the instructions were received. Although the tool pusher 308, rig floor crew 312, and company man 314 are shown communicating via the driller 310, it is understood that they may also have access to the on-site controller 144. Other individuals, such as a MWD hand 408, may access the surface steerable system 201 via the drilling hub 216, the on-site controller 144, and/or an individual such as the driller 310.

As illustrated in FIG. 4, many of the individuals involved in a drilling operation may interact through the surface steerable system 201. This enables information to be tracked as it is handled by the various individuals involved in a particular decision. For example, the surface steerable system 201 may track which individual submitted information (or whether information was submitted automatically), who viewed the information, who made decisions, when such events occurred, and similar information-based issues. This provides a complete record of how particular information propagated through the surface steerable system 201 and resulted in a particular drilling decision. This also provides revision tracking as changes in the well plan occur, which in turn enables entire decision chains to be reviewed. Such reviews may lead to improved decision making processes and more efficient responses to problems as they occur.

In some embodiments, documentation produced using the surface steerable system 201 may be synchronized and/or merged with other documentation, such as that produced by third party systems such as the WellView product produced by Peloton Computer Enterprises Ltd. of Calgary, Canada. In such embodiments, the documents, database files, and other information produced by the surface steerable system 201 is synchronized to avoid such issues as redundancy, mismatched file versions, and other complications that may occur in projects where large numbers of documents are produced, edited, and transmitted by a relatively large number of people.

The surface steerable system 201 may also impose mandatory information formats and other constraints to ensure that predefined criteria are met. For example, an electronic form provided by the surface steerable system 201 in response to a request for authorization may require that some fields are filled out prior to submission. This ensures that the decision maker has the relevant information prior to making the decision. If the information for a required field is not available, the surface steerable system 201 may require an explanation to be entered for why the information is not available (e.g., sensor failure). Accordingly, a level of uniformity may be imposed by the surface steerable system 201, while exceptions may be defined to enable the surface steerable system 201 to handle various scenarios.

The surface steerable system 201 may also send alerts (e.g., email or text alerts) to notify one or more individuals of a particular problem, and the recipient list may be customized based on the problem. Furthermore, contact information may be time-based, so the surface steerable system 201 may know when a particular individual is available. In such situations, the surface steerable system 201 may automatically attempt to communicate with an available contact rather than waiting for a response from a contact that is likely not available.

As described previously, the surface steerable system 201 may present a customizable display of various drilling processes and information for a particular individual involved in the drilling process. For example, the drilling engineer 302 may see a display that presents information relevant to the drilling engineer's tasks, and the geologist 304 may see a different display that includes additional and/or more detailed formation information. This customization enables each individual to receive information needed for their particular role in the drilling process while minimizing or eliminating unnecessary information.

Referring to FIG. 5, one embodiment of an environment 500 illustrates data flow that may be supported by the surface steerable system 201 of FIG. 2A. The data flow 500 begins at block 502 and may move through two branches, although some blocks in a branch may not occur before other blocks in the other branch. One branch involves the drilling hub 216 and the other branch involves the on-site controller 144 at the drilling rig 110.

In block 504, a geological survey is performed. The survey results are reviewed by the geologist 304 and a formation report 506 is produced. The formation report 506 details formation layers, rock type, layer thickness, layer depth, and similar information that may be used to develop a well plan. In block 508, a well plan is developed by a well planner 524 and/or the drilling engineer 302 based on the formation report and information from the regional database 128 at the drilling hub 216. Block 508 may include selection of a BHA and the setting of control limits. The well plan is stored in the database 128. The drilling engineer 302 may also set drilling operation parameters in step 510 that are also stored in the database 128.

In the other branch, the drilling rig 110 is constructed in block 512. At this point, as illustrated by block 526, the well plan, BHA information, control limits, historical drilling data, and control commands may be sent from the database 128 to the local database 410. Using the receiving information, the directional driller 306 inputs actual BHA parameters in block 514. The company man 314 and/or the directional driller 306 may verify performance control limits in block 516, and the control limits are stored in the local database 410 of the on-site controller 144. The performance control limits may include multiple levels such as a warning level and a critical level corresponding to no action taken within feet/minutes.

Once drilling begins, a diagnostic logger (described later in greater detail) 520 that is part of the on-site controller 144 logs information related to the drilling such as sensor information and maneuvers and stores the information in the local database 410 in block 526. The information is sent to the database 128. Alerts are also sent from the on-site controller 144 to the drilling hub 216. When an alert is received by the drilling hub 216, an alert notification 522 is sent to defined individuals, such as the drilling engineer 302, geologist 304, and company man 314. The actual recipient may vary based on the content of the alert message or other criteria. The alert notification 522 may result in the well plan and the BHA information and control limits being modified in block 508 and parameters being modified in block 510. These modifications are saved to the database 128 and transferred to the local database 410. The BHA may be modified by the directional driller 306 in block 518, and the changes propagated through blocks 514 and 516 with possible updated control limits. Accordingly, the surface steerable system 201 may provide a more controlled flow of information than may occur in an environment without such a system.

The flow charts described herein illustrate various exemplary functions and operations that may occur within various environments. Accordingly, these flow charts are not exhaustive and that various steps may be excluded to clarify the aspect being described. For example, it is understood that some actions, such as network authentication processes, notifications, and handshakes, may have been performed prior to the first step of a flow chart. Such actions may depend on the particular type and configuration of communications engaged in by the on-site controller 144 and/or drilling hub 216. Furthermore, other communication actions may occur between illustrated steps or simultaneously with illustrated steps.

The surface steerable system 201 includes large amounts of data specifically related to various drilling operations as stored in databases such as the databases 128 and 410. As described with respect to FIG. 1A, this data may include data collected from many different locations and may correspond to many different drilling operations. The data stored in the database 128 and other databases may be used for a variety of purposes, including data mining and analytics, which may aid in such processes as equipment comparisons, drilling plan formulation, convergence planning, recalibration forecasting, and self-tuning (e.g., drilling performance optimization). Some processes, such as equipment comparisons, may not be performed in real time using incoming data, while others, such as self-tuning, may be performed in real time or near real time. Accordingly, some processes may be executed at the drilling hub 216, other processes may be executed at the on-site controller 144, and still other processes may be executed by both the drilling hub 216 and the on-site controller 144 with communications occurring before, during, and/or after the processes are executed. As described below in various examples, some processes may be triggered by events (e.g., recalibration forecasting) while others may be ongoing (e.g., self-tuning).

For example, in equipment comparison, data from different drilling operations (e.g., from drilling the wells 102, 104, 106, and 108) may be normalized and used to compare equipment wear, performance, and similar factors. For example, the same bit may have been used to drill the wells 102 and 106, but the drilling may have been accomplished using different parameters (e.g., rotation speed and WOB). By normalizing the data, the two bits can be compared more effectively. The normalized data may be further processed to improve drilling efficiency by identifying which bits are most effective for particular rock layers, which drilling parameters resulted in the best ROP for a particular formation, ROP versus reliability tradeoffs for various bits in various rock layers, and similar factors. Such comparisons may be used to select a bit for another drilling operation based on formation characteristics or other criteria. Accordingly, by mining and analyzing the data available via the surface steerable system 201, an optimal equipment profile may be developed for different drilling operations. The equipment profile may then be used when planning future wells or to increase the efficiency of a well currently being drilled. This type of drilling optimization may become increasingly accurate as more data is compiled and analyzed.

In drilling plan formulation, the data available via the surface steerable system 201 may be used to identify likely formation characteristics and to select an appropriate equipment profile. For example, the geologist 304 may use local data obtained from the planned location of the drilling rig 110 in conjunction with regional data from the database 128 to identify likely locations of the layers 168A-176A (FIG. 1B). Based on that information, the drilling engineer 302 can create a well plan that will include the build curve of FIG. 1C.

Figure 6:
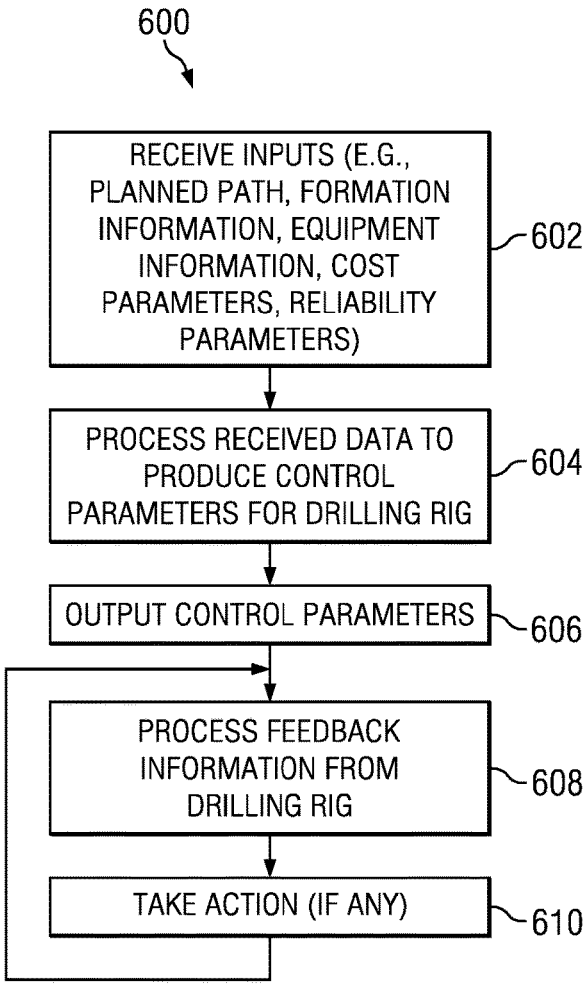
FIG. 6 illustrates one embodiment of a method that may be executed by the surface steerable system of FIG. 2A.

Referring to FIG. 6, a method 600 illustrates one embodiment of an event-based process that may be executed by the on-site controller 144 of FIG. 2A. For example, software instructions needed to execute the method 600 may be stored on a computer readable storage medium of the on-site controller 144 and then executed by the processor 412 that is coupled to the storage medium and is also part of the on-site controller 144.

In step 602, the on-site controller 144 receives inputs, such as a planned path for a borehole, formation information for the borehole, equipment information for the drilling rig, and a set of cost parameters. The cost parameters may be used to guide decisions made by the on-site controller 144 as will be explained in greater detail below. The inputs may be received in many different ways, including receiving document (e.g., spreadsheet) uploads, accessing a database (e.g., the database 128 of FIG. 1A), and/or receiving manually entered data.

In step 604, the planned path, the formation information, the equipment information, and the set of cost parameters are processed to produce control parameters (e.g., the control information 204 of FIG. 2A) for the drilling rig 110. The control parameters may define the settings for various drilling operations that are to be executed by the drilling rig 110 to form the borehole, such as WOB, flow rate of mud, toolface orientation, and similar settings. In some embodiments, the control parameters may also define particular equipment selections, such as a particular bit. In the present example, step 604 is directed to defining initial control parameters for the drilling rig 110 prior to the beginning of drilling, but it is understood that step 604 may be used to define control parameters for the drilling rig 110 even after drilling has begun. For example, the on-site controller 144 may be put in place prior to drilling or may be put in place after drilling has commenced, in which case the method 600 may also receive current borehole information in step 602.

In step 606, the control parameters are output for use by the drilling rig 110. In embodiments where the on-site controller 144 is directly coupled to the drilling rig 110, outputting the control parameters may include sending the control parameters directly to one or more of the control systems of the drilling rig 110 (e.g., the control systems 210, 212, and 214). In other embodiments, outputting the control parameters may include displaying the control parameters on a screen, printing the control parameters, and/or copying them to a storage medium (e.g., a Universal Serial Bus (USB) drive) to be transferred manually.

In step 608, feedback information received from the drilling rig 110 (e.g., from one or more of the control systems 210, 212, and 214 and/or sensor system 216) is processed. The feedback information may provide the on-site controller 144 with the current state of the borehole (e.g., depth and inclination), the drilling rig equipment, and the drilling process, including an estimated position of the bit in the borehole. The processing may include extracting desired data from the feedback information, normalizing the data, comparing the data to desired or ideal parameters, determining whether the data is within a defined margin of error, and/or any other processing steps needed to make use of the feedback information.

In step 610, the on-site controller 144 may take action based on the occurrence of one or more defined events. For example, an event may trigger a decision on how to proceed with drilling in the most cost effective manner. Events may be triggered by equipment malfunctions, path differences between the measured borehole and the planned borehole, upcoming maintenance periods, unexpected geological readings, and any other activity or non-activity that may affect drilling the borehole. It is understood that events may also be defined for occurrences that have a less direct impact on drilling, such as actual or predicted labor shortages, actual or potential licensing issues for mineral rights, actual or predicted political issues that may impact drilling, and similar actual or predicted occurrences. Step 610 may also result in no action being taken if, for example, drilling is occurring without any issues and the current control parameters are satisfactory.

An event may be defined in the received inputs of step 602 or defined later. Events may also be defined on site using the on-site controller 144. For example, if the drilling rig 110 has a particular mechanical issue, one or more events may be defined to monitor that issue in more detail than might ordinarily occur. In some embodiments, an event chain may be implemented where the occurrence of one event triggers the monitoring of another related event. For example, a first event may trigger a notification about a potential problem with a piece of equipment and may also activate monitoring of a second event. In addition to activating the monitoring of the second event, the triggering of the first event may result in the activation of additional oversight that involves, for example, checking the piece of equipment more frequently or at a higher level of detail. If the second event occurs, the equipment may be shut down and an alarm sounded, or other actions may be taken. This enables different levels of monitoring and different levels of responses to be assigned independently if needed.

Figure 7A:
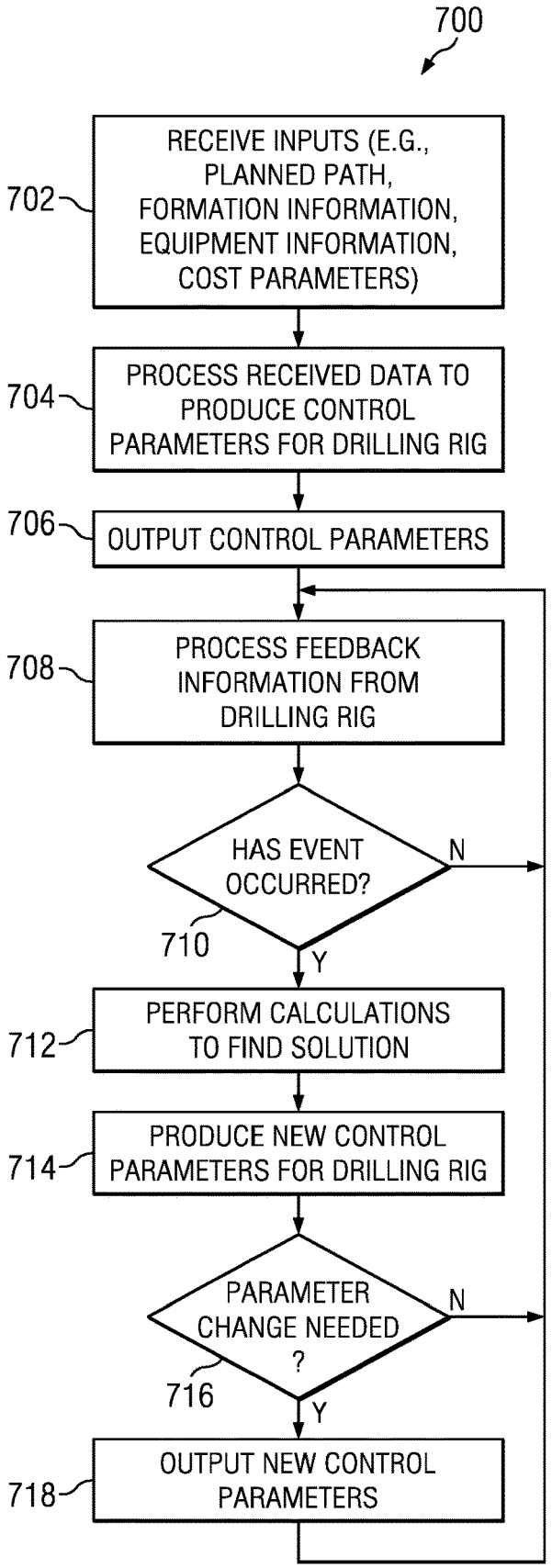
FIG. 7A illustrates a more detailed embodiment of the method of FIG. 6.

Referring to FIG. 7A, a method 700 illustrates a more detailed embodiment of the method 600 of FIG. 6, particularly of step 610. As steps 702, 704, 706, and 708 are similar or identical to steps 602, 604, 606, and 608, respectively, of FIG. 6, they are not described in detail in the present embodiment. In the present example, the action of step 610 of FIG. 6 is based on whether an event has occurred and the action needed if the event has occurred.

Accordingly, in step 710, a determination is made as to whether an event has occurred based on the inputs of steps 702 and 708. If no event has occurred, the method 700 returns to step 708. If an event has occurred, the method 700 moves to step 712, where calculations are performed based on the information relating to the event and at least one cost parameter. It is understood that additional information may be obtained and/or processed prior to or as part of step 712 if needed. For example, certain information may be used to determine whether an event has occurred, and additional information may then be retrieved and processed to determine the particulars of the event.

In step 714, new control parameters may be produced based on the calculations of step 712. In step 716, a determination may be made as to whether changes are needed in the current control parameters. For example, the calculations of step 712 may result in a decision that the current control parameters are satisfactory (e.g., the event may not affect the control parameters). If no changes are needed, the method 700 returns to step 708. If changes are needed, the on-site controller 144 outputs the new parameters in step 718. The method 700 may then return to step 708. In some embodiments, the determination of step 716 may occur before step 714. In such embodiments, step 714 may not be executed if the current control parameters are satisfactory.

In a more detailed example of the method 700, assume that the on-site controller 144 is involved in drilling a borehole and that approximately six hundred feet remain to be drilled. An event has been defined that warns the on-site controller 144 when the drill bit is predicted to reach a minimum level of efficiency due to wear and this event is triggered in step 710 at the six hundred foot mark. The event may be triggered because the drill bit is within a certain number of revolutions before reaching the minimum level of efficiency, within a certain distance remaining (based on strata type, thickness, etc.) that can be drilled before reaching the minimum level of efficiency, or may be based on some other factor or factors. Although the event of the current example is triggered prior to the predicted minimum level of efficiency being reached in order to proactively schedule drilling changes if needed, it is understood that the event may be triggered when the minimum level is actually reached.

The on-site controller 144 may perform calculations in step 712 that account for various factors that may be analyzed to determine how the last six hundred feet is drilled. These factors may include the rock type and thickness of the remaining six hundred feet, the predicted wear of the drill bit based on similar drilling conditions, location of the bit (e.g., depth), how long it will take to change the bit, and a cost versus time analysis. Generally, faster drilling is more cost effective, but there are many tradeoffs. For example, increasing the WOB or differential pressure to increase the rate of penetration may reduce the time it takes to finish the borehole, but may also wear out the drill bit faster, which will decrease the drilling effectiveness and slow the drilling down. If this slowdown occurs too early, it may be less efficient than drilling more slowly. Therefore, there is a tradeoff that must be calculated. Too much WOB or differential pressure may also cause other problems, such as damaging downhole tools. Should one of these problems occur, taking the time to trip the bit or drill a sidetrack may result in more total time to finish the borehole than simply drilling more slowly, so faster may not be better. The tradeoffs may be relatively complex, with many factors to be considered.

In step 714, the on-site controller 144 produces new control parameters based on the solution calculated in step 712. In step 716, a determination is made as to whether the current parameters should be replaced by the new parameters. For example, the new parameters may be compared to the current parameters. If the two sets of parameters are substantially similar (e.g., as calculated based on a percentage change or margin of error of the current path with a path that would be created using the new control parameters) or identical to the current parameters, no changes would be needed. However, if the new control parameters call for changes greater than the tolerated percentage change or outside of the margin of error, they are output in step 718. For example, the new control parameters may increase the WOB and also include the rate of mud flow significantly enough to override the previous control parameters. In other embodiments, the new control parameters may be output regardless of any differences, in which case step 716 may be omitted. In still other embodiments, the current path and the predicted path may be compared before the new parameters are produced, in which case step 714 may occur after step 716.

Figure 7B:
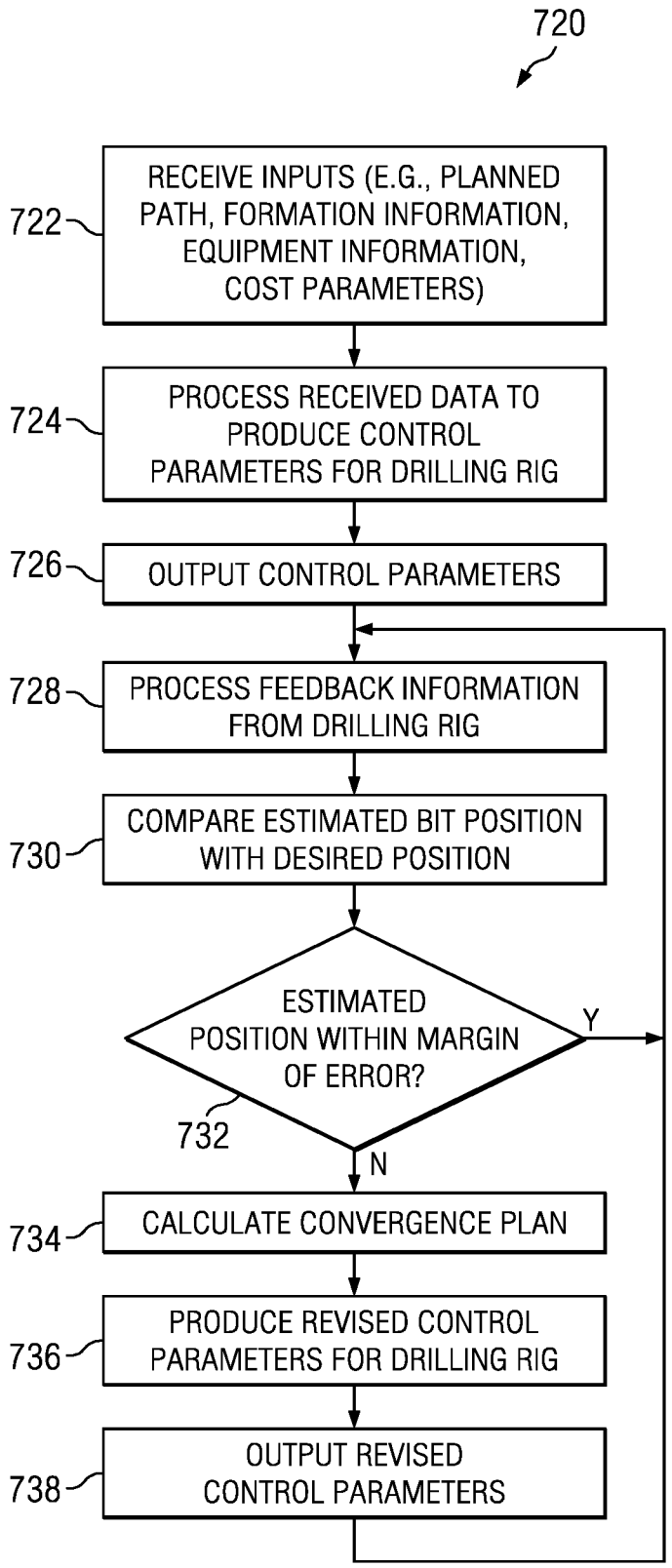
FIG. 7B illustrates a more detailed embodiment of the method of FIG. 6.
Figure 7C:
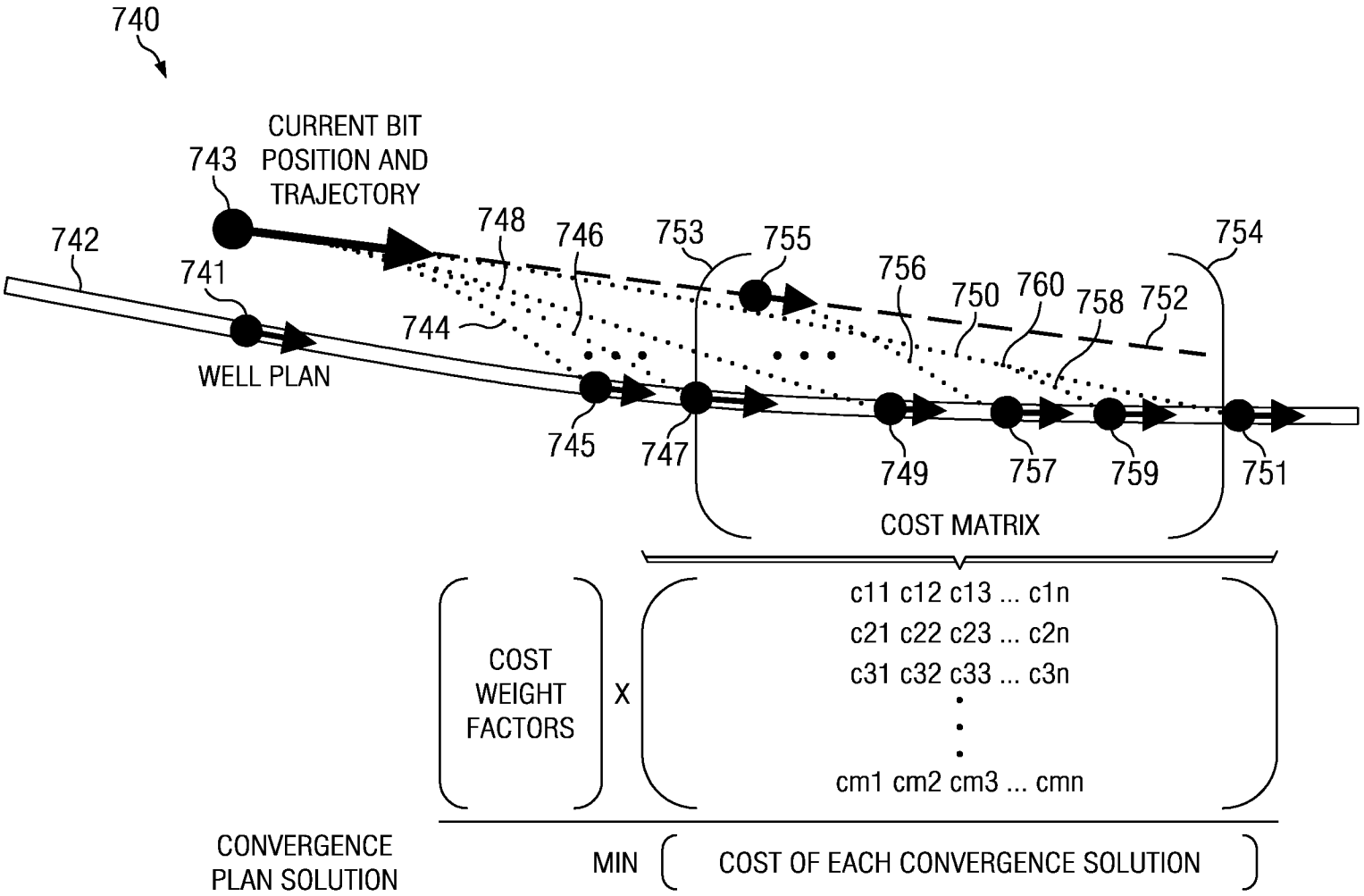
FIG. 7C illustrates one embodiment of a convergence plan diagram with multiple convergence paths.

Referring to FIG. 7B and with additional reference to FIG. 7C, a method 720 (FIG. 7B) and diagram 740 (FIG. 7C) illustrate a more detailed embodiment of the method 600 of FIG. 6, particularly of step 610. As steps 722, 724, 726, and 728 are similar or identical to steps 602, 604, 606, and 608, respectively, of FIG. 6, they are not described in detail in the present embodiment. In the present example, the action of step 610 of FIG. 6 is based on whether the drilling has deviated from the planned path.

In step 730, a comparison may be made to compare the estimated bit position and trajectory with a desired point (e.g., a desired bit position) along the planned path. The estimated bit position may be calculated based on information such as a survey reference point and/or represented as an output calculated by a borehole estimator (as will be described later) and may include a bit projection path and/or point that represents a predicted position of the bit if it continues its current trajectory from the estimated bit position. Such information may be included in the inputs of step 722 and feedback information of step 728 or may be obtained in other ways. It is understood that the estimated bit position and trajectory may not be calculated exactly, but may represent an estimate the current location of the drill bit based on the feedback information. As illustrated in FIG. 7C, the estimated bit position is indicated by arrow 743 relative to the desired bit position 741 along the planned path 742.

In step 732, a determination may be made as to whether the estimated bit position 743 is within a defined margin of error of the desired bit position. If the estimated bit position is within the margin of error, the method 720 returns to step 728. If the estimated bit position is not within the margin of error, the on-site controller 144 calculates a convergence plan in step 734. With reference to FIG. 7C, for purposes of the present example, the estimated bit position 743 is outside of the margin of error.

In some embodiments, a projected bit position (not shown) may also be used. For example, the estimated bit position 743 may be extended via calculations to determine where the bit is projected to be after a certain amount of drilling (e.g., time and/or distance). This information may be used in several ways. If the estimated bit position 743 is outside the margin of error, the projected bit position 743 may indicate that the current bit path will bring the bit within the margin of error without any action being taken. In such a scenario, action may be taken only if it will take too long to reach the projected bit position when a more optimal path is available. If the estimated bit position is inside the margin of error, the projected bit position may be used to determine if the current path is directing the bit away from the planned path. In other words, the projected bit position may be used to proactively detect that the bit is off course before the margin of error is reached. In such a scenario, action may be taken to correct the current path before the margin of error is reached.

The convergence plan identifies a plan by which the bit can be moved from the estimated bit position 743 to the planned path 742. It is noted that the convergence plan may bypass the desired bit position 741 entirely, as the objective is to get the actual drilling path back to the planned path 742 in the most optimal manner. The most optimal manner may be defined by cost, which may represent a financial value, a reliability value, a time value, and/or other values that may be defined for a convergence path.

As illustrated in FIG. 7C, an infinite number of paths may be selected to return the bit to the planned path 742. The paths may begin at the estimated bit position 743 or may begin at other points along a projected path 752 that may be determined by calculating future bit positions based on the current trajectory of the bit from the estimated bit position 752. In the present example, a first path 744 results in locating the bit at a position 745 (e.g., a convergence point). The convergence point 745 is outside of a lower limit 753 defined by a most aggressive possible correction (e.g., a lower limit on a window of correction). This correction represents the most aggressive possible convergence path, which may be limited by such factors as a maximum directional change possible in the convergence path, where any greater directional change creates a dogleg that makes it difficult or impossible to run casing or perform other needed tasks. A second path 746 results in a convergence point 747, which is right at the lower limit 753. A third path 748 results in a convergence point 749, which represents a mid-range convergence point. A third path 750 results in a convergence point 751, which occurs at an upper limit 754 defined by a maximum convergence delay (e.g., an upper limit on the window of correction).

A fourth path 756 may begin at a projected point or bit position 755 that lies along the projected path 752 and result in a convergence point 757, which represents a mid-range convergence point. The path 756 may be used by, for example, delaying a trajectory change until the bit reaches the position 755. Many additional convergence options may be opened up by using projected points for the basis of convergence plans as well as the estimated bit position.

A fifth path 758 may begin at a projected point or bit position 760 that lies along the projected path 750 and result in a convergence point 759. In such an embodiment, different convergence paths may include similar or identical path segments, such as the similar or identical path shared by the convergence points 751 and 759 to the point 760. For example, the point 760 may mark a position on the path 750 where a slide segment begins (or continues from a previous slide segment) for the path 758 and a straight line path segment begins (or continues) for the path 750. The surface steerable system 144 may calculate the paths 750 and 758 as two entirely separate paths or may calculate one of the paths as deviating from (e.g., being a child of) the other path. Accordingly, any path may have multiple paths deviating from that path based on, for example, different slide points and slide times.

Each of these paths 744, 746, 748, 750, 756, and 758 may present advantages and disadvantages from a drilling standpoint. For example, one path may be longer and may require more sliding in a relatively soft rock layer, while another path may be shorter but may require more sliding through a much harder rock layer. Accordingly, tradeoffs may be evaluated when selecting one of the convergence plans rather than simply selecting the most direct path for convergence. The tradeoffs may, for example, consider a balance between ROP, total cost, dogleg severity, and reliability. While the number of convergence plans may vary, there may be hundreds or thousands of convergence plans in some embodiments and the tradeoffs may be used to select one of those hundreds or thousands for implementation. The convergence plans from which the final convergence plan is selected may include plans calculated from the estimated bit position 743 as well as plans calculated from one or more projected points along the projected path.

In some embodiments, straight line projections of the convergence point vectors, after correction to the well plan 742, may be evaluated to predict the time and/or distance to the next correction requirement. This evaluation may be used when selecting the lowest total cost option by avoiding multiple corrections where a single more forward thinking option might be optimal. As an example, one of the solutions provided by the convergence planning may result in the most cost effective path to return to the well plan 742, but may result in an almost immediate need for a second correction due to a pending deviation within the well plan. Accordingly, a convergence path that merges the pending deviation with the correction by selecting a convergence point beyond the pending deviation might be selected when considering total well costs.

It is understood that the diagram 740 of FIG. 7C is a two dimensional representation of a three dimensional environment. Accordingly, the illustrated convergence paths in the diagram 740 of FIG. 7C may be three dimensional. In addition, although the illustrated convergence paths all converge with the planned path 742, is it understood that some convergence paths may be calculated that move away from the planned path 742 (although such paths may be rejected). Still other convergence paths may overshoot the actual path 742 and then converge (e.g., if there isn't enough room to build the curve otherwise). Accordingly, many different convergence path structures may be calculated.

Referring again to FIG. 7B, in step 736, the on-site controller 144 produces revised control parameters based on the convergence plan calculated in step 734. In step 738, the revised control parameters may be output. It is understood that the revised control parameters may be provided to get the drill bit back to the planned path 742 and the original control parameters may then be used from that point on (starting at the convergence point). For example, if the convergence plan selected the path 748, the revised control parameters may be used until the bit reaches position 749. Once the bit reaches the position 749, the original control parameters may be used for further drilling. Alternatively, the revised control parameters may incorporate the original control parameters starting at the position 749 or may re-calculate control parameters for the planned path even beyond the point 749. Accordingly, the convergence plan may result in control parameters from the bit position 743 to the position 749, and further control parameters may be reused or calculated depending on the particular implementation of the on-site controller 144.

Figure 8A:
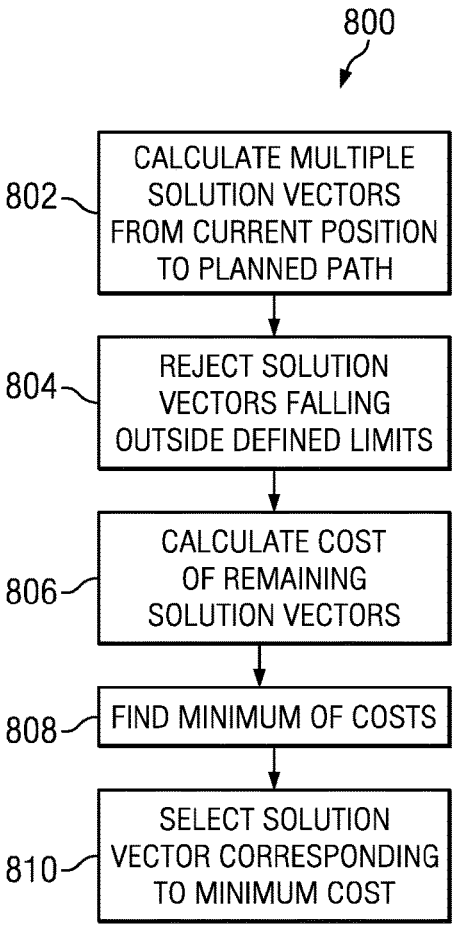
FIG. 8A illustrates a more detailed embodiment of a portion of the method of FIG. 7B.

Referring to FIG. 8A, a method 800 illustrates a more detailed embodiment of step 734 of FIG. 7B. It is understood that the convergence plan of step 734 may be calculated in many different ways, and that 800 method provides one possible approach to such a calculation when the goal is to find the lowest cost solution vector. In the present example, cost may include both the financial cost of a solution and the reliability cost of a solution. Other costs, such as time costs, may also be included. For purposes of example, the diagram 740 of FIG. 7C is used.

In step 802, multiple solution vectors are calculated from the current position 743 to the planned path 742. These solution vectors may include the paths 744, 746, 748, and 750. Additional paths (not shown in FIG. 7C) may also be calculated. The number of solution vectors that are calculated may vary depending on various factors. For example, the distance available to build a needed curve to get back to the planned path 742 may vary depending on the current bit location and orientation relative to the planned path. A greater number of solution vectors may be available when there is a greater distance in which to build a curve than for a smaller distance since the smaller distance may require a much more aggressive build rate that excludes lesser build rates that may be used for the greater distance. In other words, the earlier an error is caught, the more possible solution vectors there will generally be due to the greater distance over which the error can be corrected. While the number of solution vectors that are calculated in this step may vary, there may be hundreds or thousands of solution vectors calculated in some embodiments.

In step 804, any solution vectors that fall outside of defined limits are rejected, such as solution vectors that fall outside the lower limit 753 and the upper limit 754. For example, the path 744 would be rejected because the convergence point 745 falls outside of the lower limit 753. It is understood that the path 744 may be rejected for an engineering reason (e.g., the path would require a dogleg of greater than allowed severity) prior to cost considerations, or the engineering reason may be considered a cost.

In step 806, a cost is calculated for each remaining solution vector. As illustrated in FIG. 7C, the costs may be represented as a cost matrix (that may or may not be weighted) with each solution vector having corresponding costs in the cost matrix. In step 808, a minimum of the solution vectors may be taken to identify the lowest cost solution vector. It is understood that the minimum cost is one way of selecting the desired solution vector, and that other ways may be used. Accordingly, step 808 is concerned with selecting an optimal solution vector based on a set of target parameters, which may include one or more of a financial cost, a time cost, a reliability cost, and/or any other factors, such as an engineering cost like dogleg severity, that may be used to narrow the set of solution vectors to the optimal solution vector.

By weighting the costs, the cost matrix can be customized to handle many different cost scenarios and desired results. For example, if time is of primary importance, a time cost may be weighted over financial and reliability costs to ensure that a solution vector that is faster will be selected over other solution vectors that are substantially the same but somewhat slower, even though the other solution vectors may be more beneficial in terms of financial cost and reliability cost. In some embodiments, step 804 may be combined with step 808 and solution vectors falling outside of the limits may be given a cost that ensures they will not be selected. In step 810, the solution vector corresponding to the minimum cost is selected.

Figure 8B:
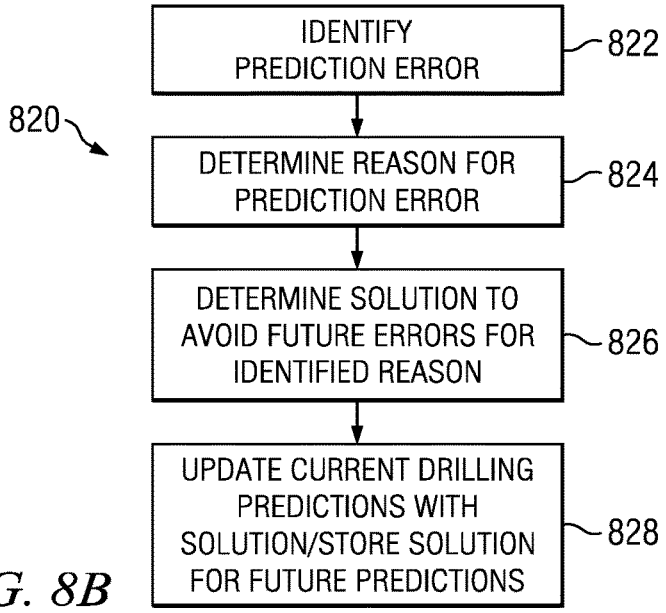
FIG. 8B illustrates a more detailed embodiment of a portion of the method of FIG. 6.

Referring to FIG. 8B, a method 820 illustrates one embodiment of an event-based process that may be executed by the on-site controller 144 of FIG. 2A. It is understood that an event may represent many different scenarios in the surface steerable system 201. In the present example, in step 822, an event may occur that indicates that a prediction is not correct based on what has actually occurred. For example, a formation layer is not where it is expected (e.g., too high or low), a selected bit did not drill as expected, or a selected mud motor did not build curve as expected. The prediction error may be identified by comparing expected results with actual results or by using other detection methods.

In step 824, a reason for the error may be determined as the surface steerable system 201 and its data may provide an environment in which the prediction error can be evaluated. For example, if a bit did not drill as expected, the method 820 may examine many different factors, such as whether the rock formation was different than expected, whether the drilling parameters were correct, whether the drilling parameters were correctly entered by the driller, whether another error and/or failure occurred that caused the bit to drill poorly, and whether the bit simply failed to perform. By accessing and analyzing the available data, the reason for the failure may be determined.

In step 826, a solution may be determined for the error. For example, if the rock formation was different than expected, the database 128 may be updated with the correct rock information and new drilling parameters may be obtained for the drilling rig 110. Alternatively, the current bit may be tripped and replaced with another bit more suitable for the rock. In step 828, the current drilling predictions (e.g., well plan, build rate, slide estimates) may be updated based on the solution and the solution may be stored in the database 128 for use in future predictions. Accordingly, the method 820 may result in benefits for future wells as well as improving current well predictions.

Figure 8C:
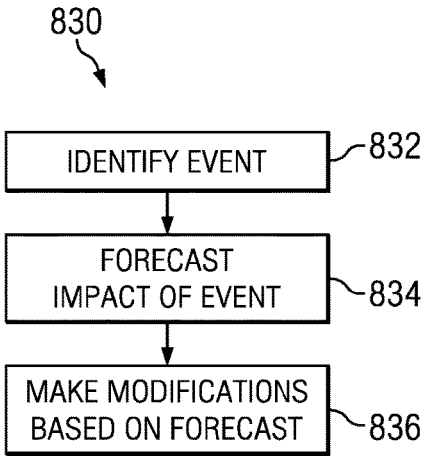
FIG. 8C illustrates a more detailed embodiment of a portion of the method of FIG. 6.

Referring to FIG. 8C, a method 830 illustrates one embodiment of an event-based process that may be executed by the on-site controller 144 of FIG. 2A. The method 830 is directed to recalibration forecasting that may be triggered by an event, such as an event detected in step 610 of FIG. 6. It is understood that the recalibration described in this embodiment may not be the same as calculating a convergence plan, although calculating a convergence plan may be part of the recalibration. As an example of a recalibration triggering event, a shift in ROP and/or GAMMA readings may indicate that a formation layer (e.g., the layer 170A of FIG. 1B) is actually twenty feet higher than planned. This will likely impact the well plan, as build rate predictions and other drilling parameters may need to be changed. Accordingly, in step 832, this event is identified.

In step 834, a forecast may be made as to the impact of the event. For example, the surface steerable system 201 may determine whether the projected build rate needed to land the curve can be met based on the twenty foot difference. This determination may include examining the current location of the bit, the projected path, and similar information.

In step 836, modifications may be made based on the forecast. For example, if the projected build rate can be met, then modifications may be made to the drilling parameters to address the formation depth difference, but the modifications may be relatively minor. However, if the projected build rate cannot be met, the surface steerable system 201 may determine how to address the situation by, for example, planning a bit trip to replace the current BHA with a BHA capable of making a new and more aggressive curve.

Such decisions may be automated or may require input or approval by the drilling engineer 302, geologist 304, or other individuals. For example, depending on the distance to the kick off point, the surface steerable system 201 may first stop drilling and then send an alert to an authorized individual, such as the drilling engineer 302 and/or geologist 304. The drilling engineer 302 and geologist 304 may then become involved in planning a solution or may approve of a solution proposed by the surface steerable system 201. In some embodiments, the surface steerable system 201 may automatically implement its calculated solution. Parameters may be set for such automatic implementation measures to ensure that drastic deviations from the original well plan do not occur automatically while allowing the automatic implementation of more minor measures.

It is understood that such recalibration forecasts may be performed based on many different factors and may be triggered by many different events. The forecasting portion of the process is directed to anticipating what changes may be needed due to the recalibration and calculating how such changes may be implemented. Such forecasting provides cost advantages because more options may be available when a problem is detected earlier rather than later. Using the previous example, the earlier the difference in the depth of the layer is identified, the more likely it is that the build rate can be met without changing the BHA.

Figure 8D:
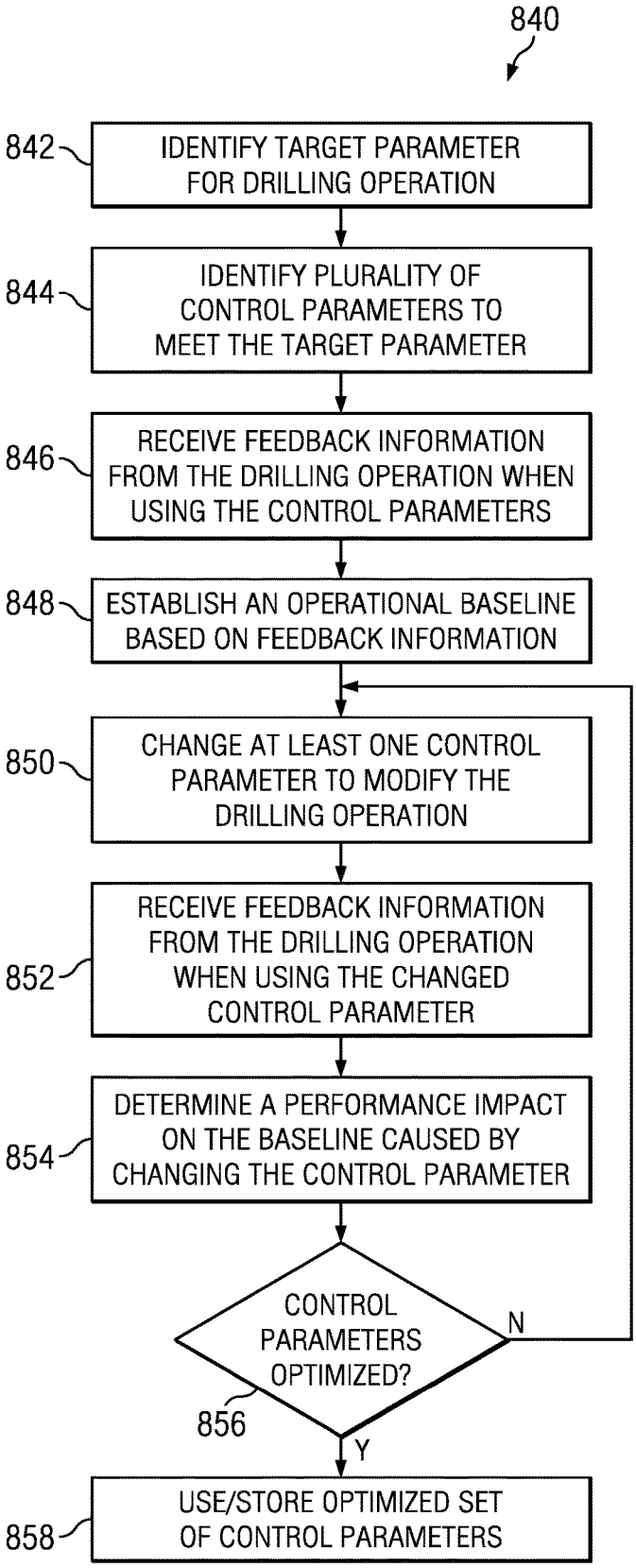
FIG. 8D illustrates a more detailed embodiment of a portion of the method of FIG. 6.

Referring to FIG. 8D, a method 840 illustrates one embodiment of an event-based process that may be executed by the on-site controller 144 of FIG. 2A. The method 840 is directed to self-tuning that may be performed by the on-site controller 144 based on factors such as ROP, total cost, and reliability. By self-tuning, the on-site controller 144 may execute a learning process that enables it to optimize the drilling performance of the drilling rig 110. Furthermore, the self-tuning process enables a balance to be reached that provides reliability while also lowering costs. Reliability in drilling operations is often tied to vibration and the problems that vibration can cause, such as stick-slip and whirling. Such vibration issues can damage or destroy equipment and can also result in a very uneven surface in the borehole that can cause other problems such as friction loading of future drilling operations as pipe/casing passes through that area of the borehole. Accordingly, it is desirable to minimize vibration while optimizing performance, since over-correcting for vibration may result in slower drilling than necessary. It is understood that the present optimization may involve a change in any drilling parameter and is not limited to a particular piece of equipment or control system. In other words, parameters across the entire drilling rig 110 and BHA may be changed during the self-tuning process. Furthermore, the optimization process may be applied to production by optimizing well smoothness and other factors affecting production. For example, by minimizing dogleg severity, production may be increased for the lifetime of the well.

Accordingly, in step 842, one or more target parameters are identified. For example, the target parameter may be an MSE of 50 ksi or an ROP of 100 ft/hr that the on-site controller 144 is to establish and maintain. In step 844, a plurality of control parameters are identified for use with the drilling operation. The control parameters are selected to meet the target MSE of 50 ksi or ROP of 100 ft/hr. The drilling operation is started with the control parameters, which may be used until the target MSE or ROP is reached. In step 846, feedback information is received from the drilling operation when the control parameters are being used, so the feedback represents the performance of the drilling operation as controlled by the control parameters. Historical information may also be used in step 846. In step 848, an operational baseline is established based on the feedback information.

In step 850, at least one of the control parameters is changed to modify the drilling operation, although the target MSE or ROP should be maintained. For example, some or all of the control parameters may be associated with a range of values and the value of one or more of the control parameters may be changed. In step 852, more feedback information is received, but this time the feedback reflects the performance of the drilling operation with the changed control parameter. In step 854, a performance impact of the change is determined with respect to the operational baseline. The performance impact may occur in various ways, such as a change in MSE or ROP and/or a change in vibration. In step 856, a determination is made as to whether the control parameters are optimized. If the control parameters are not optimized, the method 840 returns to step 850. If the control parameters are optimized, the method 840 moves to step 858. In step 858, the optimized control parameters are used for the current drilling operation with the target MSE or ROP and stored (e.g., in the database 128) for use in later drilling operations and operational analyses. This may include linking formation information to the control parameters in the regional database 128.

Figure 9:
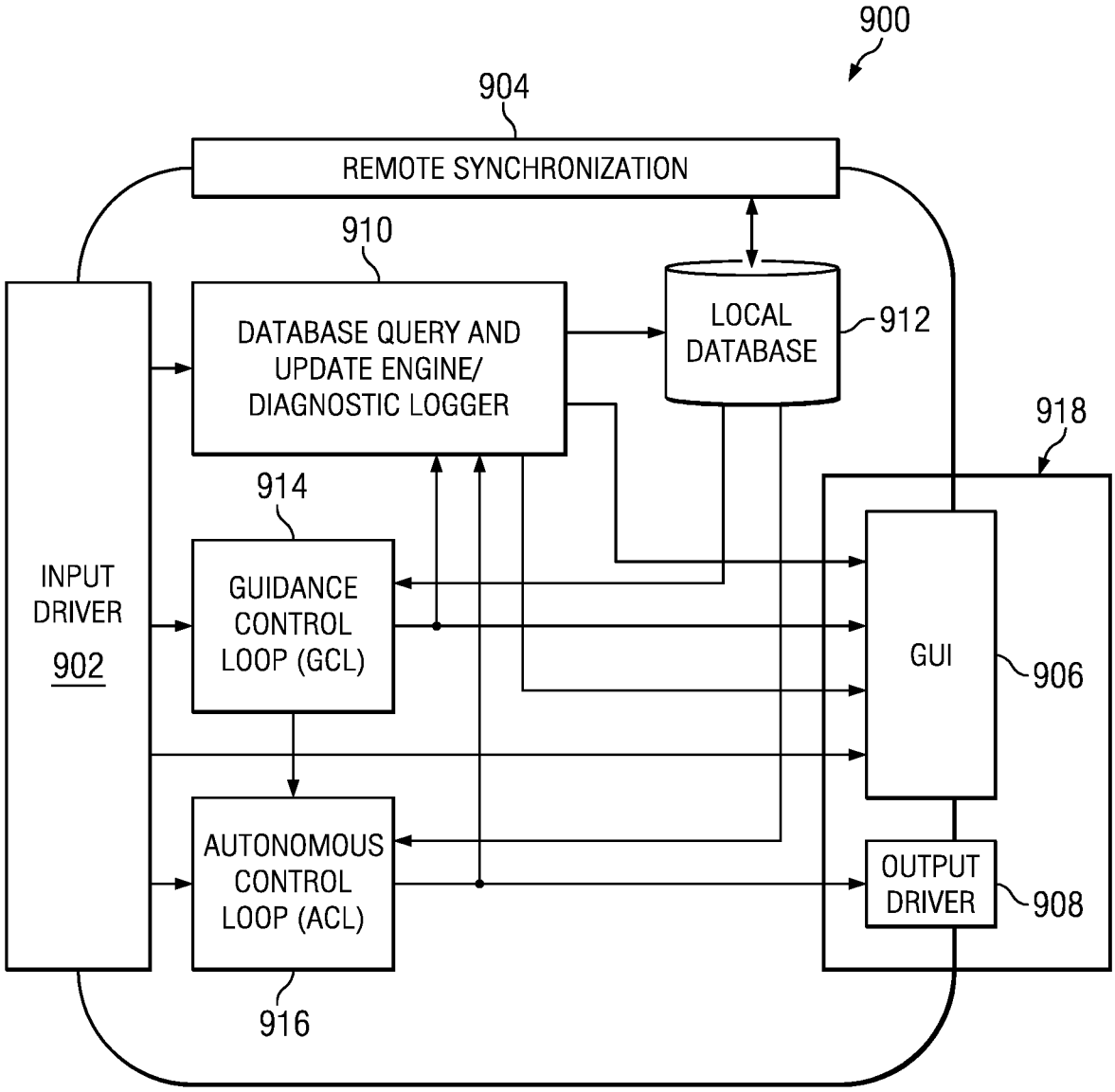
FIG. 9 illustrates one embodiment of a system architecture that may be used for the surface steerable system of FIG. 2A.

Referring to FIG. 9, one embodiment of a system architecture 900 is illustrated that may be used for the on-site controller 144 of FIG. 1A. The system architecture 900 includes interfaces configured to interact with external components and internal modules configured to process information. The interfaces may include an input driver 902, a remote synchronization interface 904, and an output interface 918, which may include at least one of a graphical user interface (GUI) 906 and an output driver 908. The internal modules may include a database query and update engine/diagnostic logger 910, a local database 912 (which may be similar or identical to the database 410 of FIG. 4), a guidance control loop (GCL) module 914, and an autonomous control loop (ACL) module 916. It is understood that the system architecture 900 is merely one example of a system architecture that may be used for the on-site controller 144 and the functionality may be provided for the on-site controller 144 using many different architectures. Accordingly, the functionality described herein with respect to particular modules and architecture components may be combined, further separated, and organized in many different ways.

It is understood that the computer steerable system 144 may perform certain computations to prevent errors or inaccuracies from accumulating and throwing off calculations. For example, as will be described later, the input driver 902 may receive Wellsite Information Transfer Specification (WITS) input representing absolute pressure, while the surface steerable system 144 needs differential pressure and needs an accurate zero point for the differential pressure. Generally, the driller will zero out the differential pressure when the drillstring is positioned with the bit off bottom and full pump flow is occurring. However, this may be a relatively sporadic event. Accordingly, the surface steerable system 144 may recognize when the bit is off bottom and target flow rate has been achieved and zero out the differential pressure.

Another computation may involve block height, which needs to be calibrated properly. For example, block height may oscillate over a wide range, including distances that may not even be possible for a particular drilling rig. Accordingly, if the reported range is sixty feet to one hundred and fifty feet and there should only be one hundred feet, the surface steerable system 144 may assign a zero value to the reported sixty feet and a one hundred foot value to the reported one hundred and fifty feet. Furthermore, during drilling, error gradually accumulates as the cable is shifted and other events occur. The surface steerable system 144 may compute its own block height to predict when the next connection occurs and other related events, and may also take into account any error that may be introduced by cable issues.

Referring specifically to FIG. 9, the input driver 902 provides output to the GUI 906, the database query and update engine/diagnostic logger 910, the GCL 914, and the ACL 916. The input driver 902 is configured to receive input for the on-site controller 144. It is understood that the input driver 902 may include the functionality needed to receive various file types, formats, and data streams. The input driver 902 may also be configured to convert formats if needed. Accordingly, the input driver 902 may be configured to provide flexibility to the on-site controller 144 by handling incoming data without the need to change the internal modules. In some embodiments, for purposes of abstraction, the protocol of the data stream can be arbitrary with an input event defined as a single change (e.g., a real time sensor change) of any of the given inputs.

The input driver 902 may receive various types of input, including rig sensor input (e.g., from the sensor system 214 of FIG. 2A), well plan data, and control data (e.g., engineering control parameters). For example, rig sensor input may include hole depth, bit depth, toolface, inclination, azimuth, true vertical depth, gamma count, standpipe pressure, mud flow rate, rotary RPMs, bit speed, ROP, and WOB. The well plan data may include information such as projected starting and ending locations of various geologic layers at vertical depth points along the well plan path, and a planned path of the borehole presented in a three dimensional space. The control data may be used to define maximum operating parameters and other limitations to control drilling speed, limit the amount of deviation permitted from the planned path, define levels of authority (e.g., can an on-site operator make a particular decision or should it be made by an off-site engineer), and similar limitations. The input driver 902 may also handle manual input, such as input entered via a keyboard, a mouse, or a touch screen. In some embodiments, the input driver 902 may also handle wireless signal input, such as from a cell phone, a smart phone, a PDA, a tablet, a laptop, or any other device capable of wirelessly communicating with the on-site controller 144 through a network locally and/or offsite.

The database query and update engine/diagnostic logger 910 receives input from the input driver 902, the GCL 914, and ACL 916, and provides output to the local database 912 and GUI 906. The database query and update engine/diagnostic logger 910 is configured to manage the archiving of data to the local database 912. The database query and update engine/diagnostic logger 910 may also manage some functional requirements of a remote synchronization server (RSS) via the remote synchronization interface 904 for archiving data that will be uploaded and synchronized with a remote database, such as the database 128 of FIG. 1A. The database query and update engine/diagnostic logger 910 may also be configured to serve as a diagnostic tool for evaluating algorithm behavior and performance against raw rig data and sensor feedback data.

The local database 912 receives input from the database query and update engine/diagnostic logger 910 and the remote synchronization interface 904, and provides output to the GCL 914, the ACL 916, and the remote synchronization interface 904. It is understood that the local database 912 may be configured in many different ways. As described in previous embodiments, the local database 912 may store both current and historic information representing both the current drilling operation with which the on-site controller 144 is engaged as well as regional information from the database 128.

The GCL 914 receives input from the input driver 902 and the local database 912, and provides output to the database query and update engine/diagnostic logger 910, the GUI 906, and the ACL 916. Although not shown, in some embodiments, the GCL 906 may provide output to the output driver 908, which enables the GCL 914 to directly control third party systems and/or interface with the drilling rig alone or with the ACL 916. An embodiment of the GCL 914 is discussed below with respect to FIG. 11.

The ACL 916 receives input from the input driver 902, the local database 912, and the GCL 914, and provides output to the database query and update engine/diagnostic logger 910 and output driver 908. An embodiment of the ACL 916 is discussed below with respect to FIG. 12.

The output interface 918 receives input from the input driver 902, the GCL 914, and the ACL 916. In the present example, the GUI 906 receives input from the input driver 902 and the GCL 914. The GUI 906 may display output on a monitor or other visual indicator. The output driver 908 receives input from the ACL 916 and is configured to provide an interface between the on-site controller 144 and external control systems, such as the control systems 208, 210, and 212 of FIG. 2A.

It is understood that the system architecture 900 of FIG. 9 may be configured in many different ways. For example, various interfaces and modules may be combined or further separated. Accordingly, the system architecture 900 provides one example of how functionality may be structured to provide the on-site controller 144, but the on-site controller 144 is not limited to the illustrated structure of FIG. 9.

Figure 10:
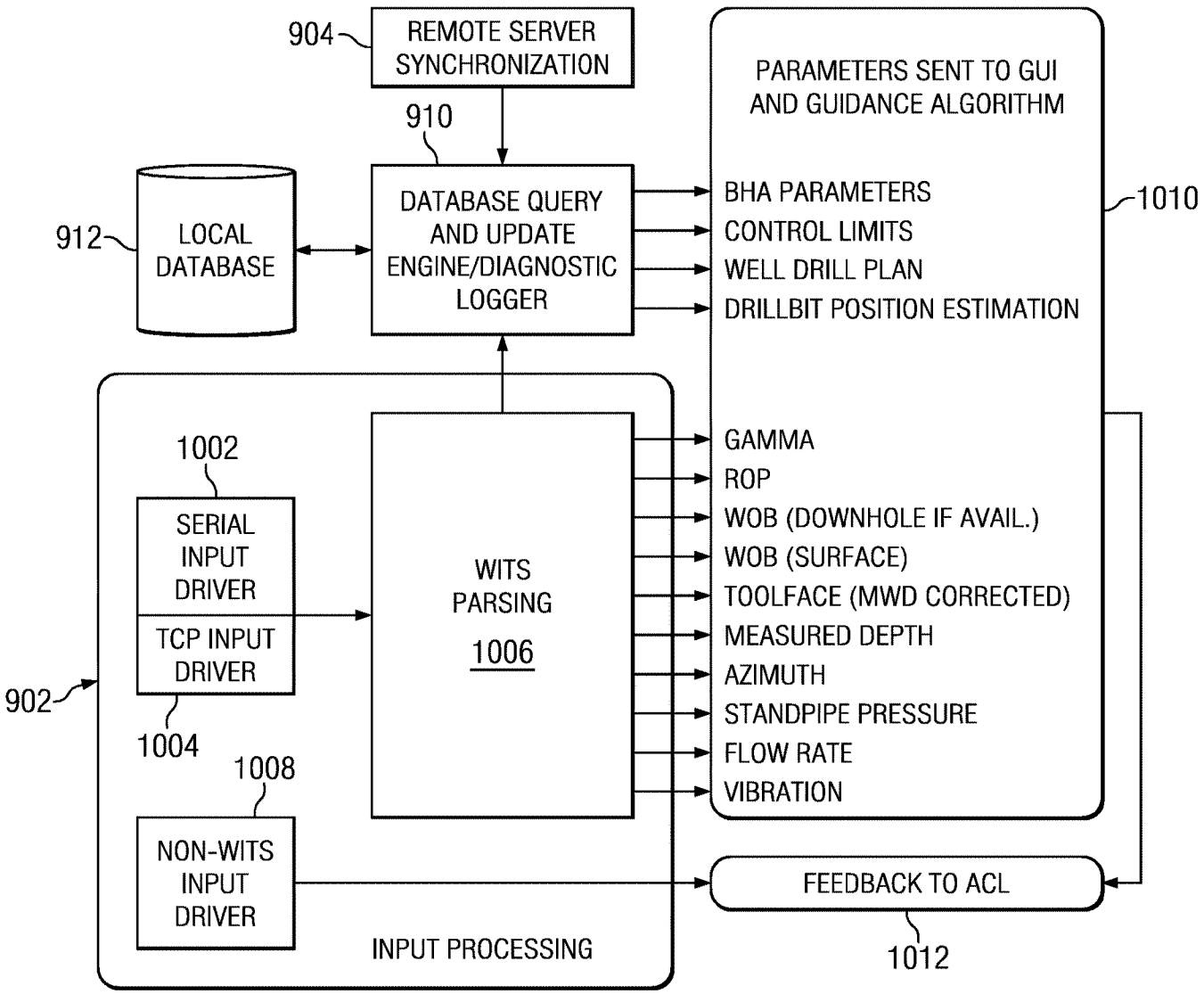
FIG. 10 illustrates one embodiment of a more detailed portion of the system architecture of FIG. 9.

Referring to FIG. 10, one embodiment of the input driver 902 of the system architecture 900 of FIG. 9 is illustrated in greater detail. In the present example, the input driver 902 may be configured to receive input via different input interfaces, such as a serial input driver 1002 and a Transmission Control Protocol (TCP) driver 1004. Both the serial input driver 1002 and the TCP input driver 1004 may feed into a parser 1006.

The parser 1006 in the present example may be configured in accordance with a specification such as WITS and/or using a standard such as Wellsite Information Transfer Standard Markup Language (WITSML). WITS is a specification for the transfer of drilling rig-related data and uses a binary file format. WITS may be replaced or supplemented in some embodiments by WITSML, which relies on eXtensible Markup Language (XML) for transferring such information. The parser 1006 may feed into the database query and update engine/diagnostic logger 910, and also to the GCL 914 and GUI 906 as illustrated by the example parameters of block 1010. The input driver 902 may also include a non-WITS input driver 1008 that provides input to the ACL 916 as illustrated by block 1012.

Figure 11:
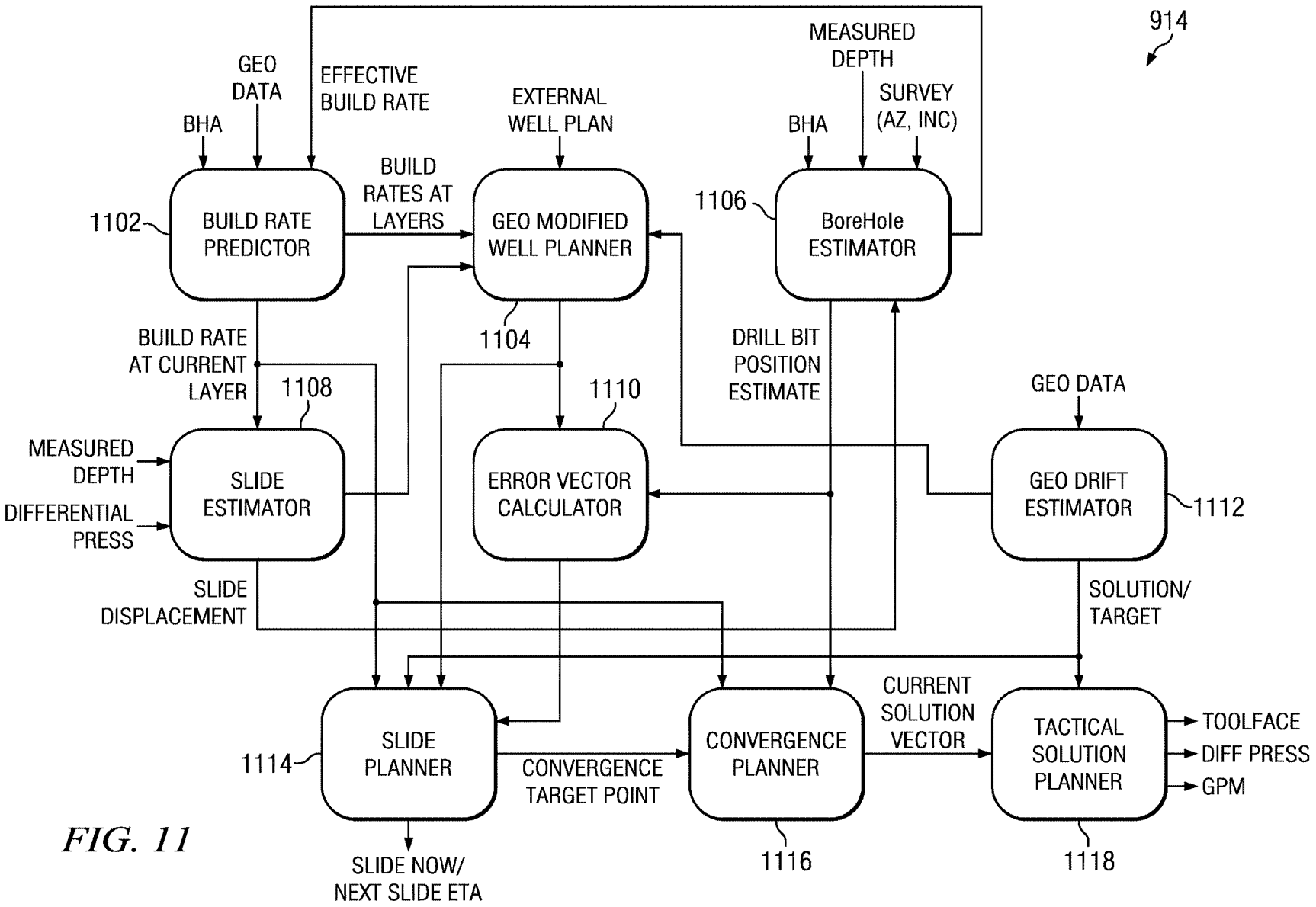
FIG. 11 illustrates one embodiment of a guidance control loop that may be used within the system architecture of FIG. 9.

Referring to FIG. 11, one embodiment of the GCL 914 of FIG. 9 is illustrated in greater detail. In the present example, the GCL 914 may include various functional modules, including a build rate predictor 1102, a geo modified well planner 1104, a borehole estimator 1106, a slide estimator 1108, an error vector calculator 1110, a geological drift estimator 1112, a slide planner 1114, a convergence planner 1116, and a tactical solution planner 1118. In the following description of the GCL 914, the term external input refers to input received from outside the GCL 914 (e.g., from the input driver 902 of FIG. 9), while internal input refers to input received by a GCL module from another GCL module.

The build rate predictor 1102 receives external input representing BHA and geological information, receives internal input from the borehole estimator 1106, and provides output to the geo modified well planner 1104, slide estimator 1108, slide planner 1114, and convergence planner 1116. The build rate predictor 1102 is configured to use the BHA and geological information to predict the drilling build rates of current and future sections of a well. For example, the build rate predictor 1102 may determine how aggressively the curve will be built for a given formation with given BHA and other equipment parameters.

The build rate predictor 1102 may use the orientation of the BHA to the formation to determine an angle of attack for formation transitions and build rates within a single layer of a formation. For example, if there is a layer of rock with a layer of sand above it, there is a formation transition from the sand layer to the rock layer. Approaching the rock layer at a ninety degree angle may provide a good face and a clean drill entry, while approaching the rock layer at a forty-five degree angle may build a curve relatively quickly. An angle of approach that is near parallel may cause the bit to skip off the upper surface of the rock layer. Accordingly, the build rate predictor 1102 may calculate BHA orientation to account for formation transitions. Within a single layer, the build rate predictor 1102 may use BHA orientation to account for internal layer characteristics (e.g., grain) to determine build rates for different parts of a layer.

The BHA information may include bit characteristics, mud motor bend setting, stabilization and mud motor bit to bend distance. The geological information may include formation data such as compressive strength, thicknesses, and depths for formations encountered in the specific drilling location. Such information enables a calculation-based prediction of the build rates and ROP that may be compared to both real time results (e.g., obtained while drilling the well) and regional historical results (e.g., from the database 128) to improve the accuracy of predictions as the drilling progresses. Future formation build rate predictions may be used to plan convergence adjustments and confirm that targets can be achieved with current variables in advance.

The geo modified well planner 1104 receives external input representing a well plan, internal input from the build rate predictor 1102 and the geo drift estimator 1112, and provides output to the slide planner 1114 and the error vector calculator 1110. The geo modified well planner 1104 uses the input to determine whether there is a more optimal path than that provided by the external well plan while staying within the original well plan error limits. More specifically, the geo modified well planner 1104 takes geological information (e.g., drift) and calculates whether another solution to the target may be more efficient in terms of cost and/or reliability. The outputs of the geo modified well planner 1104 to the slide planner 1114 and the error vector calculator 1110 may be used to calculate an error vector based on the current vector to the newly calculated path and to modify slide predictions.

In some embodiments, the geo modified well planner 1104 (or another module) may provide functionality needed to track a formation trend. For example, in horizontal wells, the geologist 304 may provide the surface steerable system 144 with a target inclination that the surface steerable system 144 is to attempt to hold. For example, the geologist 304 may provide a target to the directional driller 306 of 90.5-91 degrees of inclination for a section of the well. The geologist 304 may enter this information into the surface steerable system 144 and the directional driller 306 may retrieve the information from the surface steerable system 144. The geo modified well planner 1104 may then treat the target as a vector target, for example, either by processing the information provided by the geologist 304 to create the vector target or by using a vector target entered by the geologist 304. The geo modified well planner 1104 may accomplish this while remaining within the error limits of the original well plan.

In some embodiments, the geo modified well planner 1104 may be an optional module that is not used unless the well plan is to be modified. For example, if the well plan is marked in the surface steerable system 201 as non-modifiable, the geo modified well planner 1104 may be bypassed altogether or the geo modified well planner 1104 may be configured to pass the well plan through without any changes.

The borehole estimator 1106 receives external inputs representing BHA information, measured depth information, survey information (e.g., azimuth and inclination), and provides outputs to the build rate predictor 1102, the error vector calculator 1110, and the convergence planner 1116. The borehole estimator 1106 is configured to provide a real time or near real time estimate of the actual borehole and drill bit position and trajectory angle. This estimate may use both straight line projections and projections that incorporate sliding. The borehole estimator 1106 may be used to compensate for the fact that a sensor is usually physically located some distance behind the bit (e.g., fifty feet), which makes sensor readings lag the actual bit location by fifty feet. The borehole estimator 1106 may also be used to compensate for the fact that sensor measurements may not be continuous (e.g., a sensor measurement may occur every one hundred feet).

The borehole estimator 1106 may use two techniques to accomplish this. First, the borehole estimator 1106 may provide the most accurate estimate from the surface to the last survey location based on the collection of all survey measurements. Second, the borehole estimator 1106 may take the slide estimate from the slide estimator 1108 (described below) and extend this estimation from the last survey point to the real time drill bit location. Using the combination of these two estimates, the borehole estimator 1106 may provide the on-site controller 144 with an estimate of the drill bit's location and trajectory angle from which guidance and steering solutions can be derived. An additional metric that can be derived from the borehole estimate is the effective build rate that is achieved throughout the drilling process. For example, the borehole estimator 1106 may calculate the current bit position and trajectory 743 in FIG. 7C.

The slide estimator 1108 receives external inputs representing measured depth and differential pressure information, receives internal input from the build rate predictor 1102, and provides output to the borehole estimator 1106 and the geo modified well planner 1104. The slide estimator 1108, which may operate in real time or near real time, is configured to sample toolface orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the MWD survey sensor point passes the slide portion of the borehole, often resulting in a response lag defined by the distance of the sensor point from the drill bit tip (e.g., approximately fifty feet). This lag introduces inefficiencies in the slide cycles due to over/under correction of the actual path relative to the planned path.

With the slide estimator 1108, each toolface update is algorithmically merged with the average differential pressure of the period between the previous and current toolfaces, as well as the MD change during this period to predict the direction, angular deviation, and MD progress during that period. As an example, the periodic rate may be between ten and sixty seconds per cycle depending on the tool face update rate of the MWD tool. With a more accurate estimation of the slide effectiveness, the sliding efficiency can be improved. The output of the slide estimator 1108 is periodically provided to the borehole estimator 1106 for accumulation of well deviation information, as well to the geo modified well planner 1104. Some or all of the output of the slide estimator 1108 may be output via a display such as the display 250 of FIG. 2B.

The error vector calculator 1110 receives internal input from the geo modified well planner 1104 and the borehole estimator 1106. The error vector calculator 1110 is configured to compare the planned well path to the actual borehole path and drill bit position estimate. The error vector calculator 1110 may provide the metrics used to determine the error (e.g., how far off) the current drill bit position and trajectory are from the plan. For example, the error vector calculator 1110 may calculate the error between the current position 743 of FIG. 7C to the planned path 742 and the desired bit position 741. The error vector calculator 1110 may also calculate a projected bit position/projected path representing the future result of a current error as described previously with respect to FIG. 7B.

The geological drift estimator 1112 receives external input representing geological information and provides outputs to the geo modified well planner 1104, slide planner 1114, and tactical solution planner 1118. During drilling, drift may occur as the particular characteristics of the formation affect the drilling direction. More specifically, there may be a trajectory bias that is contributed by the formation as a function of drilling rate and BHA. The geological drift estimator 1112 is configured to provide a drift estimate as a vector. This vector can then be used to calculate drift compensation parameters that can be used to offset the drift in a control solution.

The slide planner 1114 receives internal input from the build rate predictor 1102, the geo modified well planner 1104, the error vector calculator 1110, and the geological drift estimator 1112, and provides output to the convergence planner 1116 as well as an estimated time to the next slide. The slide planner 1114 is configured to evaluate a slide/drill ahead cost equation and plan for sliding activity, which may include factoring in BHA wear, expected build rates of current and expected formations, and the well plan path.

During drill ahead, the slide planner 1114 may attempt to forecast an estimated time of the next slide to aid with planning. For example, if additional lubricants (e.g., beads) are needed for the next slide and pumping the lubricants into the drill string needs to begin thirty minutes before the slide, the estimated time of the next slide may be calculated and then used to schedule when to start pumping the lubricants.

Functionality for a loss circulation material (LCM) planner may be provided as part of the slide planner 1114 or elsewhere (e.g., as a stand-alone module or as part of another module described herein). The LCM planner functionality may be configured to determine whether additives need to be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

The slide planner 1114 may also look at the current position relative to the next connection. A connection may happen every ninety to one hundred feet (or some other distance or distance range based on the particulars of the drilling operation) and the slide planner 1114 may avoid planning a slide when close to a connection and/or when the slide would carry through the connection. For example, if the slide planner 1114 is planning a fifty foot slide but only twenty feet remain until the next connection, the slide planner 1114 may calculate the slide starting after the next connection and make any changes to the slide parameters that may be needed to accommodate waiting to slide until after the next connection. This avoids inefficiencies that may be caused by starting the slide, stopping for the connection, and then having to reorient the toolface before finishing the slide. During slides, the slide planner 1114 may provide some feedback as to the progress of achieving the desired goal of the current slide.

In some embodiments, the slide planner 1114 may account for reactive torque in the drillstring. More specifically, when rotating is occurring, there is a reactional torque wind up in the drillstring. When the rotating is stopped, the drillstring unwinds, which changes toolface orientation and other parameters. When rotating is started again, the drillstring starts to wind back up. The slide planner 1114 may account for this reactional torque so that toolface references are maintained rather than stopping rotation and then trying to adjust to an optimal tool face orientation. While not all MWD tools may provide toolface orientation when rotating, using one that does supply such information for the GCL 914 may significantly reduce the transition time from rotating to sliding.

The convergence planner 1116 receives internal inputs from the build rate predictor 1102, the borehole estimator 1106, and the slide planner 1114, and provides output to the tactical solution planner 1118. The convergence planner 1116 is configured to provide a convergence plan when the current drill bit position is not within a defined margin of error of the planned well path. The convergence plan represents a path from the current drill bit position to an achievable and optimal convergence target point along the planned path. The convergence plan may take account the amount of sliding/drilling ahead that has been planned to take place by the slide planner 1114. The convergence planner 1116 may also use BHA orientation information for angle of attack calculations when determining convergence plans as described above with respect to the build rate predictor 1102. The solution provided by the convergence planner 1116 defines a new trajectory solution for the current position of the drill bit. The solution may be real time, near real time, or future (e.g., planned for implementation at a future time). For example, the convergence planner 1116 may calculate a convergence plan as described previously with respect to FIGS. 7C and 8.

The tactical solution planner 1118 receives internal inputs from the geological drift estimator 1112 and the convergence planner 1116, and provides external outputs representing information such as toolface orientation, differential pressure, and mud flow rate. The tactical solution planner 1118 is configured to take the trajectory solution provided by the convergence planner 1116 and translate the solution into control parameters that can be used to control the drilling rig 110. For example, the tactical solution planner 1118 may take the solution and convert the solution into settings for the control systems 208, 210, and 212 to accomplish the actual drilling based on the solution. The tactical solution planner 1118 may also perform performance optimization as described previously. The performance optimization may apply to optimizing the overall drilling operation as well as optimizing the drilling itself (e.g., how to drill faster).

Other functionality may be provided by the GCL 914 in additional modules or added to an existing module. For example, there is a relationship between the rotational position of the drill pipe on the surface and the orientation of the downhole toolface. Accordingly, the GCL 914 may receive information corresponding to the rotational position of the drill pipe on the surface. The GCL 914 may use this surface positional information to calculate current and desired toolface orientations. These calculations may then be used to define control parameters for adjusting the top drive or Kelly drive to accomplish adjustments to the downhole toolface in order to steer the well.

For purposes of example, an object-oriented software approach may be utilized to provide a class-based structure that may be used with the GCL 914 and/or other components of the on-site controller 144. In the present embodiment, a drilling model class is defined to capture and define the drilling state throughout the drilling process. The class may include real time information. This class may be based on the following components and sub-models: a drill bit model, a borehole model, a rig surface gear model, a mud pump model, a WOB/differential pressure model, a positional/rotary model, an MSE model, an active well plan, and control limits. The class may produce a control output solution and may be executed via a main processing loop that rotates through the various modules of the GCL 914.

The drill bit model may represent the current position and state of the drill bit. This model includes a three dimensional position, a drill bit trajectory, BHA information, bit speed, and toolface (e.g., orientation information). The three dimensional position may be specified in north-south (NS), east-west (EW), and true vertical depth (TVD). The drill bit trajectory may be specified as an inclination and an azimuth angle. The BHA information may be a set of dimensions defining the active BHA. The borehole model may represent the current path and size of the active borehole. This model includes hole depth information, an array of survey points collected along the borehole path, a gamma log, and borehole diameters. The hole depth information is for the current drilling job. The borehole diameters represent the diameters of the borehole as drilled over the current drill job.

The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents drawworks or other WOB/differential pressure controls and parameters, including WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum RPMs to the defined level. The control output solution represents the control parameters for the drilling rig 110.

The main processing loop can be handled in many different ways. For example, the main processing loop can run as a single thread in a fixed time loop to handle rig sensor event changes and time propagation. If no rig sensor updates occur between fixed time intervals, a time only propagation may occur. In other embodiments, the main processing loop may be multi-threaded.

Each functional module of the GCL 914 may have its behavior encapsulated within its own respective class definition. During its processing window, the individual units may have an exclusive portion in time to execute and update the drilling model. For purposes of example, the processing order for the modules may be in the sequence of geo modified well planner 1104, build rate predictor 1102, slide estimator 1108, borehole estimator 1106, error vector calculator 1110, slide planner 1114, convergence planner 1116, geological drift estimator 1112, and tactical solution planner 1118. It is understood that other sequences may be used.

In the present embodiment, the GCL 914 may rely on a programmable timer module that provides a timing mechanism to provide timer event signals to drive the main processing loop. While the on-site controller 144 may rely purely on timer and date calls driven by the programming environment (e.g., java), this would limit timing to be exclusively driven by system time. In situations where it may be advantageous to manipulate the clock (e.g., for evaluation and/or testing), the programmable timer module may be used to alter the time. For example, the programmable timer module may enable a default time set to the system time and a time scale of 1.0, may enable the system time of the on-site controller 144 to be manually set, may enable the time scale relative to the system time to be modified, and/or may enable periodic event time requests scaled to the time scale to be requested.

Figure 12:
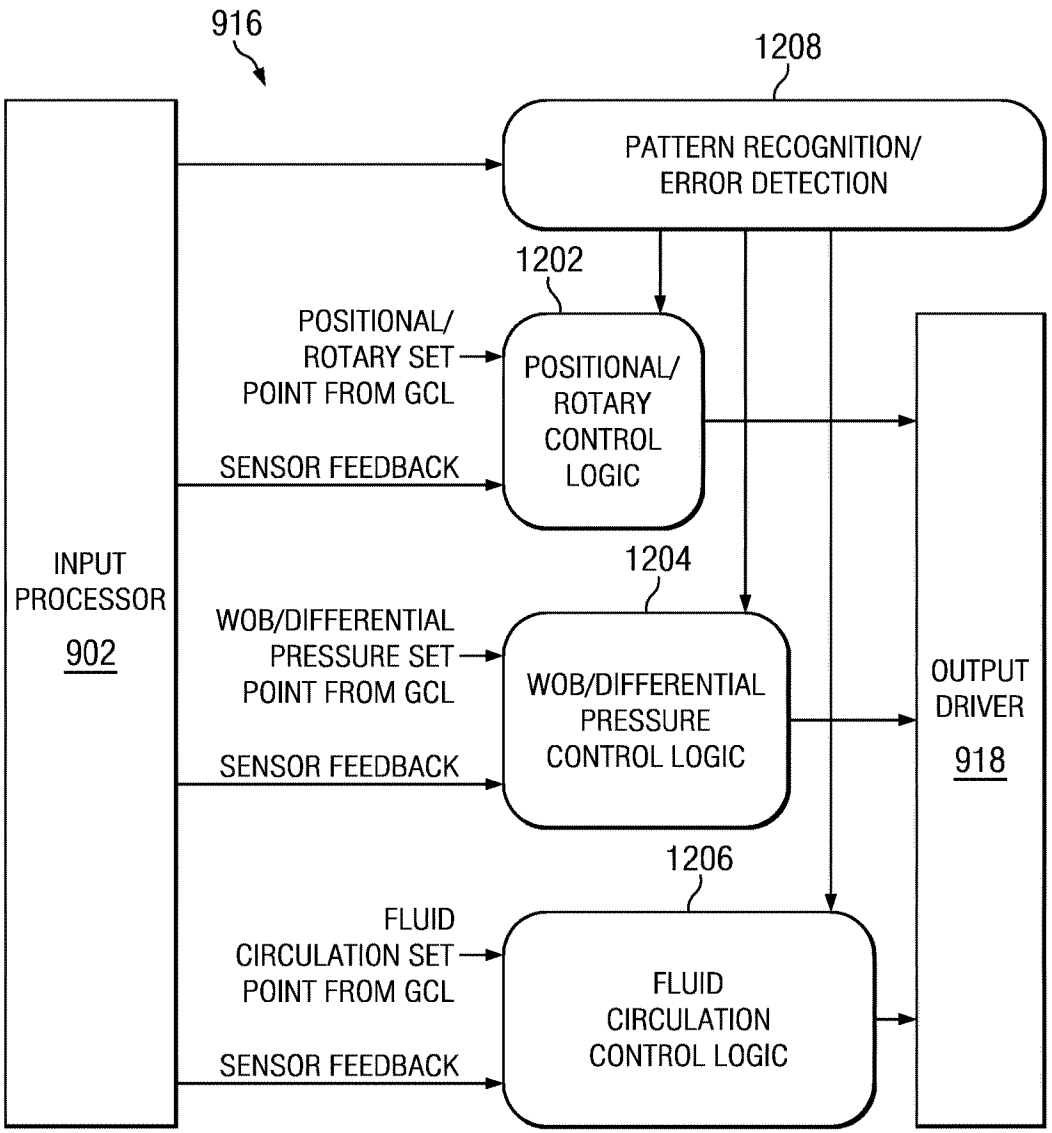
FIG. 12 illustrates one embodiment of an autonomous control loop that may be used within the system architecture of FIG. 9.

Referring to FIG. 12, one embodiment of the ACL 916 provides different functions to the on-site controller 144. The ACL 916 may be considered a second feedback control loop that operates in conjunction with a first feedback control loop provided by the GCL 914. The ACL 916 may also provide actual instructions to the drilling rig 110, either directly to the drilling equipment 216 or via the control systems 208, 210, and 212. The ACL 916 may include a positional/rotary control logic block 1202, WOB/differential pressure control logic block 1204, fluid circulation control logic block 1206, and a pattern recognition/error detection block 1208.

One function of the ACL 916 is to establish and maintain a target parameter (e.g., an ROP of a defined value of ft/hr) based on input from the GCL 914. This may be accomplished via control loops using the positional/rotary control logic block 1202, WOB/differential pressure control logic block 1204, and fluid circulation control logic block 1206. The positional/rotary control logic block 1202 may receive sensor feedback information from the input driver 902 and set point information from the GCL 914 (e.g., from the tactical solution planner 1118). The differential pressure control logic block 1204 may receive sensor feedback information from the input driver 902 and set point information from the GCL 914 (e.g., from the tactical solution planner 1118). The fluid circulation control logic block 1206 may receive sensor feedback information from the input driver 902 and set point information from the GCL 914 (e.g., from the tactical solution planner 1118).

The ACL 916 may use the sensor feedback information and the set points from the GCL 914 to attempt to maintain the established target parameter. More specifically, the ACL 916 may have control over various parameters via the positional/rotary control logic block 1202, WOB/differential pressure control logic block 1204, and fluid circulation control logic block 1206, and may modulate the various parameters to achieve the target parameter. The ACL 916 may also modulate the parameters in light of cost-driven and reliability-driven drilling goals, which may include parameters such as a trajectory goal, a cost goal, and/or a performance goal. It is understood that the parameters may be limited (e.g., by control limits set by the drilling engineer 306) and the ACL 916 may vary the parameters to achieve the target parameter without exceeding the defined limits. If this is not possible, the ACL 916 may notify the on-site controller 144 or otherwise indicate that the target parameter is currently unachievable.

In some embodiments, the ACL 916 may continue to modify the parameters to identify an optimal set of parameters with which to achieve the target parameter for the particular combination of drilling equipment and formation characteristics. In such embodiments, the on-site controller 144 may export the optimal set of parameters to the database 128 for use in formulating drilling plans for other drilling projects.

Another function of the ACL 916 is error detection. Error detection is directed to identifying problems in the current drilling process and may monitor for sudden failures and gradual failures. In this capacity, the pattern recognition/error detection block 1208 receives input from the input driver 902. The input may include the sensor feedback received by the positional/rotary control logic block 1202, WOB/differential pressure control logic block 1204, and fluid circulation control logic block 1206. The pattern recognition/error detection block 1208 monitors the input information for indications that a failure has occurred or for sudden changes that are illogical.

For example, a failure may be indicated by an ROP shift, a radical change in build rate, or any other significant changes. As an illustration, assume the drilling is occurring with an expected ROP of 100 ft/hr. If the ROP suddenly drops to 50 ft/hr with no change in parameters and remains there for some defined amount of time, an equipment failure, formation shift, or another event has occurred. Another error may be indicated when MWD sensor feedback has been steadily indicating that drilling has been heading north for hours and the sensor feedback suddenly indicates that drilling has reversed in a few feet and is heading south. This change clearly indicates that a failure has occurred. The changes may be defined and/or the pattern recognition/error detection block 1208 may be configured to watch for deviations of a certain magnitude. The pattern recognition/error detection block 1208 may also be configured to detect deviations that occur over a period of time in order to catch more gradual failures or safety concerns.

When an error is identified based on a significant shift in input values, the on-site controller 201 may send an alert. This enables an individual to review the error and determine whether action needs to be taken. For example, if an error indicates that there is a significant loss of ROP and an intermittent change/rise in pressure, the individual may determine that mud motor chunking has likely occurred with rubber tearing off and plugging the bit. In this case, the BHA may be tripped and the damage repaired before more serious damage is done. Accordingly, the error detection may be used to identify potential issues that are occurring before they become more serious and more costly to repair.

Another function of the ACL 916 is pattern recognition. Pattern recognition is directed to identifying safety concerns for rig workers and to provide warnings (e.g., if a large increase in pressure is identified, personnel safety may be compromised) and also to identifying problems that are not necessarily related to the current drilling process, but may impact the drilling process if ignored. In this capacity, the pattern recognition/error detection block 1208 receives input from the input driver 902. The input may include the sensor feedback received by the positional/rotary control logic block 1202, WOB/differential pressure control logic block 1204, and fluid circulation control logic block 1206. The pattern recognition/error detection block 1208 monitors the input information for specific defined conditions. A condition may be relatively common (e.g., may occur multiple times in a single borehole) or may be relatively rare (e.g., may occur once every two years). Differential pressure, standpipe pressure, and any other desired conditions may be monitored. If a condition indicates a particular recognized pattern, the ACL 916 may determine how the condition is to be addressed. For example, if a pressure spike is detected, the ACL 916 may determine that the drilling needs to be stopped in a specific manner to enable a safe exit. Accordingly, while error detection may simply indicate that a problem has occurred, pattern recognition is directed to identifying future problems and attempting to provide a solution to the problem before the problem occurs or becomes more serious.

Figure 13:
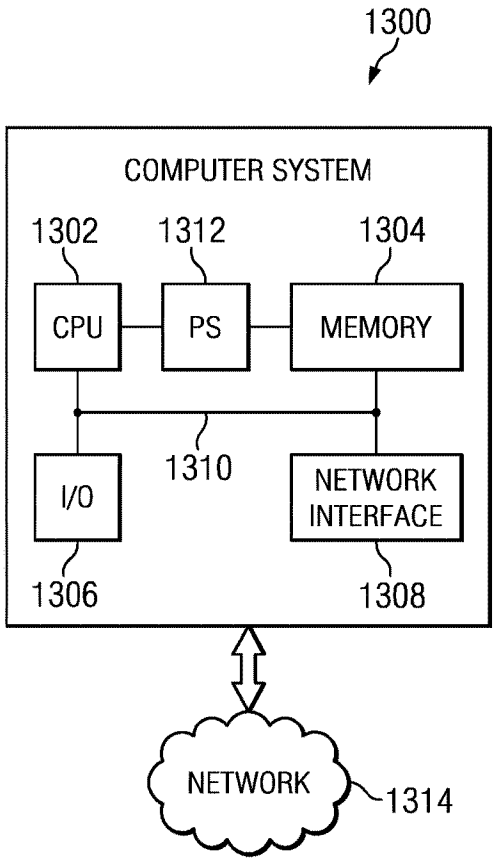
FIG. 13 illustrates one embodiment of a computer system that may be used within the surface steerable system of FIG. 2A.

Referring to FIG. 13, one embodiment of a computer system 1300 is illustrated. The computer system 1300 is one possible example of a system component or device such as the on-site controller 144 of FIG. 1A. In scenarios where the computer system 1300 is on-site, such as at the location of the drilling rig 110 of FIG. 1A, the computer system may be contained in a relatively rugged, shock-resistant case that is hardened for industrial applications and harsh environments.

The computer system 1300 may include a central processing unit ("CPU") 1302, a memory unit 1304, an input/output ("I/O") device 1306, and a network interface 1308. The components 1302, 1304, 1306, and 1308 are interconnected by a transport system (e.g., a bus) 1310. A power supply (PS) 1312 may provide power to components of the computer system 1300, such as the CPU 1302 and memory unit 1304. It is understood that the computer system 1300 may be differently configured and that each of the listed components may actually represent several different components. For example, the CPU 1302 may actually represent a multi-processor or a distributed processing system; the memory unit 1304 may include different levels of cache memory, main memory, hard disks, and remote storage locations; the I/O device 1306 may include monitors, keyboards, and the like; and the network interface 1308 may include one or more network cards providing one or more wired and/or wireless connections to a network 1314. Therefore, a wide range of flexibility is anticipated in the configuration of the computer system 1300.

The computer system 1300 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 1300. The operating system, as well as other instructions (e.g., software instructions for performing the functionality described in previous embodiments) may be stored in the memory unit 1304 and executed by the processor 1302. For example, if the computer system 1300 is the on-site controller 144, the memory unit 1304 may include instructions for performing methods such as the methods 600 of FIG. 6, 700 of FIG. 7A, 720 of FIG. 7B, 800 of FIG. 8A, 820 of FIG. 8B, 830 of FIG. 8C, and 840 of FIG. 8D.

Figure 14A:
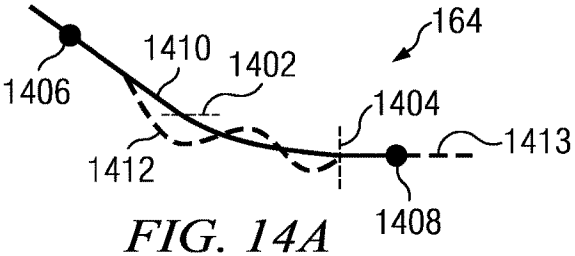
FIGS. 14A-14D illustrate embodiments of a portion of the drilling environment of FIG. 1B.
Figure 14C:
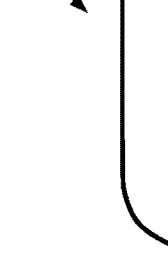
Figure 14B:
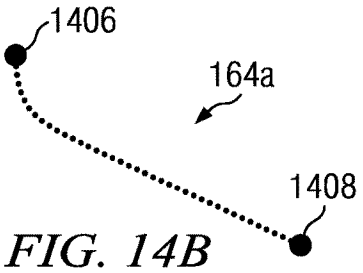
Figure 14E:
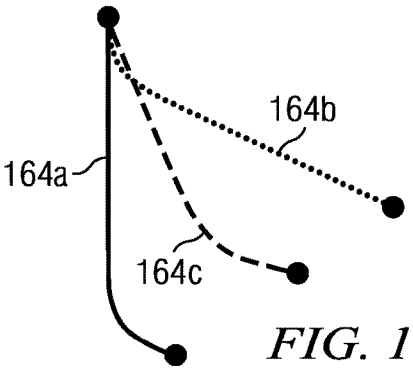
FIG. 14E illustrates FIGS. 14B-14D overlaid on one another.
Figure 14D:
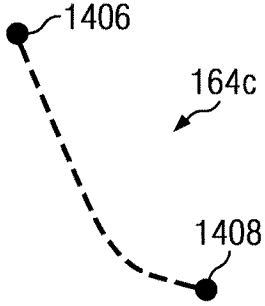

Referring to FIGS. 14A-14D, embodiments of sections of the borehole 164 of FIG. 1B are illustrated. FIG. 14A illustrates an embodiment of the borehole 164 where the slide occurs in the middle of the section. The slide is planned to begin at a point marked by line 1402 and end at a point marked by line 1404. Sequential survey points 1406 and 1408 mark locations where measured surveys occur. Being sequential, there is no survey point between the two survey points 1406 and 1408. FIG. 14B illustrates an embodiment of the borehole 164*a* where the slide occurs at the beginning of the section (e.g., right after the survey point 1406). FIG. 14C illustrates an embodiment of the borehole 164*b* where the slide occurs at the end of the section (e.g., leading up to the survey point 1408). FIG. 14D illustrates an embodiment of the borehole 164*c* where the slide occurs for the entire distance between the survey points 1406 and 1408. FIG. 14E illustrates the boreholes 164*a*-164*c* (not to scale) overlaid on one another.

Referring specifically to FIG. 14A, in the present example, two possible paths 1410 and 1412 are illustrated between the survey points 1406 and 1408. The two paths 1410 and 1412 are used herein to illustrate what may happen in the borehole 164 between the two survey points 1406 and 1408. As described previously, surveys may occur at defined intervals, such as every thirty, forty-five, or ninety feet. For example, a survey may occur each time a new section of pipe (e.g., a joint) is added to the drill string. If the sections are approximately thirty feet long and a survey is taken every three sections (e.g., a stand), the surveys may occur approximately every ninety feet. Constant surveying is generally not practical as performing a survey may take a relatively substantial amount of time (e.g., from five to twenty minutes) and, in addition, control of the reactional torque neutral point may be lost. Between surveys, the state of the drilling (e.g., orientation of the bit and distance drilled) is not generally known. Accordingly, the path between the survey points 1406 and 1408 is unknown. This lack of knowledge may affect various aspects of drilling the borehole 164, as well as the final efficiency of the well.

For example, assume that the planned borehole 164 includes a fifty foot slide (from point 1402 to point 1404) and the slide occurs between the survey points 1406 and 1408. One possible path 1410 for the slide occurs when the drilling is held almost perfectly on course, which would result in a slide of approximately fifty feet (assuming other factors are ideal). However, another possible path 1412 occurs when the drilling does not stay on course. In the present example, the path 1412 is not even on course prior to the line 1402 that represents the beginning of the slide. As the shortest distance between the points 1406 and 1408 is a straight line (or an arc at the maximum build rate), the path 1410 is more efficient than the path 1412 in making progress toward the target. Furthermore, not only is the path 1412 less efficient in reaching the target, it also forms a less ideal borehole in terms of tortuosity as described in greater detail below.

It is understood, as described previously, that there may be a survey point offset where the survey point is actually located some distance behind the bit and so the survey location may not represent the actual bit location. Because of this offset distance, a survey is accurate only to a certain distance (e.g., fifty feet behind the bit) and there is usually some uncertainty in the path ahead of the survey point to where the bit is actually located. Accordingly, knowing the actual path past a survey point may also be beneficial as illustrated by path segment 1413 extending from survey point 1408.

In addition to providing information about drilling efficiency, knowing what occurs between the survey points 1406 and 1408 may enable the effective build rate of the BHA to be assessed more objectively because the build rate orientation stability can be taken into account. If the build rate orientation stability is not taken into account, the second path 1412 that lacks orientation stability may be included in the assessment, which would make the BHA seem less efficient than it actually was. In turn, the more accurate assessment of the actual path of the BHA aids in the accuracy of later drilling predictions (e.g., build rate predictions).

Knowledge of what occurs between survey points may also aid in addressing drilling problems such as tortuosity in the borehole that may impact whether casing can be run, increase friction in the drill string, affect lubrication planning for slides, and other issues. For example, dogleg severity is often viewed as the change of angle between two sequential survey points. However, this view provides no information as to whether a dogleg exists between the survey points and, if one does exist, how severe it is. Furthermore, the orientation of the doglegs may create even more severe problems. For example, a dogleg created by a left arc that is immediately followed by a dogleg created by a right arc may be more problematic than if the following dogleg is also a left arc. In other words, sequential doglegs that arc in generally the same direction may be preferable to sequential doglegs that arc in opposite directions. Accordingly, the survey points may show a dogleg characterized by a five degree per hundred foot severity (5°/100'), while the actual path may include a dogleg of 10°/100' at one point, 5°/100' at another point, et cetera, between the survey points, and these doglegs may have different orientations.

Knowing what is happening between the survey points and accumulating such information over the course of the well enables problems to be addressed by implementing one or more solutions before drilling continues, during later drilling, and even after drilling. For example, the ability to measure tortuosity in real time or near real time may enable determinations to be made during drilling such as whether lubrication is needed, how and when to apply the lubrication, and whether back reaming a particular section of the borehole is needed. Such information may also be used to determine whether a planned well should be stopped early. After the well is completed, the use of path information that is higher resolution than the information provided by the survey points may be used to improve the well, such as in a determination on where to focus reaming activity (e.g., at a problem area at ten thousand feet).

It is understood that information about what is occurring between survey points may also be useful even when not sliding. For example, drift caused by formation characteristics may affect the path even when drilling straight ahead. Accordingly, current location estimates may be useful regardless of the type of drilling (e.g., rotating or sliding).

Figure 15:
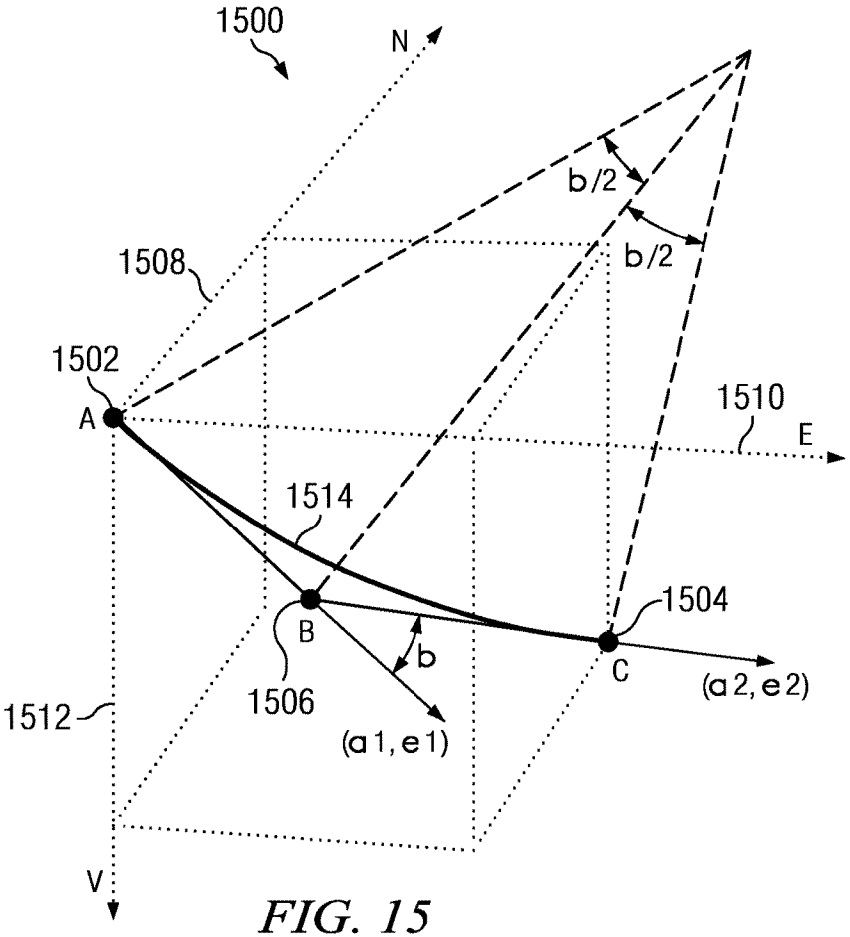
FIG. 15 illustrates one embodiment of a three-dimensional borehole space.

Referring to FIG. 15, one embodiment of a three-dimensional borehole space 1500 is illustrated with two measured survey points 1502 (also labeled as "A") and 1504 (also labeled as "C"). A borehole path (not shown) extends between the two survey points 1502 and 1504, but the actual path is unknown. Current borehole projection methods frequently use a minimum curvature technique for estimating the borehole projection between the two survey points 1502 and 1504. Assuming the initial borehole position is known as well as its initial survey trajectory, there may be only a subsequent measure of additional borehole length and a new survey trajectory that can be measured from surface and downhole instruments that are available.

In FIG. 15, the borehole space is presented in Cartesian space with a North-South (N) axis 1508, an East-West (E) axis 1510, an Up-Down Vertical (V) axis 1512, and a borehole trajectory where an inclination angle represents the vertical component and a compass style azimuth angle represents the horizontal component. The initial survey point 1502 has an inclination and azimuth trajectory of $\alpha 1$ and $\varepsilon 1$, respectively, and the second survey point 1504 has an inclination and azimuth trajectory of $\alpha 2$ and $\varepsilon 2$, respectively.

With only new survey trajectory and path length information available, an assumption must be made about the shape of the borehole between the survey points 1502 and 1504. The minimum curvature method works off the assumption that the borehole moves along the smoothest possible arc between two survey points. This arc is represented by arc 1514. The change in trajectory angle from survey point 1502 to survey point 1504 ($\beta$) is often referred to as a dogleg in the context of surveying. The path ABC (where B is also labeled as point 1506) represents the balanced tangential method path, whereby a borehole projection is estimated by two line segments which intersect at the point where the curvature angle, $\beta$, is evenly bisected. This bisection point is point 1506 in the present example. This is a useful case, as the minimum curvature method represents a special case of the balanced tangential method where the two line segments are substituted with a circular arc curve (e.g., the arc 1514) that also passes through points 1502 and 1504 with tangents at those points aligned with their respective trajectories. The equations for the curve AB are the same as the balanced tangential method for calculating path ABC except for the application of the ratio factor (RF):

$$_{D}V = \frac{_{D}MD}{2}[\cos a1 + \cos a2] \cdot RF \quad \text{(Equation 1)}$$

$$_{D}N = \frac{_{D}MD}{2}[\sin a1 \cdot \cos e1 + \sin a2 \cdot \cos e2] \cdot RF \quad \text{(Equation 2)}$$

$$_{D}E = \frac{_{D}MD}{2}[\sin a1 \cdot \sin e1 + \sin a2 \cdot \sin e2] \cdot RF \quad \text{(Equation 3)}$$

When using Equations 1-3 for estimating borehole positions between measured survey points, $\Delta$MD represents an increase in measured depth progress between two survey trajectory measurements.

The ratio factor (RF) is used to account for the path length difference between the length of ABC and the length of the minimum curvature arc which crosses through AC. RF is given by the equation:

$$RF = \frac{2}{b}\tan\frac{b}{2} \quad \text{(Equation 4)}$$

The minimum curvature method may result in significant inaccuracy as shown in the following examples. There are two basic assumptions in these examples. The first is that the example starts from a ninety degree inclination. The second is that all sliding is two-dimensional in the vertical plane.

Table 1, shown below, illustrates a scenario where a slide has occurred.

TABLE 1

| Description | Value | Units |
|---|---|---|
| Total MD Increment Between Surveys | 100 | ft |
| Slide/Build Duration | 15 | ft |
| Instantaneous Build Rate | 12 | Degrees/100 ft |
| Inclination Change | 1.8 | Degrees |

For purposes of illustration, the distance between surveys is equal to one hundred feet and is used as a surface measurement of the total measured depth increment. Accordingly, the total measured depth increment between surveys in Table 1 is one hundred feet. The slide lasted for fifteen feet and had an instantaneous build rate of twelve degrees per one hundred feet, so the inclination change over the twelve foot slide was 1.8 degrees.

Table 2, shown below, illustrates two scenarios where a slide has occurred. The first column contains two rows, with each row indicating whether the slide occurred at the beginning of the one hundred foot distance (one embodiment of which is illustrated in FIG. 14B) or at the end (one embodiment of which is illustrated in FIG. 14C).

TABLE 2

| | MD change (ft) | TVD change (ft) | Traditional Curve Fit TVD change (ft) | Interpreted TVD error (ft) | Interpreted Formation Dip Error Over Survey Period Due to TVD Error (degrees) |
|---|---|---|---|---|---|
| Slide before Rotate | 100 | 2.906 | 1.571 | 1.335 | 0.765 |
| Rotate before Slide | 100 | 0.236 | 1.571 | −1.335 | −0.765 |

In the first row where sliding occurred before rotation, the TVD change is 2.906 feet. Using the previously presented equations for curve fitting, the curve fit TVD change is 1.571 feet. This results in an interpreted TVD error of 1.335 feet and an interpreted formation dip error of 0.765 degrees. In the second row where sliding occurred after rotation, the TVD change is 0.236 feet. Using the previously presented equations for curve fitting, the curve fit TVD change is 1.571 feet. In other words, the curve fit TVD change is the same as in row one. The curve fit TVD change of 1.571 results in an interpreted TVD error of −1.335 feet and an interpreted formation dip error of −0.765 degrees.

Although the errors may cancel each other out relative to the entire well (e.g., an error in one direction may be canceled by an equal error in the opposite direction), the errors in a given direction accumulate and there is more accumulation the longer that a slide occurs in a particular direction.

As illustrated in Table 2, the curve fit TVD change for a particular set of slide/build duration and instantaneous build rate values remains constant regardless of whether sliding occurs before or after rotation even though the TVD change is different based on whether sliding occurs before or after rotation. This difference between the curve fit TVD change and the total TVD change occurs for different values of slide/build duration and instantaneous build rate in Table 1. The curve fit TVD change and the total TVD change may only match in two scenarios. The first is when the slide occurs for the full one hundred feet (e.g., slide/build duration is set to 100 in Table 1), as the borehole shape may be estimated as an arc between the two survey points (one embodiment of which is illustrated in FIG. 14D). The second is when the slide is symmetrically centered on the midpoint between survey points. As illustrated in FIG. 14E, the boreholes 164*a*-164*c* of FIGS. 14B-14D may vary significantly for the same curve fit TVD change.

Accordingly, using only information from two measured survey points to estimate the state of the drilling (e.g., orientation of the bit and distance drilled) between the two survey points may result in significant inaccuracies. These inaccuracies may negatively impact drilling efficiency, the ability to objectively identify well plan corrections, the ability to characterize formation position and dip angles, and/or similar issues. Furthermore, problems such as tortuosity may be more difficult to identify and address. Inaccurate TVD information may result in difficulties in following the target layer (e.g., the layer 172A of FIG. 1B), as even seemingly minor variations in inclination (e.g., one half of one degree) may cause the drill bit to exit the target layer.

Figure 16:
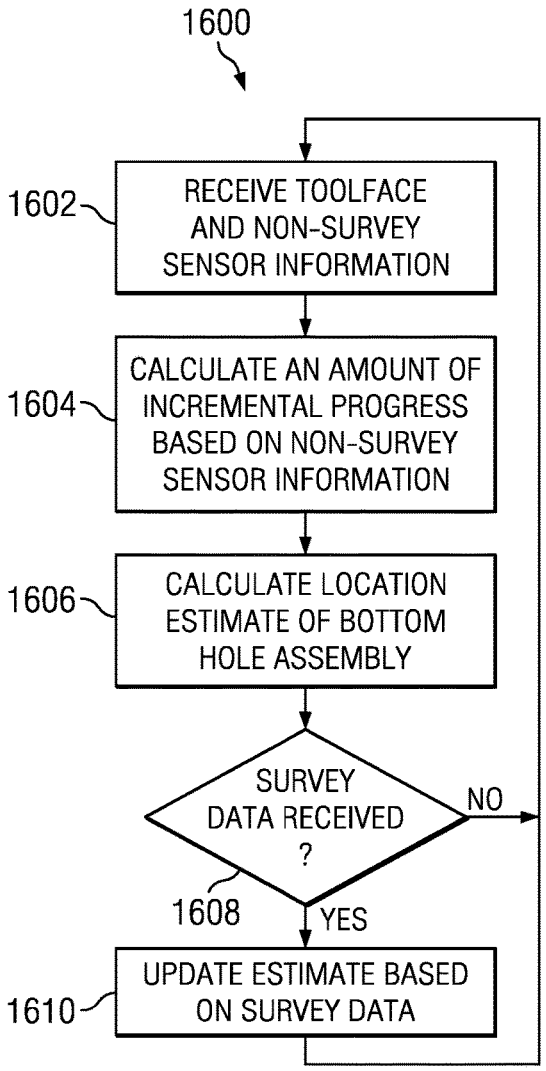
FIG. 16 illustrates one embodiment of a method that may be executed by the surface steerable system of FIG. 2A to estimate a drill bit position between survey points.

Referring to FIG. 16, a method 1600 illustrates one embodiment of a process that may be executed by the on-site controller 144 of FIG. 2A and/or another part of the surface steerable system 201. For example, software instructions needed to execute the method 1600 may be stored on a computer readable storage medium of the on-site controller 144 and then executed by the processor 412 that is coupled to the storage medium and is also part of the on-site controller 144.

In the present example, the method 1600 may be used to estimate the position of the drill bit between survey points during straight drilling and/or during a sliding operation. The method 1600 may provide more accurate information on the state of the drilling (e.g., orientation of the bit and distance drilled) than that provided by the minimum curvature method described above.

In step 1602, toolface and other non-survey sensor information is received. The toolface information may be relayed from the toolface periodically, such as at set intervals of between ten and thirty seconds. The non-survey sensor information may include any type of data, such as differential pressure and may be continuous or non-continuous. As the toolface information may be obtained at set intervals and the other non-survey sensor information may be continuous, non-survey sensor information may be obtained between orientation updates. The non-survey sensor information may be averaged (symmetrically or otherwise) to relate the sensor information to the toolface information.

In step 1604, calculations are performed on the non-survey sensor information to estimate the amount of progress made by the drill bit since the last estimate. For example, the differential pressure may be used to estimate the force on the bit, which may be used with formation information to determine the distance that the bit should have drilled in the current formation layer.

One difficulty in measuring drilling information between survey points is that measurements made at the top of the drill string may not accurately reflect events at the BHA. For example, a ten thousand foot drill string may be viewed as a big spring, and when motion is stopped at the surface, the spring force may continue to increase the length of the drill string and the BHA may make progress in a certain direction. In another example, if a foot of pipe is moved into the hole, the drill string may compress and/or buckle and the bit may move little, if at all.

Accordingly, predictions about the current orientation and progress of the drill bit may vary in accuracy depending on the information on which the predictions are based. For example, rather than exclusively using surface deviation, energy produced by the bit and a combination of differential pressure, MSE, and/or other measurements may be used. In some embodiments, more sensors may be placed downhole to provide more accurate information. Depending on the particular embodiment, calculations may be performed based on sensors at various levels of the drillstring to predict actual progress between surveys. For example, calculations may be used to approximate the fluid pressure to how much force is on the bit. Other calculations may be made to account for drill string compression, tension, and/or buckling.

It is understood that the calculations may differ based on the configuration of the drilling equipment and/or the BHA. For example, if an autodrilling system is used, the drilling rig may have a fixed value for ROP, WOB, DP, and/or other characteristics. Such fixed values may affect the particular calculations used. For example, if DP is fixed, the calculations may not rely on changes in DP as the autodrilling system may attempt to maintain the fixed DP value. In another example, if ROP is fixed, measurements of DP may have a wide range due to the attempt to maintain the fixed ROP value. If an autodrilling system is not used to control drilling functions, more flexibility may be available in the calculations that are used.

In step 1606, calculations may be performed to obtain an estimate of the BHA's location using the toolface information and the calculated amount of progress. This calculation may be performed in a variety of ways, including the calculation of a vector as a three-dimensional estimate of the drill bit's current location and orientation. The vector progress (e.g., degrees/100 feet) may come from the build rate predictor 1102 of FIG. 11, and may also include the use of formation information.

In step 1608, a determination may be made as to whether survey data has been received. If not, the method 1600 may return to step 1602 and calculate another location estimate (e.g., another vector) of the BHA's incremental progression. As these estimates are calculated, an estimated path of the BHA between the two survey points is developed. If survey data has been received, the method 1600 moves to step 1610, where the survey data is used to update the estimated location. The method 1600 may then return to step 1602 and calculate another location estimate using the new survey data as the baseline for the current estimate.

Accordingly, the survey data may serve as truth data against which the estimates can be measured. This enables the calculations used for the estimates to be refined in conjunction with formation information as more survey point data is received. For example, if the estimates use a particular drilling speed through the current formation layer and the survey data indicates that the drilling speed is incorrect, future estimates may be calculated based on the revised drilling speed to provide a higher level of accuracy. Furthermore, although not shown in FIG. 16, it is understood that the survey data may also be used to check the estimated build rate and, if needed, recalibrate the build rate (e.g., the build rate predictor 1102 of FIG. 11) to correspond to the survey data.

Figure 17:
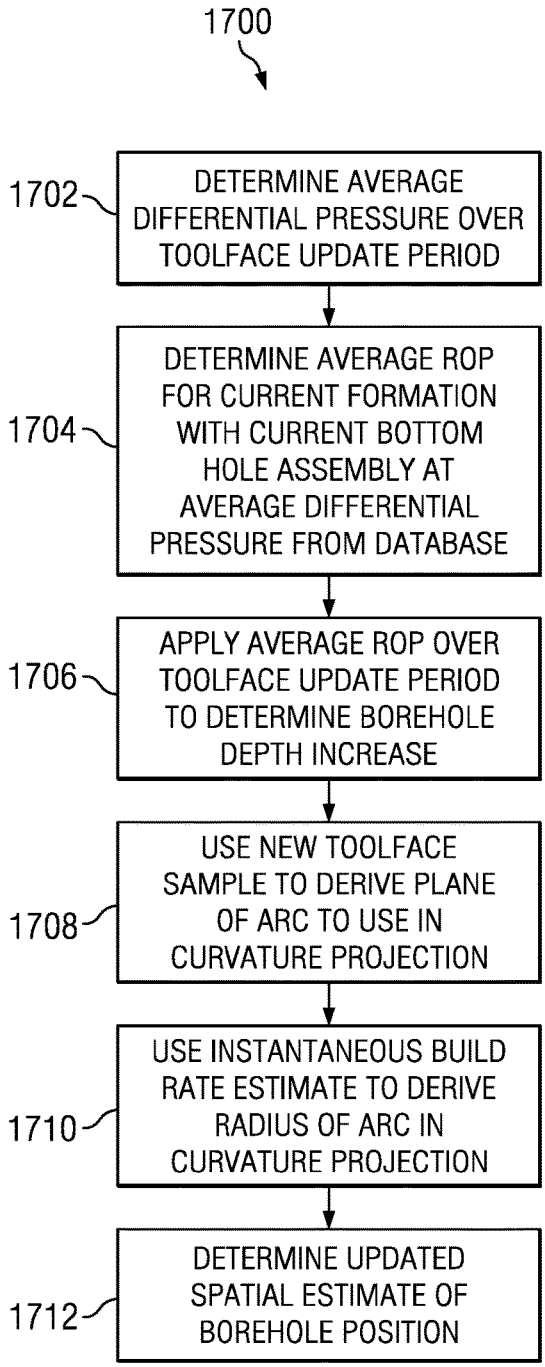
FIG. 17 illustrates one embodiment of a method that represents a portion of the method of FIG. 16 in greater detail.

Referring to FIG. 17, a method 1700 illustrates one embodiment of a process that may be executed by the on-site controller 144 of FIG. 2A and/or another part of the surface steerable system 201. For example, software instructions needed to execute the method 1700 may be stored on a computer readable storage medium of the on-site controller 144 and then executed by the processor 412 that is coupled to the storage medium and is also part of the on-site controller 144. In the present example, the method 1700 illustrates a more detailed example of steps 1602-1606 of FIG. 16.

In step 1702, the average differential pressure is determined for a toolface update period (e.g., the length of time between toolface updates). The differential pressure may be acquired or calculated. The toolface update period may vary based on factors such as the speed at which the MWD component is set to run, the priority given to the toolface information in the MWD component, the overall bandwidth available to the MWD component, and/or other factors.

In step 1704, the average ROP is determined. For example, the differential pressure determined in step 1702 may be used to assist in a database lookup. More specifically, the average ROP for the current formation using the current BHA at the average differential pressure may be acquired from the database.

In step 1706, the average ROP is applied over the toolface update period to determine the borehole distance increase since the last iteration. For example, if the ROP retrieved from the database indicates that the ROP is fifty feet per hour and the toolface update period is thirty seconds, then the distance increase should be approximately five inches.

In steps 1708 and 1710, the new toolface sample is used to derive a plane of arc to use in a curvature projection. In the current example, applying observations from the previously described minimum curvature method may be useful when developing a method for estimating borehole position and trajectory from toolface measurements between survey measurements. Certain parameters used in the minimum curvature method may be estimated instead of directly measured.

Figure 18:
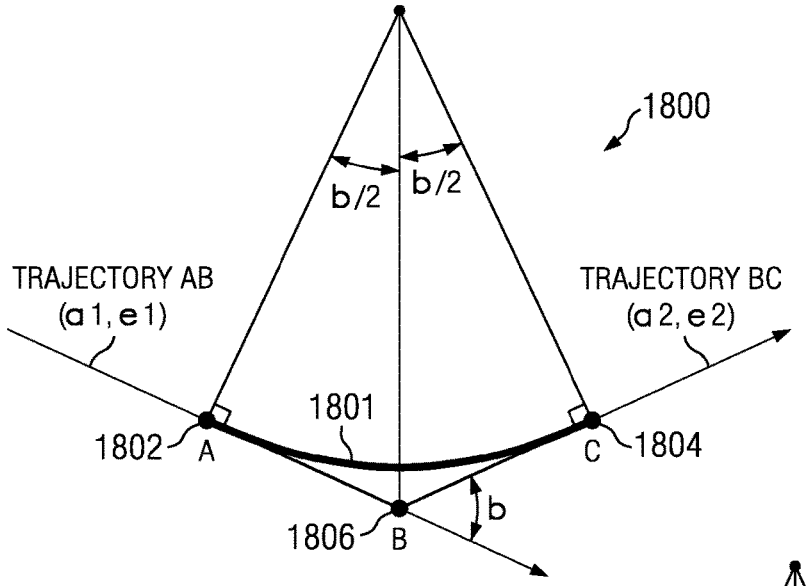
FIG. 18 illustrates one embodiment of a two-dimensional borehole space.

With additional reference to FIG. 18, one embodiment of a two-dimensional borehole space 1800 illustrates the minimum curvature path 1801 in the plane of the curvature arc. The space 1800 is illustrated with two measured survey points 1802 (also labeled as "A") and 1804 (also labeled as "C").

As illustrated in FIG. 18, the angle β can be seen intuitively as the arc angle along which the minimum curvature path is made and the change in trajectory between the two path points. Angle β would normally be calculated from survey trajectory angles using an additional formula. In the context of directional well steering where the angle β is deliberately controlled, it can also be considered an angle of desired or target build. In the case of projecting build in real time, an instantaneous β estimate may be needed. The complexity of such an estimate may vary. For example, a relatively simple approach may use a geometric formula of BHA dimensions. In other examples, more detailed approaches may account for factors from previous and instantaneous rig sensor data, formation data, etc., in order to provide an improved prediction of an instantaneous build rate while drilling. The build rate predictor 1102 of FIG. 11 may provide a functional component used to perform this task within the surface steerable system 201.

In the minimum curvature method, ΔMD may be directly obtained from the surface measurement of the difference in drill string lengths between surveys. When accounting for the position of the bit, this method of using surface changes in drill string lengths may be used in a relatively simple approach for an estimate. However, accounting for drill string tension, compression, buckling, and other factors that impact drill string length may provide a better estimate of the current drill bit position as it is drilling new borehole.

In the case of updating borehole trajectory over a given change in borehole depth, survey measurements may be used when available. In such cases, one goal of slide estimation may be to estimate trajectory along the bit path by using toolface history along the intervals ahead of where survey data is available to allow a real time or near real time estimate of bit location.

Figure 19:
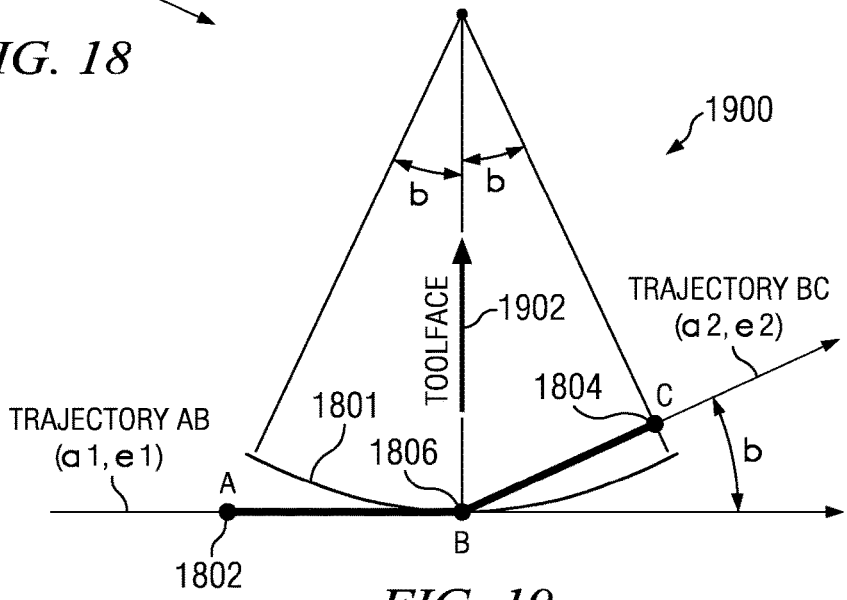
FIG. 19 illustrates another embodiment of a two-dimensional borehole space.

With additional reference to FIG. 19, one embodiment of a two-dimensional borehole space 1900 illustrates slide estimation by integration of a single toolface measurement using the minimum curvature path 1801 of FIG. 18. More specifically, the present example addresses the application of a toolface vector 1902 that is a direct linear projection of an individual toolface. This projection is overlaid against the minimum curvature path 1801 for purposes of illustration. It is understood that while the present example uses a gravity toolface frame of reference, magnetic references can also be used with variations in some formulas described below to account for the use of magnetic references.

In this case, the borehole is assumed to be moving in a straight path along the trajectory AB until encountering a measured toolface. Upon encountering the toolface at point 1806 (B), the toolface is applied directly to the trajectory BC as follows:

$$a2=a1+\cos TF\cdot b \quad \text{(Equation 5)}$$

$$\in 2=\in 1+\sin TF\cdot b \quad \text{(Equation 6)}$$

where TF is the toolface vector angle presented relative to the gravity "up" vector. The position estimates for the path between AC may be given by:

$$_DV={}_DBD\cdot\cos a1 \quad \text{(Equation 7)}$$

$$_DN={}_DBD\cdot[\sin a1\cdot\cos e1] \quad \text{(Equation 8)}$$

$$_DE={}_DBD\cdot[\sin a1\cdot\sin e1] \quad \text{(Equation 9)}$$

The equations 7-9 represent the simple projection of the straight line AB in Cartesian space since the toolface would not be applied until point B. When overlaid on the curvature model, it is evident that this estimate is analogous to the balanced tangential method where the starting and finishing points A and C and the path ABC lie apart from the overlying smooth circular arc.

Figure 20:
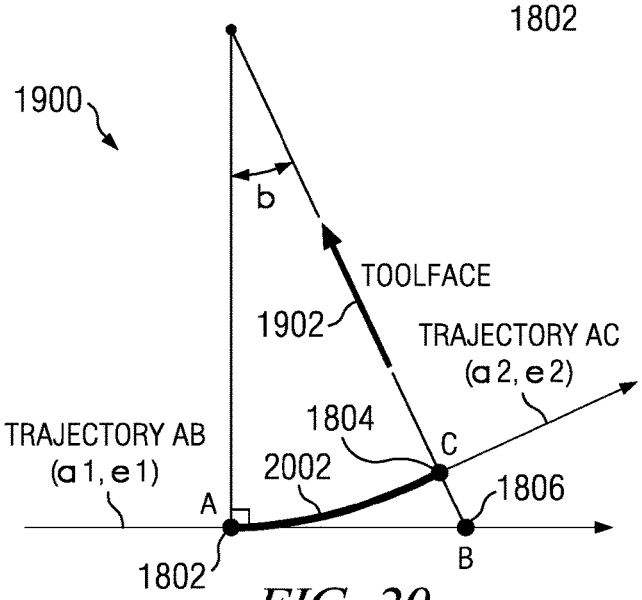
FIG. 20 illustrates another embodiment of the two-dimensional borehole space of FIG. 19.

With additional reference to FIG. 20, one embodiment of the two-dimensional borehole space 1900 of FIG. 19 is illustrated using the minimum curvature concept to yield a better estimate of actual borehole displacement by modeling the borehole as an arc rather than bending line segments. When framed as a single arc curve displacement 2002, the projection of the single toolface may appear as illustrated in FIG. 20.

In this case, the toolface influence on trajectory may be modeled to yield the same tangent trajectory from the toolface build vector 1902 as follows:

$$a2=a1+\cos TF\cdot b \quad \text{(Equation 10)}$$

$$\in 2=\in 1+\sin TF\cdot b \quad \text{(Equation 11)}$$

After deriving trajectory changes, the minimum curvature method equations are again applicable for determining the positional displacements over the interval as follows:

$$_DV=\frac{_DBD}{2}[\cos a1+\cos a2]\cdot RF \quad \text{(Equation 12)}$$

$$_DN=\frac{_DBD}{2}[\sin a1\cdot\cos e1+\sin a2\cdot\cos e2]\cdot RF \quad \text{(Equation 13)}$$

$$_DE=\frac{_DBD}{2}[\sin a1\cdot\sin e1+\sin a2\cdot\sin e2]\cdot RF \quad \text{(Equation 14)}$$

In this case, the line path to arc relationship works out to be the same as the minimum curvature RF:

$$RF=\frac{2}{b}\tan\frac{b}{2} \quad \text{(Equation 15)}$$

While the preceding example illustrates slide estimation by integration of a single toolface measurement, it is understood that a range of toolface measurements may be used. As described above, the integration of individual toolface projections may provide a useful method of slide and borehole estimation on a near real time basis. However, like the use of minimum curvature on a smaller scale, this process may be subject to cumulative errors over longer intervals. Accordingly, a range of toolfaces may be used over an interval to address this issue. For example, the range of toolfaces may be used to provide a net effective toolface direction and a net effective β build rate angle may also be estimated. In both cases, the benefit of larger data sets (e.g., toolface histories) may enable the application of more sophisticated statistical methods and filtering techniques. For example, over a path interval, a target toolface may be desired and attempted to be maintained. In practice, the ability to control the toolface over these intervals can be evaluated in statistical metrics, like a circular distribution. These metrics can then be used to refine the effective build rate and toolface direction over the evaluation interval.

Referring again specifically to FIG. 17, in step 1712, an updated spatial estimate of the borehole position may be estimated based on the preceding steps. The estimated spatial estimate may be provided to the display 250 of FIG. 2B (e.g., for display to the driller 310 of FIG. 3), provided as feedback to the convergence planner 1116 of FIG. 11, and/or otherwise used.

Figure 21:
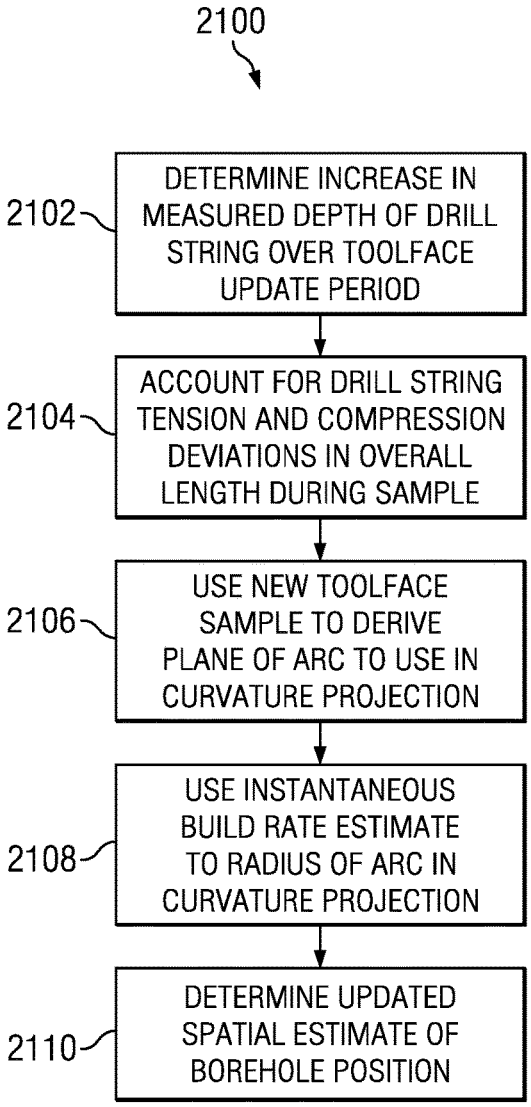
FIG. 21 illustrates one embodiment of a method that represents a portion of the method of FIG. 16 in greater detail.

Referring to FIG. 21, a method 2100 illustrates one embodiment of a process that may be executed by the on-site controller 144 of FIG. 2A and/or another part of the surface steerable system 201. For example, software instructions needed to execute the method 2100 may be stored on a computer readable storage medium of the on-site controller 144 and then executed by the processor 412 that is coupled to the storage medium and is also part of the on-site controller 144. In the present example, the method 2100 may provide a more detailed example of steps 1602-1606 of FIG. 16.

In step 2102, the increase in measured depth is determined for the toolface update period. The increase may be acquired or calculated. For example, the measured depth may be acquired based on a surface measurement of the length of pipe inserted into the borehole between the last toolface update period and the current toolface update period. In other examples, the measured depth may be calculated based on measurements received from downhole sensors.

In step 2104, the method 2100 may account for deviations in the overall drillstring length due to issues such as compression, tension, and/or buckling. In some embodiments, step 2104 may be omitted and the measured depth determined in step 2102 may be used with accounting for such deviations. Steps 2106, 2108, and 2110 may similar or identical to steps 1708, 1710, and 1712, respectively, with the estimate using the information from steps 2102 and 2104.

Figure 22:
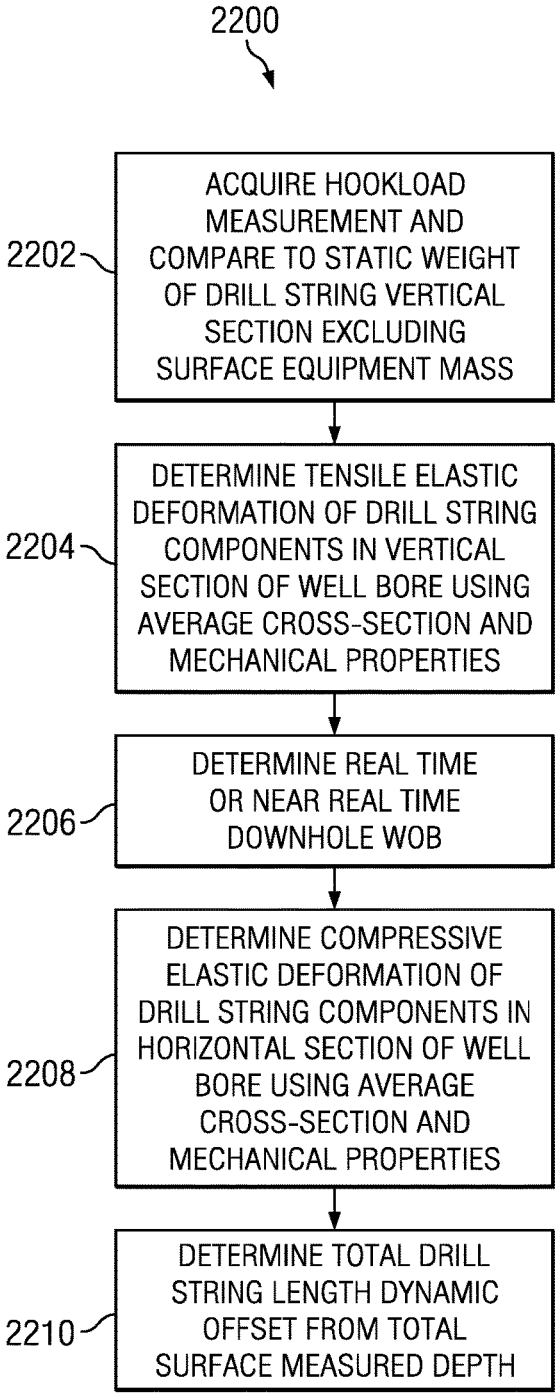
FIG. 22 illustrates one embodiment of a method that represents a portion of the method of FIG. 21 in greater detail.

Referring to FIG. 22, a method 2200 illustrates one embodiment of a process that may be executed by the on-site controller 144 of FIG. 2A and/or another part of the surface steerable system 201. For example, software instructions needed to execute the method 2200 may be stored on a computer readable storage medium of the on-site controller 144 and then executed by the processor 412 that is coupled to the storage medium and is also part of the on-site controller 144. In the present example, the method 2200 may provide a more detailed example of step 2104 of FIG. 21, although it is understood that the method 2200 may be used with the other methods described herein.

In step 2202, a hookload measurement is acquired and compared to the static weight of the drill string vertical section excluding the mass of the surface equipment. The static weight of the drill string vertical section excluding the mass of the surface equipment may be determined, for example, from information available from the local database 912 of FIG. 9 and/or regional database 128 of FIG. 1A.

In step 2204, the tensile elastic deformation of the drill string components in the vertical section is determined. This determination may use, for example, average cross-section and mechanical properties of the drill string components in the vertical section. The average cross-section and mechanical properties may be determined, for example, from information available from the local database 912 of FIG. 9 and/or regional database 128 of FIG. 1A.

In step 2206, a real time or near real time WOB value is determined. For example, the WOB value may be obtained using a downhole sensor. In another example, the WOB value may be approximated using differential pressure and mud motor properties.

In step 2208, the compressive elastic deformation of the drill string components in the horizontal section of the borehole (if any) is determined. This determination may use, for example, average cross-section and mechanical properties of the drill string components in the vertical section. The average cross-section and mechanical properties may be determined, for example, from information available from the local database 912 of FIG. 9 and/or regional database 128 of FIG. 1A.

In step 2210, the total drill string length dynamic offset from the measured depth is determined. This total length dynamic offset accounts for variations between the measured depth and the actual drillstring length due to issues such as compression, tension, and/or buckling in the drillstring.

Figure 23:
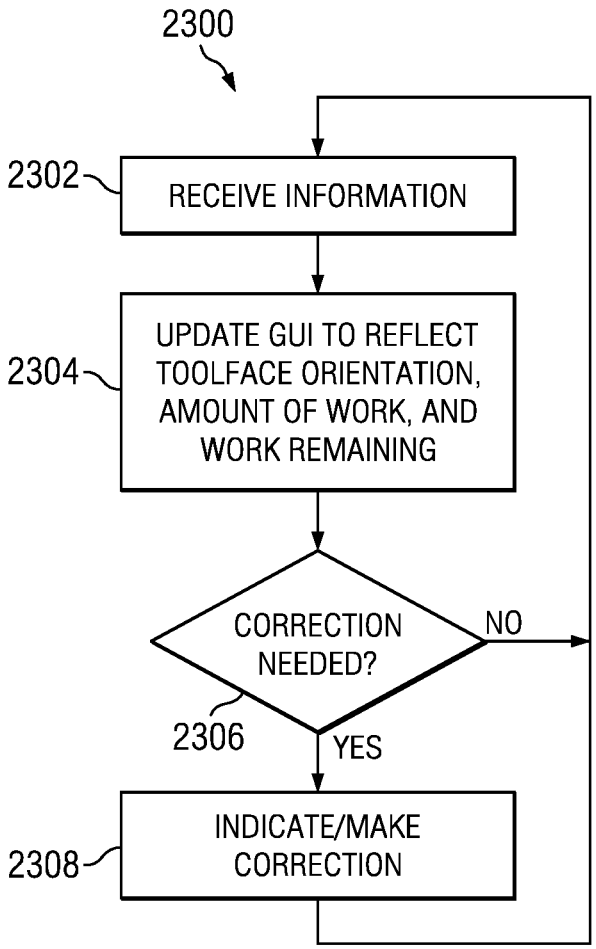
FIG. 23 illustrates one embodiment of a method that may be executed by the surface steerable system of FIG. 2A.
Figure 24:
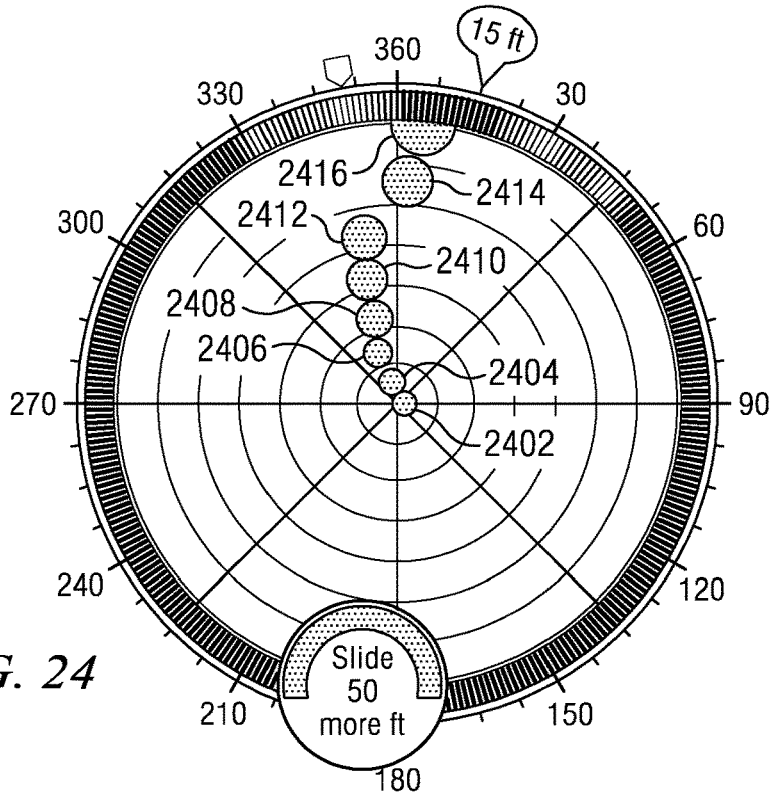
FIG. 24 illustrates another embodiment of the display of FIG. 2B.
Figure 25:
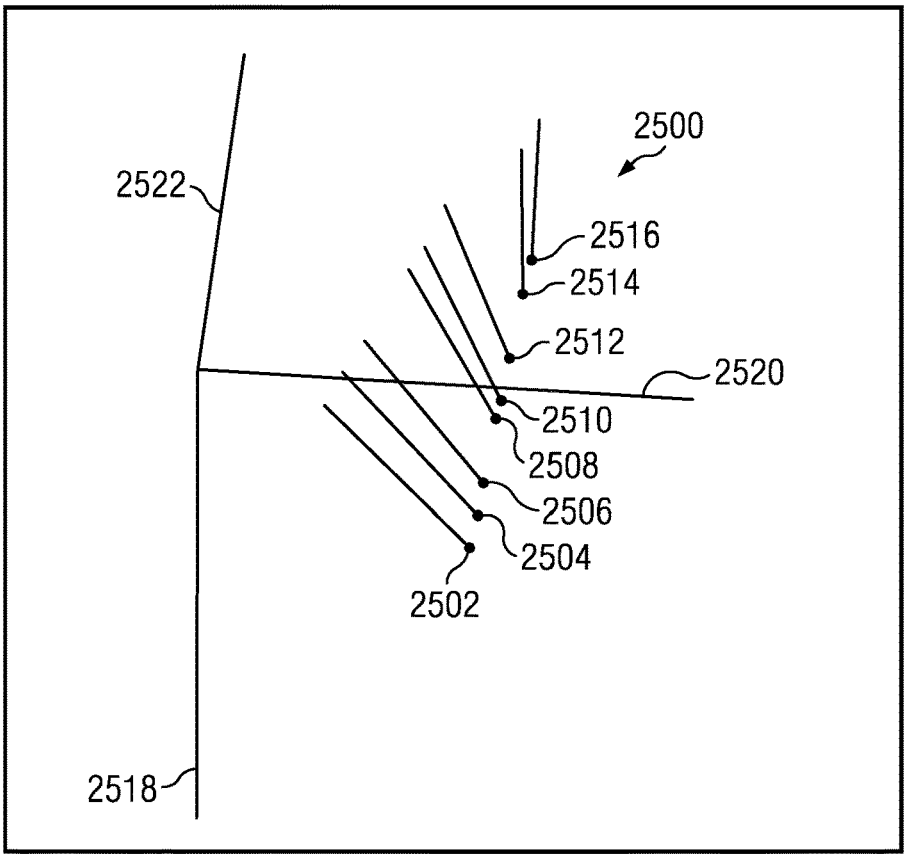
FIG. 25 illustrates one embodiment of a three-dimensional graph illustrating vectors representing information that may be displayed on the display of FIG. 24.

Referring to FIG. 23 and with additional reference to FIGS. 24 and 25, a method 2300 illustrates one embodiment of a process that may be executed by the on-site controller 144 of FIG. 2A and/or another part of the surface steerable system 201. For example, software instructions needed to execute the method 2300 may be stored on a computer readable storage medium of the on-site controller 144 and then executed by the processor 412 that is coupled to the storage medium and is also part of the on-site controller 144.

In step 2302, information is received by the surface steerable system 201. The information may be any type of information displayed by the display 250. For purposes of example, the information may include the orientation and progress estimate from FIG. 16.

In step 2304, the GUI (e.g., the circular chart 286) may be updated with the information representing the orientation and progress of the drill bit. Referring specifically to FIG. 24, an embodiment of the circular chart 286 of the display 250 (FIG. 2B) is illustrated with differently positioned circles than those shown in FIG. 2B and may be used to show the orientation and/or mechanical progress of the drill bit at survey points and/or between surveys. More specifically, FIG. 2B illustrates a particular positioning of the circles ranging from the largest circle 288 to the smallest circle 289. FIG. 24 illustrates a different positioning of circles labeled 2402 (the smallest circle), 2404, 2406, 2408, 2410, 2412, 2414, and 2416 (the largest circle). As described with respect to FIG. 2B, the series of circles may represent a timeline of toolface orientations, with the sizes of the circles indicating the temporal position of each circle. In the present example, the largest circle 2416 is the newest orientation and the smallest circle 2402 is the oldest orientation. The circular chart 286 may provide insight into what is happening in the borehole between surveys (e.g., using variations in size, color, shape, and/or other indicators). As described previously, the lack of knowledge about orientation and progress between surveys may affect various aspects of drilling, as well as the final efficiency of the well.

With additional reference to FIG. 25, a three-dimensional chart 2500 illustrates vectors 2502, 2504, 2506, 2508, 2510, 2512, 2514, and 2516 corresponding to circles 2402, 2404, 2406, 2408, 2410, 2412, 2414, and 2416, respectively. The vectors 2502, 2504, 2506, 2508, 2510, 2512, 2514, and 2516 are plotted against a TVD axis 2518 and compass directions indicated by an axis 2520 representing east-west and an axis 2522 representing north-south.

Each vector 2502, 2504, 2506, 2508, 2510, 2512, 2514, and 2516 provides a three dimensional representation of the orientation of the tool face, as well as an amplitude that may be used to represent the mechanical progress (e.g., distance traveled) of the bit and/or one or more other indicators. The amplitude may represent a measurement such as MSE or WOB. In some embodiments, the amplitude may be a combination of measurements and/or may represent the results of calculations based on such measurements. Accordingly, the circular chart 286 may provide a graphical illustration of the vectors 2502, 2504, 2506, 2508, 2510, 2512, 2514, and 2516. Although not shown, each estimate of FIG. 16 may result in one of the vectors 2502, 2504, 2506, 2508, 2510, 2512, 2514, and 2516, which may be combined to provide an estimated path.

Referring again specifically to step 2304 of FIG. 23, for example, the circle 2416 may represent the latest toolface orientation information that is used to calculate the vector 2516 of FIG. 25 when the information used to calculate the previous vector 2514 was represented on the circular chart 286 by the circle 2414. In addition, the slide indicator 292 and/or colored bar 293 may be updated to provide a visual indication of the current status of an ongoing slide.

In step 2306, a determination may be made as to whether a correction is needed according to the information. For example, if the heading is off by five degrees, the surface steerable system 201 may identify this error. In step 2308, the GUI may be updated to reflect this error. For example, the error indicator 294 may be updated. In some embodiments, the surface steerable system 201 may correct the heading automatically, while in other embodiments the target toolface pointer 296 may change to indicate an updated correct heading. For example, as the actual toolface veers off course, the GUI may be repeatedly updated to indicate an offsetting correction that should be made in cases where the GUI is used to notify an individual for manual correction of the toolface. Although continuous or near continuous error calculations may be provided to the driller 310, the steerable system 201 may plan a solution that uses periodic corrections, rather than instantaneous corrections. Accordingly, the display 250 may provide the recommended corrections to the driller 310 so that controlled, gradual, incremental step changes are made. In cases where the solution has a helical or otherwise continuous correction path, instantaneous or periodic corrections may be displayed to the driller 310. For example, the incremental step correction may be a function of the tortuosity of the well, amount of friction, and/or the overall depth of the BHA. In another example, in cases where the toolface is automatically controlled (e.g., via Top Drive), the method 2300 may make the correction via instructions to the Top Drive controller, via another controller, or directly.

A method of assessing hole cleaning effectiveness of drilling in a subsurface formation may include determining a mass of rock excavated in a well. The mass of cuttings excavated from the well can be determined by using an offset log, real time logging while drilling ("LWD") log, of formation bulk density. The length and diameter of hole may be used to provide the volume, and the bulk density log may provide the density estimate.

A mass of cuttings removed from the well may be determined by measuring the total mass of fluid entering the well and the total mass of fluid exiting the well, and then subtracting the total mass of fluid entering the well from total mass of fluid exiting the well. The mass of cuttings remaining in the well may be estimated by subtracting the determined mass of cuttings removed from the well from the determined mass of rock excavated in the well. A quantitative measure of hole cleaning effectiveness may be assessed based on the determined mass of cuttings remaining in the well. Partial fluid losses may be taken into account by excluding the lost fluid mass from the reconciliation.

In some embodiments, continuous monitoring of drilling fluids density and flow rate is achieved using Coriolis mass flow meters. In one embodiment, Coriolis meters are provided at both the suction and return line to physically measure the mass flow of fluid entering and exiting the well in real time. The Coriolis meters may provide flow rate, density and temperature data. In one embodiment, a densimeter, flow meter, and viscometer are mounted inline (for example, on a skid placed between the active mud tank and the mud pumps). The densimeter, flow meter, and viscometer may measure fluid going into the well. A second Coriolis meter is installed at the flow line to measure the fluid exiting the well.

A control system can be programmed to provide an autonomous drilling and data collection process. The process may include monitoring various aspects of drilling performance. The control system may use drilling fluids data manual inputs, sensory measurements, and/or mathematical calculations to help establish indicators and trends to validate drilling performance in real time. In some embodiments, the data collected may be used to determine hole cleaning effectiveness.

Drilling fluid parameters can be measured in real time. Real time measurements may also increase objectivity of the data to facilitate an immediate response to drilling fluid fluctuations. Density, viscosity and flow rate can be measured in real time while drilling. Real time control and data collection of mudflow rate and density in and out of the well may enable accurate drilling parameter optimization. A control system may, for example, automatically react and make optimization adjustments based on sensor signals (with or without human involvement).

Mass balance metering of drilled cuttings may be used to provide trend indication for hole cleaning effectiveness. In one embodiment, a mass balance calculation for a Hole Cleaning Index (HCI) is determined by calculating the volume of cuttings left in the well and making an assumption that all the cuttings are spread evenly along the horizontal section of the well. The cuttings bed height can be calculated and converted into a cross sectional area occupied by cuttings.

$$HCI = \text{Bit Open Area}/\text{Area Occupied by Cuttings}$$

The wellbore column of fluid may be independent of the surface system. Powder products or liquid additives transferred into the active system (if there are any such products or additives) may not have any bearing on the mass balance of fluid being circulated though the well in real time. The excavated drilled cuttings may thus be the only "additive" to the column of fluid. An exception to the assumption that drilled cuttings are the only additive would be if there is an influx of water from the formation. In some embodiments, water influx is determined by monitoring for any unexpected decrease in rheological properties measured from an inline viscometer. In other embodiments, totalizing of the volumes in versus volume out can indicate fluid influxes. The HCI may be adjusted based on any such decrease to account for the water influx.

A Coriolis meter may have a preset calibration schedule. The Coriolis meter may have built-in hi/low level alarms to confirm that accurate data is being received. In one example, a 6" Coriolis meter has two flow tubes, each having a diameter at 3.5" (88.9 mm). In one embodiment, the Coriolis meter controls the material flow to an accuracy of ±0.5 percent of the preset flow rate.

The use of automatic monitoring of cleaning effectiveness may eliminate or reduce a need for human monitoring of operations, such as monitoring of the shakers. For example, personnel may not be required at the shakers to measure viscosity and mud weight a periodic intervals. As another example, a mud engineer may not need to catch mud sample at periodic intervals.

A look-up table may be provided that includes calliper log data from offset wells to increase accuracy.

A look-up table may be provided that includes a washout percentage vs depth from offset wells.

The lag time may be computed based on the time it takes to empty the annulus of mud calculated from the annular volume and flowrate (a "bottoms up" time)

Cuttings shape, size, fluid slip velocity, horizontal vs vertical drilling may be assessed Flow measurements may be used to set targets or thresholds used by the control system.

Performance of a mud solids handling system is monitored with the Coriolis metering system. Density and rate (mass flow) of slurry from the annulus of the well may be metered corning into the solids control system. The efficiency of the system in removing solids may be measured by the Coriolis meter on the other side of the system at the point where the mud enters the mud pump to be sent back down the hole. By tracking the base density of the mud against the density of the mud going back down the hole, the capacity of the system to remove the drilled solids is assessed.

Solids left in the well may be determined. An overall solids control system performance is determined based on an overall removal of rock mass from both the well and the drilling fluid. The overall solids control system performance may provide an indicator as to how much cuttings are left in the well. In one embodiment, the measured mass of rock is plotted against theoretical mass of rock generated. The result may be displayed to an operator in a graphical user interface. A Maximum Solids Threshold Limit is established. The limit may be automatically displayed to a driller to provide the driller with a visual cue that the well is not adequately being cleaned. The limit may be linked as a setpoint to be monitored by an automated drilling control system. If the system determines that wellbore cleaning is inadequate, mitigation subroutines may be initiated such as reducing rate of penetration, increasing flow rate, increasing circulating time and rotary speed in the pre- and post-joint drilling phases.

The following discussion addresses systems and methods useful in controlling the drilling of well based at least in part on the effectiveness of the drilling rig system at removing rock cuttings and other solids, as well as drilling muds and other fluids, from the borehole while drilling. A system for controlling drilling operations in accordance with this disclosure may be a surface steerable system with additional programming, or may an additional one or more computer systems with programming, and such one or more computer systems may be systems like the surface steerable system described above. The control system or systems used in accordance with the present disclosure may be connected, directly or indirectly, to one or more components of a drilling rig, to one or more drilling rig control systems, and/or to an autodriller system connected to and operable to control operations of a drilling rig and systems.

A control system may be provided that includes at least one processor, memory, and computer instructions executable by the processor. The control system may be programmed to receive a variety of inputs useful in monitoring the drilling operations and monitoring and determining the hole cleaning effectiveness of the drilling rig system. These inputs may include one or more inputs of data from one or more downhole sensors and/or surface sensors. Such data may be provided in real-time during drilling. In addition, the control system may be programmed to use one or more of such inputs to determine whether or not adjustments in one or more of the drilling parameters may be appropriate to maintain a desired ROP or maintain an ROP within a desired target range based on the determined hole cleaning effectiveness of the rig system. Moreover, the control system may be programmed to automatically send one or more control signals to one or more components of the drilling rig in order to automatically implement any such one or more adjustments of the one or more drilling parameters, and to drill in accordance with such adjustments. Alternatively, the control system may be programmed to provide or transmit such one or more control signals to one or more drilling rig control systems, drilling rig components, and/or an autodriller for the drilling rig, so that such drilling rig systems, component systems, and/or autodriller may automatically implement any such one or more adjustments of the drilling parameters and adjust drilling operations in accordance therewith. It should be noted that the control system in accordance with the present disclosure can be programmed to provide control signals that may be operable to adjust one or more operating parameters, to adjust one or more target drilling parameters or set points, or to adjust the limits for an autodriller system. The control system's control signals may be transmitted to and operable to adjust additional components and parameters beyond those subject to control adjustments via an autodriller system, such as adjustments to flowrate and RPM, alone or in conjunction with those drilling parameters subject to autodriller control.

Figure 26:
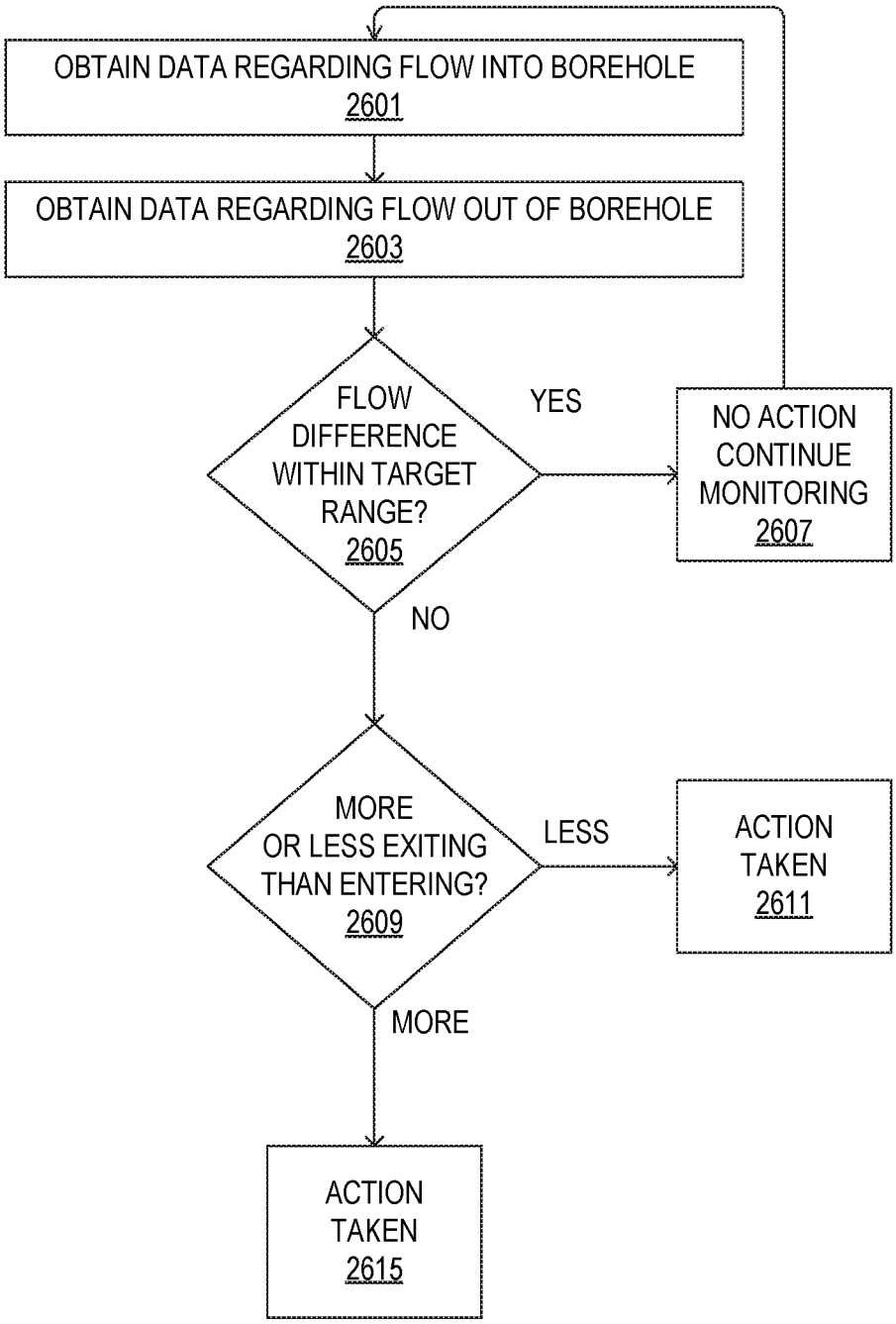
FIG. 26 is a flow diagram which illustrates one embodiment of a process for controlling drilling operations based on borehole cleaning effectiveness.

Referring to FIG. 26, a flow chart is provided to illustrate one embodiment of a process for control of drilling based on borehole cleaning effectiveness. In step 2601, the control system may obtain a variety of input data regarding the flow of fluids into the well borehole and the solids introduced into the well borehole, such as from the crushing and/or cutting of the rock while drilling. Such data may include any one or more of the following information: data from one or more prior wells, data regarding the BHA being used to drill, WOB, ROP, mud pressure, mud flow rates into the borehole and/or out of the borehole, the type or mode of the current drilling operations (e.g., rotary drilling, slide drilling, etc.), the current segment of the planned well, information relating to the formation being drilled, the torque applied to the bit, the rotation of the mud motor, the drag on the bit and/or drill string, and so forth.

In step 2603, the control system may obtain a variety of input data regarding the flow of fluids and solids from the well borehole. Such data may include any one or more of the following information: data from one or more prior wells, data regarding the BHA being used to drill, WOB, ROP, mud pressure, mud flow rates into the borehole and/or out of the borehole, the type or mode of the current drilling operations (e.g., rotary drilling, slide drilling, etc.), the current segment of the planned well, information relating to the formation being drilled (including cuttings), the torque applied to the bit, the rotation of the mud motor, the drag on the bit and/or drill string, and so forth. The input data may include data obtained in real-time during drilling from one or more downhole sensors and/or one or more surface sensors. Such data may be used by itself, or may be used in combination with historical data from one or more portions of the same well or from other wells. Likewise, the input data may consist of historical data from the same well or from one or more earlier wells, without the use of data from sensors, if desired.

In addition to monitoring and measuring the volume of fluids and cuttings exiting the borehole to assess hole cleaning effectiveness, other forms of measurement may be used to determine and assess whether a lack of effective hole cleaning exists and the extent to which it may pose a problem. Such other forms of measurement can be used on their own or in addition to the comparison of the volume or flow rate of fluids going into the borehole and rock drilled with the volume of fluids and cuttings coming out of the borehole. For example, as rotary torque increases, pick-up and slack-off weight variation and weight transfer issues can be detected and may indicate excess drag or friction resulting from ineffective hole cleaning. This situation can lead to responsive actions, such as an automatic reduction in the aggressiveness of the drilling operations, pumping a sweep by the drilling mud, or performing a form of cleanup cycle. Autodriller set points for drilling operations and various drilling parameters can be controlled or limited based on any combination of the foregoing factors.

In step 2605, the control system uses the input data provided in steps 2601 and 2603 and determines whether the flow out of the well borehole and the flow into the well borehole are close enough to be within a desired target range. Alternatively, the control system may be used to determine whether the flow out of the borehole is above (or below, as appropriate) a threshold or target. The control system may make this determination at step 2605 in any one or more of several ways. First, the control system may determine the mass of the fluids and solids entering the wellbore and the mass of the solids and fluids exiting the wellbore, then determine whether the difference between these two numbers is within or outside a selected target range of values. Alternatively, the control system may be programmed to determine the volume (e.g., flow rate) of the fluids and solids introduced into the wellbore and the volume (e.g., flow rate) of the fluids and solids exiting the wellbore, then determine whether these two values are sufficiently close to be within the desired target range.

In step 2605, the control system may also adjust for the time required for the cuttings and mud to return to the surface from the location of the drill bit, and/or the time required for the drilling mud to travel from the location at which the entering volume or flow rate is measured or determined to the drill bit. The depth of the borehole, the flow rate, the pressure of the drilling mud, and the like are variables that can affect the time required for drilling mud to travel from the surface to the bit, and for the mud and the cuttings to travel from the bit to the surface. The control system may receive information regarding such drilling parameters and can determine the time requirements so that the control system can compare the volume or flow rate exiting the borehole with the same or substantial same volume or flow rate of the mud that previously entered the borehole. This approach may provide a better comparison of the input volumes or flow rates and the corresponding output volumes or flow rates. In addition, the target range may be preset by an operator, may be based on historical data, and/or may vary for different borehole segments. In another alternative, the control system may be programmed to calculate a hole cleaning effectiveness value and then determine whether that value is within a target range and make appropriate drilling control adjustments based on such a determination. It should be noted that, if desired, the control system may be programmed to calculate whether the effective hole cleaning rate (e.g., (fluid volume in per time unit−(fluid volume+cuttings volume out per time unit) versus volume of rock drilled in that time unit) is within a desired or acceptable target range, or exceeds a minimum or maximum value, based on one or more data inputs like those noted above. Alternatively, however, the control system may be programmed to calculate the hole cleaning rate based on programmed models for calculating the same or based on past historical data from the same well borehole and/or from other wells without necessarily using any real-time data received from surface or downhole sensors from the well being drilled.

In the example flow chart in FIG. 26, if the determination at step 2605 is that the fluids and solids going into the well borehole and the fluids and solids exiting the well are within a desired target range, then the control system may take no further action and proceed to step 2607, in which the control system continues monitoring the well drilling operations, receiving data and essentially repeating the steps as described.

In step 2609, the control system is programmed to determine what happens when the comparison of the fluids and solids entering the well and the fluids and solids exiting the well is not within a desired target range. In step 2609, the control system may determine whether the difference between the solids and fluids exiting the borehole and those entering the borehole indicate that less solids and fluids are exiting than are entering. If this is the case, the control system may proceed to step 2611, at which the control system may be programmed to automatically generate an alert to an operator, which may be one or more of a display, an audible sound, an email, a text message, and the like. In addition, or alternatively, the control system may be programmed to automatically generate one or more control signals and send such signals to one or more components of the drilling rig system to adjust one or more drilling parameters, which may include adjusting ROP, WOB, torque, rotation of the drill string, rotation of the mud motor, mud flow rate, pump speed, and the like.

If the control system determines at step 2609 that the difference between the solids and fluids entering the borehole and those exiting the borehole indicates that more solids and fluids are exiting than are entering, the control system may be programmed to proceed to step 2615 to adjust one or more drilling parameters. For example, the control system may be programmed to increase the volume of mud entering the well borehole and to also adjust one or more drilling parameters to increase the ROP of the bit within the borehole if the drilling rig system is effectively cleaning the borehole.

In one embodiment, the control system may be programmed to perform one or more additional checks if the hole cleaning rate falls outside of the desired target range or if one or more hole cleaning parameters fall below a minimum or exceed a maximum desired value, such as whether to allow the detected condition to continue without adjusting drilling parameters immediately or for a predetermined time or length of measured depth. For example, allowing the condition to exist temporarily may be appropriate if rotary drilling is being performed and generates a significant amount of cuttings, but the control system knows based on one or more inputs, such as via a drill plan, that a slide drilling operation will be performed shortly. Because the cuttings from the rotary drilling are likely to be removed during the upcoming slide drilling operations, the control system may allow continued drilling without any adjustment of drilling parameters. In such a situation, there may not be any real need to adjust drilling parameters to account for hole cleaning effectiveness because the forthcoming switch to slide drilling operations will allow the drilling system to essentially "catch up" with respect to removal of any excess cuttings.

In another embodiment, the control system of the present disclosure may be connected to one or more of the mud pumps of the drilling rig system, or to one or more mud pump control systems, and may be programmed to adjust one or more drilling operations by sending control signals, or sending one or more alerts, as noted above, if one or more of the mud pumps ceases to operate or ceases to operate at a minimum acceptable level (e.g., a predetermined minimum flow rate). This may be especially helpful if the control system has determined that the hole cleaning effectiveness rate is already close to falling outside the target range, failing to meet the predetermined minimum, or exceeding a predetermined maximum, and/or if other conditions exist that suggest a potential problem may occur, such as may be based on the well plan, due to anticipated drilling into or through a particular formation, due to expected upcoming drilling operations, and the like.

Once the control system takes appropriate action at either step 2611 or 2615, the control system may then repeat the process and continue monitoring drilling operations and making any appropriate corrections or adjustments as described.

In one aspect of the present disclosure, some or all of the steps shown in FIG. 26 may be taken responsive to changes or conditions of the mud system of the drilling rig. As detailed below, for example, the rig control systems 500 and/or steering control 168 may be programmed so that, upon the existence of certain conditions or drilling activities, or in anticipation of certain conditions or activities, additives of a desired type and/or in a desired amount, may be automatically added to the drilling mud system, or additional drilling mud may be added to the system. Upon the occurrence of such actions with respect to the drilling mud system (e.g., additives added, additional drilling mud added, and so forth as described below), the rig control system 500 and/or steering control system 168 may automatically take some or all of the steps of the flow chart shown in FIG. 26, such as, for example, determining whether the comparison of fluids and solids entering the well and the fluids and solids exiting the well are within a target range or do not exceed a threshold value and, if the comparison is outside a target range or exceeds (or falls below, as the case may be) a threshold, then generating an alert or sending a signal to adjust or modify one or more drilling parameters.

As technological advancements in drilling occur, various aspects of the drilling process may become at least partially automated, to improve efficiency and reliability of various functions that have typically been performed manually by humans. Increased automation may also provide new synergy or capabilities that were previously not or poorly integrated, such as due to manual operations that do not lend themselves to automation, or due to improved outcomes from the use of more data in a faster manner than human operators can handle.

For example, rig control systems 500, and steering control system 168 in particular, may become increasingly integrated and may support new fields of automation that were previously not considered for integration. This technological integration and automation of various aspects of drilling wells may enable drilling operations to essentially become repeatable manufacturing processes, which is economically desirable in the drilling industry.

One aspect of the drilling process that is typically manually performed by humans is the processing of drilling mud 153 used for drilling. For example, as discussed above with respect to FIG. 5, drilling equipment 530 includes mud pumping equipment 536 to control mud flow and may also receive and decode mud telemetry signals. Thus, mud pumping 546 may represent the various equipment to introduce, circulate, and control pumping of drilling mud 153 into borehole 106 during drilling. As further described above with respect to FIG. 1, mud pumping equipment 536 may include various elements depicted with respect to drilling system 100, such as mud pit 154, mud pump 152, discharge line 156, standpipe 160, and rotary hose 158, among others. It is noted that drilling system 100 depicts an exemplary embodiment of drilling mud processing and that various systems and methods may be used for circulating drilling mud 153 into borehole 106 for drilling purposes.

As drilling mud 153 is circulated, including when circulated to the surface 104, drilling mud 153 may contain various information that is relevant to the drilling process. For example, a physical condition of drilling mud 153, such as color, hydrocarbon content, rock content, particulate content, thickness, etc., may be indicative of the formation being drilled. In addition, certain physical or chemical properties of drilling mud 153, such as temperature, viscosity, density, resistivity, GR count, alkalinity or acidity (pH), chemical composition, etc., may be characteristic of the geological formation, but also of the effect of various drilling parameters used to drill through the geological formation. For these reasons, an analysis of drilling mud 153 may be performed at the surface 104 to ascertain valuable information about the actual state of drilling that is occurring at drill bit 148.

The analysis of drilling mud 153 typically involves analysis of rock cuttings, fluids, hydrocarbons, and other material that has been carried to the surface 104 by drilling mud 153, usually from the bottom or end of borehole 106 where drilling is being performed. During drilling operations, drilling mud 153 travels downhole in borehole 106 until drilling mud 153 reaches drill bit 148. Drill bit 148 grinds into geological formation 102, which results in rock cuttings and other drilling byproducts being introduced into drilling mud 153. By virtue of the pressure applied to drilling mud 153 at the surface 104, drilling mud 153 is then forced back to the surface 104, along with the rock cuttings and drilling byproducts, among other materials from borehole 106. When drilling mud 153 arrives at the surface 104 in a typical drilling operation, a human geologist may manually examine samples of drilling mud 153 in order to provide a characterization of drilling mud 153 to report back to the drilling operator. For example, the human geologist may manually perform microscopy on the samples of drilling mud 153 to better observe the microcontents, such as particulates and various other content in drilling mud 153. In particular, the human geologist may look for rock cuttings, gas and oil content, different types of rocks, and the presence of various chemicals in drilling mud 153. However, the human geologist's findings about drilling mud 153 may be subjective and interpretive, and may be primarily based on the professional experience of the human geologist. Typically, a report of the human geologist's findings may be provided to the drilling operator, who may use the report on drilling mud 153, among other information, for modifying the drill path or for adjusting other aspects of the drilling operation. The findings in the report may also be recorded, such as in a mud log that may be indexed to a particular depth, which may be TVD, MD, or some other depth value.

The manual analysis of drilling mud 153 by the human geologist during drilling described above may have several disadvantages. First, the human geologist's report may not be captured in electronic form suitable for process integration, and may simply be kept using paper logs or text documents, which may not be accessible by existing hardware or software used for automation, such as by steering control system 168. Second, the human geologist's report may become available after a substantial delay has passed, which may reduce the effectiveness of any action taken by the drilling operator based on the report. For example, the delay may encompass a pumping time for transporting drilling mud 153 from drill bit 148 to the surface 104, an analysis time for inspecting the content in drilling mud 153, and a reporting time for generating the report and sending the report to the drilling operator. For example, the pumping time itself may take hours for drilling mud 153 to rise from a 20,000-foot deep borehole 106 from drill bit 148 to the surface 104, such that the additional delays from the analysis time and the reporting time may further aggravate the pumping time delay. Furthermore, a manually generated report on the condition of the drilling mud may be difficult or impossible to integrate with process data that are collected for the well, such as drilling parameters and survey data of the formation being drilled through.

As disclosed herein, a system and method for analysis and control of drilling mud 153 and additives may enable process integration and automation during drilling of a well, such as borehole 106. The system and method for analysis and control of drilling mud and additives disclosed herein may be integrated with and controlled by steering control system 168, as described above. The system and method for analysis and control of drilling mud and additives disclosed herein may enable automatic sampling and analysis of drilling mud 153 during drilling, such as by using a mud analysis system. The system and method for analysis and control of drilling mud and additives disclosed herein may enable qualitative or quantitative results of the analysis of drilling mud 153 to be provided to, and interpreted by, steering control system 168. The system and method for analysis and control of drilling mud and additives disclosed herein may enable steering control system 168, based on the results of the analysis, to determine various actions and responses to the analyzed condition of drilling mud 153. The system and method for analysis and control of drilling mud and additives disclosed herein may enable steering control system 168 to display indications of the composition and timing of drilling mud 153 during drilling. The system and method for analysis and control of drilling mud and additives disclosed herein may enable steering control system 168 to receive user input to control the composition and timing of additives to be added to drilling mud 153 during drilling. The system and method for analysis and control of drilling mud and additives disclosed herein may determine a composition of additives and a timing of adding the additives to drilling mud 153. The system and method for analysis and control of drilling mud and additives disclosed herein may be enabled to automatically mix a composition of additives for drilling mud 153 from a plurality of additives, such as by using a mud additive system. The system and method for analysis and control of drilling mud and additives disclosed herein may be enabled to automatically dose an additive into drilling mud 153 during drilling, such as by using the mud additive system.

The system and method for analysis and control of drilling mud and additives disclosed herein may provide feedback about drilling operations without delay during drilling. The feedback provided by the system and method for analysis and control of drilling mud and additives disclosed herein may include confirmation or early detection of drilling into or out of a geological formation, or of geological formation transitions (either in the vertical direction or in the horizontal direction), as well as information indicative of downhole tool health, such as through analysis of rubber or ferrous metals content (e.g., wear byproducts of tool steel) in drilling mud 153. The system and method for analysis and control of drilling mud and additives disclosed herein may aid in the placement of a downhole tool in borehole 106. The system and method for analysis and control of drilling mud and additives disclosed herein may provide measurement of the density and the viscosity of drilling mud 153 that can provide an early warning for mud loss changes or the presence of natural gas. The system and method for analysis and control of drilling mud and additives disclosed herein may enable early detection of, and thus, potential mitigation of, drilling through undesirable geological formations. For example, ashbeds are a type of geological formation in which drill bit 148 may often become stuck. Instead of conventional methods of mud analysis, such a manual examination of drilling mud 153 and its contents by a human geologist using a microscope, the system and method for analysis and control of drilling mud and additives disclosed herein may enable automatic identification and early detection of the ashbed, in order to report the presence of the ashbed as early as possible to the driller, in order to give the driller more time and more options to respond, such as by avoiding the ashbed. The system and method for analysis and control of drilling mud and additives disclosed herein may further provide digital mud logs that can be correlated with gamma ray logs and drilling parameter logs, such as according to MD. The various correlated logs, including the digital mud logs, may enable improved accuracy in determining an actual drilling location, such a location of drill bit 148 relative to a given formation, as well as improved accuracy of other drilling information. The system and method for analysis and control of drilling mud and additives disclosed herein may integrate analysis results from the mud analysis system as feedback into a drilling and geosteering control loop, such as GCL 900 described above with respect to FIG. 9.

Figure 27:
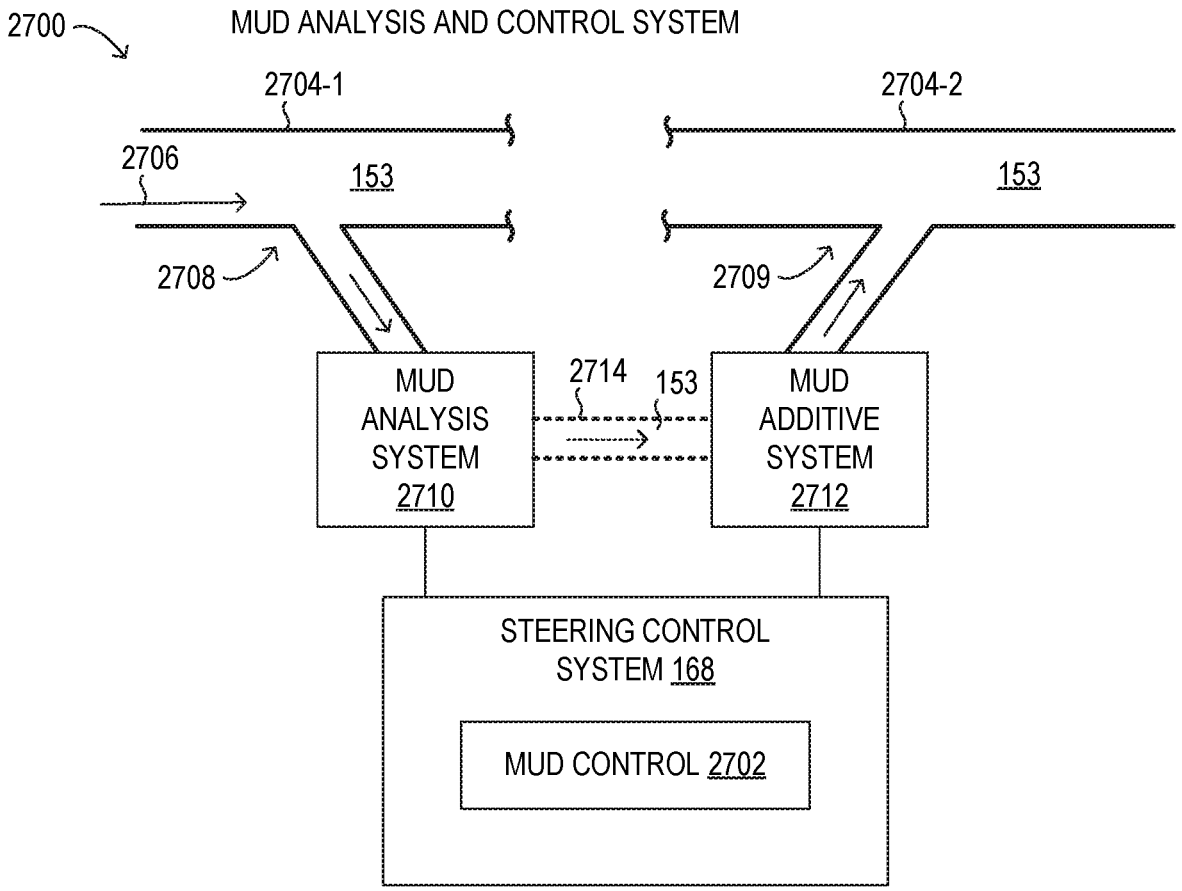
FIG. 27 is a schematic diagram of an exemplary embodiment of a mud analysis and control system.

Referring now to FIG. 27, a mud analysis and control system 2700 is depicted. As shown in FIG. 27, mud analysis and control system 2700 is depicted in schematic form for descriptive clarity, and is not drawn to scale or perspective. It is noted that various elements not shown in FIG. 27 may be incorporated into mud analysis and control system 2700 in various embodiments. In FIG. 27, various elements in mud analysis and control system 2700 are shown operating in fluid communication with a mud line 2704 having drilling mud 153 passing therethrough in a direction 2706. It is noted that mud line 2704 may represent any of various mud lines or connections that are included in mud pumping equipment 536 (see FIG. 5), such as a conduit to or from mud pit 154, discharge line 156, or a conduit associated with mud pump 152 (see FIG. 1), among others. Accordingly, mud analysis and control system 2700 may be variously integrated with mud pumping equipment 536. Also shown with mud analysis and control system 2700 is steering control system 168, which is shown including a mud control 2702, which may be a hardware or software module for performing various operations associated with the system and method for analysis and control of drilling mud and additives disclosed herein (see also FIGS. 14 and 15). For example, mud control 2702 may receive and interpret signals from mud analysis system 2710 that are indicative of properties of drilling mud 153, such as properties determined by one or more of the sensors included with mud analysis system 2710. Additionally, mud control 2702 may send commands to control a mud additive system 2712 that may be enabled to mix and dose specific compositions of additives into drilling mud 153 (see also FIG. 13). Accordingly, because mud control 2702 is integrated with steering control system 168 in a similar manner as autodriller 510, bit guidance 512, and autoslide 514 (see FIG. 5), steering control system 168 may be enabled to perform various analyses and decision-making regarding drilling parameters, including evaluating various drilling information associated with borehole 106, in addition to, or in coordination with, mud analysis and control, as described herein. Additionally, it is noted that steering control system 168 may be enabled to display indications of the composition and timing of drilling mud 153 during drilling, as well as to receive user input to control the composition and timing of additives to be added to drilling mud 153 during drilling. For example, user interface 850 (see FIG. 8) provided by steering control system 168 may include with display elements indicating a condition of drilling mud 153, or a measurement value associated with drilling mud 153, such as on a log plot versus MD or another depth. User interface 850 provided by steering control system 168 may also include user input elements, such as to control the composition of drilling mud 153 at a desired time. For example, user input elements may be available for operation using user interface 850 that enable a user to specify various properties of an additive to be added to drilling mud 154, such as by mud additive system 2712, including particle size, density, composition, delivery timing, among other options.

The timing of the additives to drilling mud 153 may be accordingly controlled using various factors that steering control system 168 can access and evaluate. In one example, steering control system 168 may send a request to mud additive system 2712 specifying a composition and a future time to add a given additive to drilling mud 153. In response, mud additive system 2712 may be enabled to prepare and mix the composition of the additive and to add the additive having the mixed composition when the future time occurs. In another example, the request may specify a drilling operation that is planned to occur after a minimum delay period from when the request was sent. Then, as steering control system 168 controls drilling to perform the drilling operation, mud additive system 2712 may be enabled or controlled to add the additive within a specified time in advance of the planned drilling operation. The minimum delay period may be longer than the specified time in advance of the planned drilling operation to allow for sufficient time for the additive to reach drill bit 148. In some embodiments, the additive may be a lubricant, such as PTFE beads, while the drilling operation is a slide. In a third example, the minimum delay period may be determined by steering control system 168 from at least one of the following: ROP, WOB, differential pressure, a rotational velocity of drill bit 148, MD, a mud flow rate; the drill plan; and a threshold delay value.

In addition, the timing of sampling drilling mud 153 by mud analysis system 2710 may be controlled in a variety of ways. In one example, a time-based approach may be used, such as at regular or irregular intervals for sampling drilling mud 153, or at predetermined times. In some embodiments, the intervals may be adapted by steering control system 168 depending on various factors associated with drilling, such as a value of a drilling parameter, or a condition of drilling mud 153. In another example, a volume-based approach may be used, such as sampling drilling mud 153 according to a given volume of drilling mud 153 that has been circulated, such as every 1,000 gallons, among other values. In another example, sampling of drilling mud 153 may be based on MD of borehole 106, such as at regular intervals, irregular intervals, or at specified values of MD.

In FIG. 27, mud analysis and control system 2700 includes a mud analysis system 2710 that is enabled to receive a circulating supply of drilling mud 153 at a diversion 2708 in fluid communication with mud line 2704-1, which may represent an arbitrary first section of mud line 2704. As shown mud line 2704-1 is a source of drilling mud 153 that is sampled by mud analysis system 2710. The location of mud line 2704-1 may vary and may represent different locations in mud pumping equipment 536. For example, mud line 2704-1 may be located to enable sampling of drilling mud 153 upon emerging from borehole 106. In another example, mud line 2704-1 may be located to enable sampling of drilling mud 153 entering or leaving mud pit 154 or mud supply tank 2912. In yet another example, mud line 2704-1 may be located to enable sampling of drilling mud 153 entering borehole 106. Other locations for mud line 2704-1 may also be used. In this manner, an absolute or a relative condition of drilling mud 153 at a given location may be compared to the remaining supply of drilling mud 153, as sampled in a variety of locations.

Although depicted as a Y-diversion, it is noted that diversion 2708 may be any of a variety of means for obtaining a characteristic mud sample from the flow in mud line 2704 in direction 2706, such as a bypass line to mud line 2704 or another sampling means. For example, mud analysis system 2710 may include a means for obtaining a desired mud sample from a closed mud conduit, from an open mud line, from mud pit 154, from mud supply tank 2912, or various combinations thereof. In some embodiments, the desired mud sample may be a sample of particulate matter that has been isolated from drilling mud 153, such as rock cuttings or metal shavings, for example. In some embodiments, mud analysis system 2710 may support receiving manually supplied mud samples, such as obtained from a human operator. In some embodiments, mud analysis system 2710 may return the drilling mud diverted at diversion 2708 using a return line 2714 (shown as an optional dashed element in FIG. 27) that may be in fluid communication with mud line 2704, such as via mud additive system 2712 as shown.

As described in further detail with respect to FIG. 28 below, mud analysis system 2710 may include a variety of sensors and sensory means for qualitatively and quantitatively analyzing drilling mud 153 flowing through mud line 2704. As noted, mud analysis system 2710 may include connections for receiving mud flow from diversion 2708, as well as internal connections and means for autosampling drilling mud 153 from diversion 2708, in order to operate the various sensors. Specifically, mud analysis system 2710 may include various mud connections, mud pumps and other mud handling equipment, as well as electronic connections for power and communications, such as network connections for communicating with steering control system 168, or more specifically, with mud control 2702.

One example of a mud analysis system that is enabled for similar analyses as mud analysis system 2710, and can analyze mud density and mud rheology is Halliburton's BaraLogix™ Density Rheology Unit. As disclosed herein, mud analysis system 2710 provides various additional sensors and is communicatively integrated with steering control system 168, such as by providing output signals (not shown) indicative of mud properties (see also FIG. 28). It is noted that the output signals may be in various analog or digital form, and may be direct or indirect signals. Direct signals may be directly communicated from mud analysis system 2710 to mud control 2702 in operation, such as by using an active network connection and without intermediate storage. Indirect signals may be transmitted using an intermediate storage, such as a database, and may be in the form of numerical values that are updated by mud analysis system 2710 in the database without direct communication with mud control 2702, in one example. The database for transmitting such indirect signals may be local to steering control system 168, or may be a regional drilling database, or a central drilling database (see FIG. 4).

Furthermore, steering control system 168 (or mud control 2702) may be enabled to log information indicative of the output signals from mud analysis system 2710 as a mud log that can be indexed using MD, for example. Specifically, mud analysis system 2710 may enabled to correlate a sample of drilling mud 153 with the MD of borehole 106 using various different methods. In one example, mud analysis system 2710 may enabled to correlate a sample of drilling mud 153 with the MD of borehole 106 by comparing the first property with a drill plan for the well, by identifying a time of drilling from a first timestamp indicative of the output signal and a travel time of drilling mud 153 from the MD to the surface 104, by identifying a pressure of drilling mud 153 indicative of a velocity of drilling mud 153 from the MD to the surface 104, or various combinations thereof. It is noted that there can be a variable time delay for drilling mud 153 to travel to the surface 104 from a location in proximity to drill bit 148 in borehole 106. The variable time delay may be a function of a hole size of borehole 106 and a flow rate of drilling mud 153. In some embodiments, steering control system 168 may be coupled, directly or indirectly, with various components included with mud pumping, as shown previously with respect to FIG. 5, including components such as mud pumps, valves, pressure regulators, flow meters, among other mud handling components. Accordingly, steering control system 168 may be enabled to receive or acquire various process parameters associated with mud pumping equipment 536, such as flowrate, volumetric losses, BHA information, as well as borehole size and borehole geometry at various MDs, for example. With access to such process parameters associated with mud pumping equipment 536, steering control system 168 (or mud control 2702) may be enabled to associate various content of drilling mud 153 (e.g., cuttings, fluids, inclusions, particles, etc.) at the surface 104 to a location or a measured depth within borehole 106, from where a sample of drilling mud 153 originates.

Additionally, steering control system 168 (or mud control 2702) may invoke borehole estimator 906 (see FIG. 9) to map the measured depth to TVD without delay during drilling, for example. In this manner, logs of one or more mud properties may be combined with other logged well data, such as gamma ray data, drilling parameters, and drilling equipment parameters, such as MSE or a drift rate, among others, into a single log, display, or data file, which is desirable for predictive methods, drilling operations, and post-well analyses. The combined logged well data, including mud property logs, may also be used for pattern recognition to improve identification of geological formations, such as target area 280 in strata layer 272-1 or another strata layer (see FIG. 2), which may improve steering the drilling of the well. In one example, the combined logged well data, including mud property logs, may be provided to steering control system 168 for comparing the combined logged well data with a corresponding drill plan for the well, including data associated with one or more geological formations in the well. Alternatively, the mud property log may be correlated with one or more additional logs, such as a GR log among others, to help identify one or more geological formations of interest. For example, a result of the comparing may produce a match, or a correlation within a selected margin of error, to identify a particular geological formation. When the particular formation is identified, steering control system 168 may output a notification indicating that a match exists and may identify the determined formation, such as on a user interface displayed to a user. Additionally, steering control system 168, responsive to identifying the formation, may determine one or more suggested actions for drilling operations. For example, steering control system 168 may automatically adjust one or more drilling parameters based on the identified formation, such as modifying a slide drilling operation to reach target area 280, or to avoid an undesirable formation (e.g., an ash bed).

In one example, steering control system 168 may employ geosteering and may compare results of mud analyses performed by mud analysis system 2710 to a target drill path for borehole 106, such as specified in the drill plan. Depending on the results of the geosteering comparison in conjunction with the mud analyses performed by mud analysis system 2710, steering control system 168 may be enabled to alter the drill path of borehole 106 and may implement corresponding actions and changes in drilling parameters to implement the altered drill path. Accordingly, steering control system 168 may determine a location of drill bit 148 relative to a surrounding geological formation, and may know which geological formations are expected as drilling continues. Thus, for example, steering control system 168 may use the mud analyses to determine whether drill bit 148 is in a desired formation, is in an undesired formation, is about to enter a desired formation, or is about to enter an undesired formation. The location of drill bit 148 determined by steering control system 168 may be a relative location with respect to a particular geological formation that is determined based on drilling parameters, such as ROP or an expected time period before drill bit 148 reaches a given formation boundary. When indicated, steering control system 168 may determine an appropriate corrective action (such as to cease drilling, commence a slide drilling operation, or change one or more drilling parameters), and then automatically drill in accordance with the determined corrective action, based on the results of the mud analyses by mud analysis system 2710, at least in part.

Although shown integrated with mud line 2704 in FIG. 27, which is located at the surface 104, it is noted that one or more sensors included with mud analysis system 2710 may be located downhole in borehole 106. For example, a downhole sensor included with mud analysis system 2710 may not receive drilling mud from diversion 2708, but rather, such a downhole sensor may directly measure a property of drilling mud 153 within borehole 106, such as in proximity to drill bit 148, among other locations along drill string 146. The downhole sensor may be communicatively coupled to mud analysis system 2710 or mud control 2702 (rather than directly measuring drilling mud 153 at surface 104) to provide signals indicative of downhole properties of drilling mud 153. Such a downhole measurement of various properties of drilling mud 153 may be advantageous, such as by eliminating potential sources of error that may be introduced as drilling mud 153 travels to the surface 104. In addition, a travel time for the signal from the downhole sensor to reach the surface 104, and be interpreted by mud control 2702, may be less than the delay involved with analyzing drilling mud 153 at the surface 104, which may be desirable for certain drilling control operations.

In FIG. 27, mud analysis and control system 2700 further includes mud additive system 2712, as noted. Mud additive system 2712 may be enabled to introduce additives into drilling mud 153 that circulates along drill string 146 in borehole 106. Accordingly, mud additive system 2712 may be enabled to prepare, dose, and supply one or more additives, such as in a desired composition or concentration, for adding to drilling mud 153 at a merge point 2709. As with diversion 2708, merge point 2709 is schematically depicted, and may represent any of a variety of means enabled to introduce solid, liquid, or mixed solid-liquid additives into drilling mud 153 flowing in direction 2706 in conduit 2704-2. It is noted that conduit portion 2704-2 may represent any arbitrary mud handling process location where introduction of additives using merge point 2709 is desired. It is noted that mud additive system 2712 may also be used to add a fresh supply of mud or other liquids, or to first dissolve one or more additives into a supply of fresh mud prior to introduction at merge point 2709. Further details of mud additive system 2712 are described below with respect to FIG. 29.

Also shown in FIG. 27 as a dashed element is return line 2714 that may optionally fluidically couple an output from mud analysis system 2710 to an input to mud additive system 2712. In some embodiments, return line 2714 may represent a portion of a bypass mud line to conduit 2704 within which a characteristic sample of drilling mud 153 is carried to mud analysis system 2710 and then flows to mud additive system 2712 before being reintroduced to conduit 2704-2 at merge point 2709. It is noted that mud analysis system 2710 may further include additional diversions (not shown) to obtain characteristic mud samples, while mud additive system 2712 may include additional merge points (not shown) to introduce one or more additives. In still other embodiments, it is noted that mud analysis and control system 2700 may be arranged with mud analysis system 2710 and mud additive system 2712 being in direct fluid communication with conduit 2704, such that diversion 2708 or merge point 2709 are not used. It is further noted that at least certain portions of mud analysis system 2710 may be placed downstream of mud additive system 2712, in order to validate or confirm the operation of mud additive system 2712, such as by using a sensor to analyze drilling mud 153 after merge point 2709 to confirm that a particular additive was indeed properly added to drilling mud 153 by mud additive system 2712.

Figure 28:
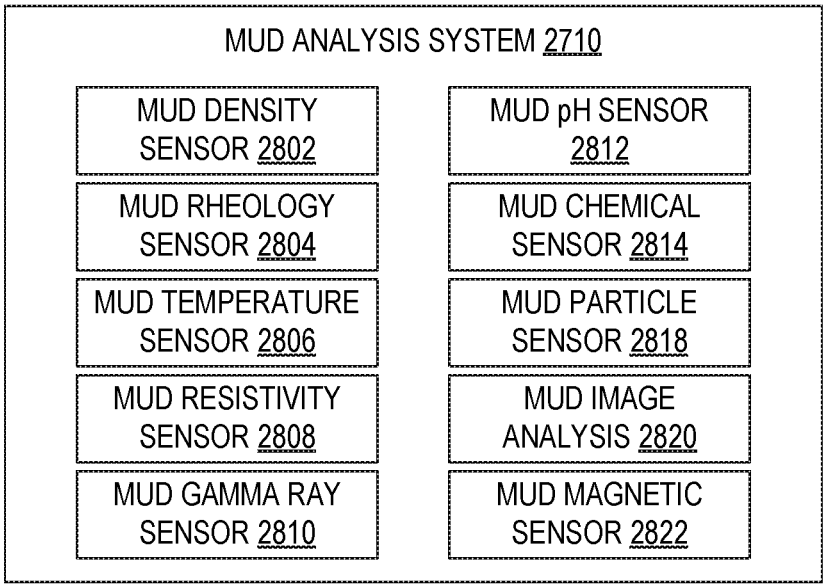
FIG. 28 is a block diagram of an exemplary embodiment of a mud analysis system.

Referring now to FIG. 28, further details of mud analysis system 2710 are depicted. Specifically, FIG. 28 depicts a plurality of mud sensors and corresponding equipment that may be included with mud analysis system 2710. FIG. 28 is a schematic diagram for descriptive purposes and omits various implementation details for clarity. It is noted that each of the elements shown included with mud analysis system 2710 may be associated with mud sample handling equipment, as well as processing equipment enabled for measurement, control, and communication (not shown). For example, the processing equipment may include one or more processors with an accessible memory media that is enabled to execute instructions, such as instructions for acquiring measurements from a sensor included with mud analysis system 2710, instructions for controlling sample handling equipment, and instructions to communicate analysis results, such as measured values, to mud control 2702, among other instructions. Certain ones of the sensors depicted with mud analysis system 2710 in FIG. 28 may be located downhole in borehole 106, in addition to sensors that are located at the surface 104. For example, a mud temperature sensor 2806 may be located within downhole tool 166 and may communicate temperature values using mud pulse telemetry to steering control system 168 at the surface 104.

In FIG. 28, mud analysis system 2710 is depicted including a variety of analytical instruments and sensors that enable mud analysis system 2710 to provide a variety of information to steering control system 168. Specifically, as shown, mud analysis system 2710 includes a mud density sensor 2802 to measure the density (or the weight and volume) of mud contents and mud flow of drilling mud 153. As shown, mud analysis system 2710 also includes a mud rheology sensor 2804 that is enabled to determine viscosity and various related characteristic flow values of drilling mud 153. As shown, mud analysis system 2710 also includes mud temperature sensor 2806 that is enabled to measure temperature of drilling mud 153. As shown, mud analysis system 2710 also includes a mud resistivity sensor 2808 that is enabled to measure electrical resistivity, or related values such as impedance, of drilling mud 153. As shown, mud analysis system 2710 also includes a mud gamma ray sensor 2810 that is enabled to measure gamma ray emissions of drilling mud 153. As shown, mud analysis system 2710 also includes a mud pH sensor 2812 that is enabled to measure an alkalinity or an acidity of drilling mud 153. As shown, mud analysis system 2710 also includes a mud chemical sensor 2814 that is enabled to measure a chemical composition of drilling mud 153. As shown, mud analysis system 2710 also includes a mud particle sensor 2812 that is enabled to determine various characteristic properties of particulate matter in drilling mud 153. The characteristic properties of the particles can include size, shape, morphology, distribution, and concentration, among others. As shown, mud analysis system 2710 also includes a mud magnetic sensor 2822 that is enabled to determine magnetic susceptibility of the contents of drilling mud 153. For example, when the content of drilling mud 153 includes ferrous metals, mud magnetic sensor 2822 may be selectively enabled to identify the ferrous metal content.

As shown in FIG. 28, mud analysis system 2710 also includes a mud image analysis 2820 that may include various equipment for visually analyzing drilling mud 153, including performing image analysis of the contents in drilling mud 153. In various embodiments, mud image analysis 2820 may include a shaker table over which drilling mud 153 from diversion 2708 flows and is spread out over an area of the shaker table. The shaker table may be implemented as a conveyor system that constantly moves the sample of drilling mud 153 to enable a continuous analysis. As a result of the spreading out over the area of the shaker table, various inclusions and solid particles may become visible at the shaker table, which can be captured using a video camera to generate corresponding digital images, or frames of digital images, such as in a video. The digital images may be analyzed by mud image analysis 2820 using image processing techniques to identify and characterize the contents of drilling mud 153. The image processing operations accordingly that may be performed by mud image analysis 2820 may include identifying an individual particle from an image of the shaker table, and tracking the individual particle over time on the shaker table using a temporal-spatial-feature tracking algorithm. The image processing operations accordingly that may be performed by mud image analysis 2820 may also include measuring a size, a shape, or a velocity of the individual particle, and performing an analysis to determine whether a drilling action is indicated, based on a condition of drilling mud 153 determined from an image of the shaker table. A rate of flow of drilling mud 153 and an extent of coverage of drilling mud 153 over an area of the shaker table may be used to determine a rheological condition of drilling mud 153, such as the presence of excessive solids, too low viscosity, among other factors. Additionally, mud image analysis 2820 may be enabled to operate with various types of light, such as visible light, lasers, infrared, near-infrared, far-infrared, ultraviolet, coherent light, incoherent light, polarized light, radio waves, x-rays, among other types of light, photons, or electromagnetic radiation. Accordingly, mud image analysis system 2820 may be enabled to use light detection and ranging (LIDAR), thermal imaging, radar, or other techniques to analyze drilling mud 153 and contents.

Regardless of the technique used, the ongoing monitoring of the inclusions and solid particles in drilling mud 153 by mud analysis system 2710 may be used to ascertain various types of information regarding the drilling of borehole 2710. For example, a variance in the concentration of the inclusions and solid particles in drilling mud 153, or a variance in mud volume and mud pressure, as detected by mud analysis system 2710, may be indicative of a condition within borehole 106, such as borehole widening or a borehole obstruction, such as a hole cleaning condition that blocks or impedes a flow of drilling mud 153. The mud image analysis system 2820 may include one or more cameras, whether for capturing still or video images, which may be focused on or aimed at the same or multiple locations, which may be overlapping. The one or more cameras may capture two-dimensional or three-dimensional images, and the image analysis system 2820 may be programmed to analyze either or both 2D or 3D images.

In operation, mud analysis system 2710 may be enabled to communicate with steering control system 168 to determine various parameters and settings associated with measurements of drilling mud 153 that are performed by mud analysis system 2710. For example, steering control system 168 may send mud analysis system 2710 information specifying which measurements are to be acquired, a frequency of the measurements, as well as a format of the measurements communicated back to steering control system 168 from mud analysis system 2710. In certain modes of operation, it is noted that steering control system 168 may enable the user to directly interact with mud analysis system 2710 on an ad hoc basis to perform desired analyses and to obtain corresponding measurements. In other modes of operation, steering control system 168 may enable a driller to oversee operation of mud analysis system 2710, after mud analysis system 2710 has been configured for continuous or semi-automatic operation, such as by using user interface 850 to view indications and update control values from time to time. For example, the user of steering control system 168 (e.g., the drilling operator) may specify frequent sampling of drilling mud 153 during certain drilling operations, while specifying that during other drilling operations the sampling of drilling mud 153 may be performed less frequently or deactivated altogether. Accordingly, steering control system 168 may command mud analysis system 2710 to control the frequency and type of analyses of drilling mud 153 that are to be performed during drilling. For example, steering control system 168 may instruct mud analysis system 2710 in advance to automatically vary the frequency of the analyses depending on a location of drilling or with respect to certain drilling operations.

It is noted that the individual sensor elements shown in FIG. 28 may represent a plurality of sensors that are either the same type or are different types. For example, the individual sensor elements depicted in FIG. 28 may encompass various equipment to perform various analytical techniques on drilling mud 153. Specifically, mud chemical sensor 2814 may incorporate equipment and subsystems to perform at least one of spectrographic analyses, chromatographic analyses, chemical reactions, optical absorption analyses, and optical transmission analyses, and may further be enabled to detect the presence of one or more chemicals or compounds in drilling mud 153, such as gas, oil, rubber, metal, and various hydrocarbons, among others. In this manner, mud chemical sensor 2814, alone or in conjunction with another sensor in mud analysis system 2710, may accordingly be enabled to detect wear and tear products from drill string 146 in drilling mud 153. In another example, mud density sensor 2802 may be enabled to perform at least one of x-ray diffraction density analyses, gamma ray density analyses, and flow density analyses, on drilling mud 153.

Figure 29:
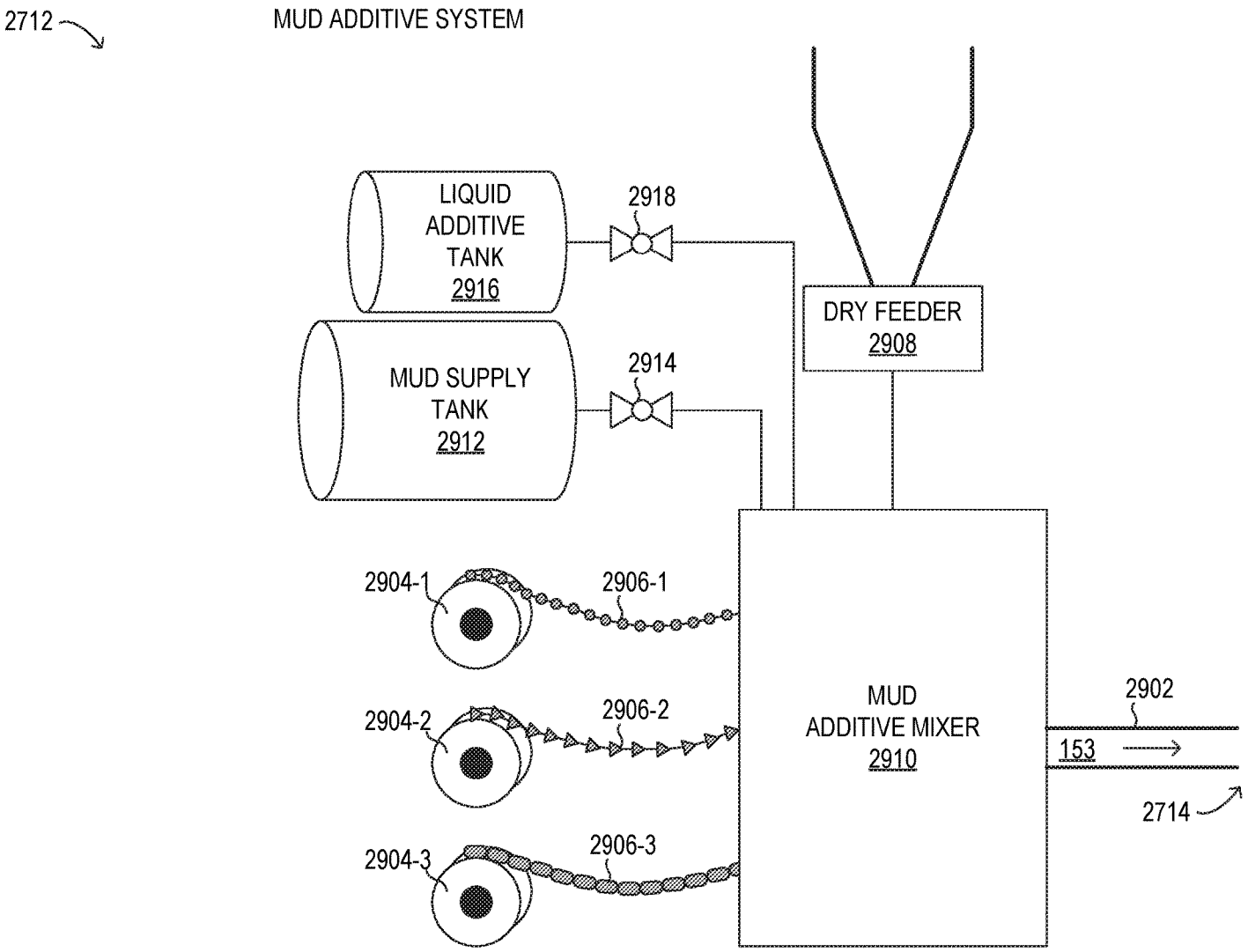
FIG. 29 illustrates an exemplary embodiment of a mud additive system.

Referring now to FIG. 29, further details of mud additive system 2712 are depicted. Specifically, FIG. 29 depicts different kinds of additives and corresponding equipment that may be included with mud additive system 2712. FIG. 29 is a schematic diagram for descriptive purposes and omits various implementation details for clarity. As shown, mud additive system 2712 includes a mud additive mixer 2910 that may be associated with additive processing equipment (not shown) and individual control systems for the additive processing equipment. For example, mud additive system 2712 or mud additive mixer 2910 may include one or more processors with an accessible memory media (not shown) that is enabled to execute instructions, such as instructions for controlling additive or mixing equipment, and instructions to receive commands to control the additive or mixing equipment, among other instructions. Mud additive system 2712 may be used to introduce additives into drilling mud 153 in a manner that is consistent, controlled, and safe. Mud additive system 2712 may include an automated delivery system for additives to be introduced into drilling mud 153 that achieves consistency, high feed rates, and process control to support various densities, particle sizes, and uniform distribution of the additives to be added to drilling mud 153. The automated delivery system included in mud additive system 2712 may also provide safety benefits by reducing manual handling and interactions with various additives that may include hazardous chemicals. The safety benefits may result from a decreased risk of injury from manually handling the hazardous chemicals, which may be present in bulk form in large quantities, as well as from manually handling the packaging of the additives and manually mixing the additives in batches. By removing or avoiding such manual operations associated with handling additives and packaging using the automated delivery system, the risks to human personnel may be reduced by the use of mud additive system 2712. The additive may be selected from any one or more of: a liquid, a colloid, a solid-liquid mixture, a solute dissolved in a solvent, a powder, and a particulate.

As shown in FIG. 29, mud additive system 2712 may be communicatively coupled to steering control system 168, such as by using a wired or a wireless network connection (see also FIG. 27). Accordingly, mud additive system 2712 is enabled to be responsive to control signals or commands received from steering control system 168. In some embodiments, mud additive system 2712 may be responsive to commands received from a human operator. The control signals or commands received by mud additive system 2712 from steering control system 168 may originate as a decision made by mud control 2702, or may be in response to user input. For example, from steering control system 168, the user may be provided user interface elements, such as on user interface 850, to select types and amounts of available additives to add to drilling mud 153, as well as user interface elements to specify the timing or rate of introduction of the additives to drilling mud 153. Thus, in addition to controlling the content and amount of the additives being added to drilling mud 153, mud additive system 2712 may control the timing of mixing a desired additive having a given composition, such as from other additives, and outputting the desired additive to merge point 2918 for mixing with drilling mud 153. It is noted that the timing of delivery of additives to drilling mud 153 may be an important factor for optimal drilling. For example, polytetrafluoroethylene (PTFE or Teflon™) beads may be used as an additive to lubricate drilling mud 153 during slide drilling. If the PTFE beads are delivered to drill bit 156 too early or too late with respect to the slide drilling, the PTFE beads may fail to lubricate the slide drilling as intended, which is undesirable for drilling purposes, but also because the cost and effort to introduce the lubricating PTFE beads is wasted. In one example, the user interface can enable the user to specify additive parameters such as fiber size, density, granular particulate size, and composition of a mixture of different additives or additive components, such as various chemical agents, bentonite, PTFE beads, among others. The user input provided to steering control system 168 may result in immediate dosing of the specified additives to drilling mud 153 without delay. The user input to steering control system 168 may also specify a delay or a timestamp in the future when the specified additives are to be added to drilling mud 153. In addition, the user input provided to steering control system 168 may specify certain process parameters, such as a feed rate, a chopper rate, among others, in order to control the size and consistency of individual additives to be added to drilling mud 153.

As shown in FIG. 29, mud additive system 2712 includes mud additive mixer 2910 having an output line 2902 that may couple to mud analysis and control system 2700 via return line 2714. Also shown with mud additive system 2712 is a dry feeder 2908 that may be used as a feed line for dry material to be added to drilling mud 153, such as powders, fibers, particles, and various dry mixtures that can be gravitationally dispensed using a hopper, for example. The refilling of the hopper (or other storage means) of dry feeder 2908 may be manually performed, such as in response to a corresponding indication provided on user interface 850, or locally at mud additive system 2712. In other embodiments, additional equipment may be provided to automate a sufficient supply feed of a dry additive for dispensing by dry feeder 2908. Dry feeder 2908 may be an automated device that is enabled to volumetrically or gravitationally dispense quantities of the dry additive to mud additive mixer 2910. Although one instance of dry feeder 2908 is shown in FIG. 29 for descriptive clarity, it is noted that a plurality of dry feeders 2908 may be used, such as for a corresponding plurality of dry additives. Because dry feeder 2908 can precisely dispense quantitatively accurate amounts of the dry additive, dry feeder 2908 may be controlled to dispense a desired amount of the dry additive at a desired time.

In FIG. 29, also shown with mud additive system 2712 is a mud supply tank 2912, along with a control valve 2914. Mud supply tank 2912 may be used to supply fresh mud into drilling mud 153, such as when the circulating mud supply in borehole 106 is lost during drilling. Additionally, mud supply tank 2912 may be used to provide low concentrations of an additive, such when a predilution of the additive using the fresh mud from mud supply tank 2912 is indicated, prior to mixing with drilling mud 153. Control valve 2914 may be used to meter the output from mud supply tank 2912, and may accordingly be a servo-actuated valve, such as a ball valve for example. It is noted that mud supply tank 2912 can be a fixed structure, or can be a terrestrial pit, such as mud pit 154, while additional mud pumps and mud lines (not shown) may be used to provide the fresh mud to mud additive mixer 2910. Also shown with mud additive system 2712 is a liquid additive tank 2916, along with a control valve 2918. Liquid additive tank 2916 may bused to supply a liquid additive to mud additive mixer 2910 that can be controlled using control valve 2918. It is noted that although one liquid additive tank 2916 is shown for one liquid additive, a plurality of liquid additive tanks and control valves for a respective plurality of different or the same liquid additive may be used.

Also shown in FIG. 29 are packaged additives 2906 that can be supplied to mud additive mixer 2910. Packaged additives 2906 may represent certain substances that are packaged in small units for environmental stability and preservation prior to addition to drilling mud 153. Accordingly, the packaging used for packaged additives 2906 may protect them against moisture, temperature, water, air, oxygen, or otherwise prevent degradation from undesirable environments to ensure a desired efficacy when used in borehole 106. In some embodiments, the packaging used for packaged additives 2906 may itself may comprise a desired additive, such as one or more materials that are soluble in drilling mud 153, for example. It should be further appreciated that, in one aspect of the present disclosure, one or more packaged additives 2906 may be customized to be particularly useful for a particular type of well, a particular region in which the well is located, or for particular geological formations, among other criteria. In some embodiments, a particular well owner may specify the form and composition of packaged additives 2906 for use in borehole 106. It is noted that even when packaged additives 2906 are manually fed from feed spools 2904, the rope or cable form may itself be useful for standardizing the delivery of packaged additives 2906 to drilling mud 153, and may improve the consistency of the delivery.

In some embodiments, the packaged additives 2906 may be removably joined together in a continuous series, such as when sausages are linked together in a chain arrangement or when laminated condiment packages are removably joined together at their ends. The contents and amounts of the additives in the packaged additives 2906 can be precisely and accurately controlled and reproduced. This approach may allow the easier and more precise delivery of the desired amount of additives at the desired time, and should help sustain better and easier environmental control and stability in transit. The contents of the packaged additives 2906 may contain a single additive or chemical, or a mixture of liquids, solids, and chemicals in a preselected and predictable relative mixture. Rope and cable structures, as discussed in more detail elsewhere, can contain layers of different types of additives, such as fibrous materials, solids, and liquids.

As shown in FIG. 29, three different types of packaged additives 2906-1, 2906-2, and 2906-3 are depicted being respectively supplied as ropes or cables using feed spools 2904-1, 2904-2, 2904-3. Although three different kinds of packaged additives 2906 are depicted, it is noted that various numbers of packaged based additives 2906 may be supplied to mud additive mixer 2910. In FIG. 29, each packaged additive 2906 is shown with a different packaged form that may indicate a different composition, respectively. Although packaged additives 2906 are shown having discrete packages tied together, it will be understood that packaged additives 2906 may include a continuous form, such as a clear tube filled with the additive that may be dosed on the basis of length of the clear tube, for example. Other types of packaged additives (not shown) may be added in discrete form, such as blocks, sticks, bricks, rods, among other forms.

In addition, the orientation of feed spools 2904 shown in FIG. 29 is schematic and feed spools 2904 may be physically installed in various orientations. In various implementation, packaged additives 2906 may be servo mechanically fed to mud additive mixer 2910, such as by powering feed spools 2904 or using another means, and may enable precise quantitative dosing of packaged additives 2906, such as by controlling a feed rate of powered feed spools 2904. In addition, mud additive system 2712 may include one or more choppers or grinders (not shown) that may be enabled to decimate or separate individual portions of packaged additives 2906. In one example (not shown), packaged additives 2906 can be fed vertically into mud additive mixer 2910 using gravity feeding. In another embodiment, packaged additives 2906 may be fed to mud additive mixer 2910 using one or more powered rollers, or using the choppers or grinders in mud additive mixer 2910 feed packaged additives 2906. In mud additive system 2712, packaged additives 2906 may be mixed with liquid additives, dry additives, or drilling mud, among other types of liquid and solid mixtures that may be used.

With reference to FIG. 29, one particular kind of additive for drilling mud 153 is referred to as a loss circulation material (LCM). As drilling mud 153 is circulated into borehole 106 to reduce the friction and heat generated by the drill bit 148 working on the geological formation, under certain conditions, a certain amount of drilling mud 153 may seep into cracks in the geological formation. Drilling mud 153 seeping into the geological formation may result in undesirable loss of drilling mud 153 and may accordingly adversely affect drilling, such as by increasing the friction and heat at drill bit 148. To reduce the loss of drilling mud 153 into the geological formation, or other losses, various LCM may be added to drilling mud 153. The LCM in drilling mud 153 may seal off holes, cracks, or other openings in the geological formation, and may result in reduced loss of drilling mud 153. LCM compositions may vary from fibrous materials (e.g., tree bark and cane stalks) to granular materials (e.g., wood and nuts hulls). Typically, LCM is manually added by humans to drilling mud 153, which can result in significant inconsistencies, or errors that can damage costly drilling equipment. For example, if a mud line transporting drilling mud 153 becomes clogged due to improper or excessive addition of LCM, various drilling equipment may fail and the failure may result in an unexpected tripping that can add delay, expense and additional safety risks.

However, with the use of mud analysis and control system 2700, as shown and described with respect to FIGS. 27, 28 and 29, downhole or surface sensors can be used to monitor various properties of drilling mud 153 during drilling as various drilling operations and drilling parameters are being controlled. Then, for example, steering control system 168 may be enabled to detect significant changes to the condition and amount of drilling mud 153 being circulated during drilling without delay, such as by using mud analysis system 2710 as described previously herein. Once steering control system 168 detects an unsuitable condition of drilling mud 153, an indication may be transmitted or displayed to the user. The indication may be a communication, such as a message, a short-message service (SMS) message, an email, an audible alert, a visual alert (e.g., a colored indicator that can be red, blinking, yellow, or green, according to specified criteria). The unsuitable condition may be a significant loss of drilling mud 153, that may be indicated when the loss exceeds a predetermined amount. For example the loss may be indicated when a drilling parameter associated with drilling mud 153 exceeds a predetermined range of values, or another alarm condition occurs. In response to the indication of excessive loss of drilling mud 153, steering control system 168 may be enabled to control mud additive system 2712 to automatically or semi-automatically add large particles sizes of LCM to drilling mud 153 to pump downhole and seal the geological formation. Similarly, in response to an indication that a slide drilling operation is coming up soon (which can be based on time, MD, WOB, ROP, etc.), steering control system 168 may be enabled generate a corresponding user notification of the desirability of adding certain types of LCM to drilling mud 153 within a particular time window and in a particular amount. In this manner, steering control system 168 is enabled to improve the chances that the appropriate amount of LCM be added to drilling mud 153 in a timely manner. In other embodiments, steering control system 168 may automatically control mud additive system 2712 to automatically deliver a specified LCM to drilling mud 153 at a desired and preprogrammed start time and schedule. In particular embodiments, steering control system 168 may automatically control a feed rate and grinding operations for an LCM, such as by grinding the LCM for a longer period of time to obtain a smaller particle size of the LCM.

Figure 30:
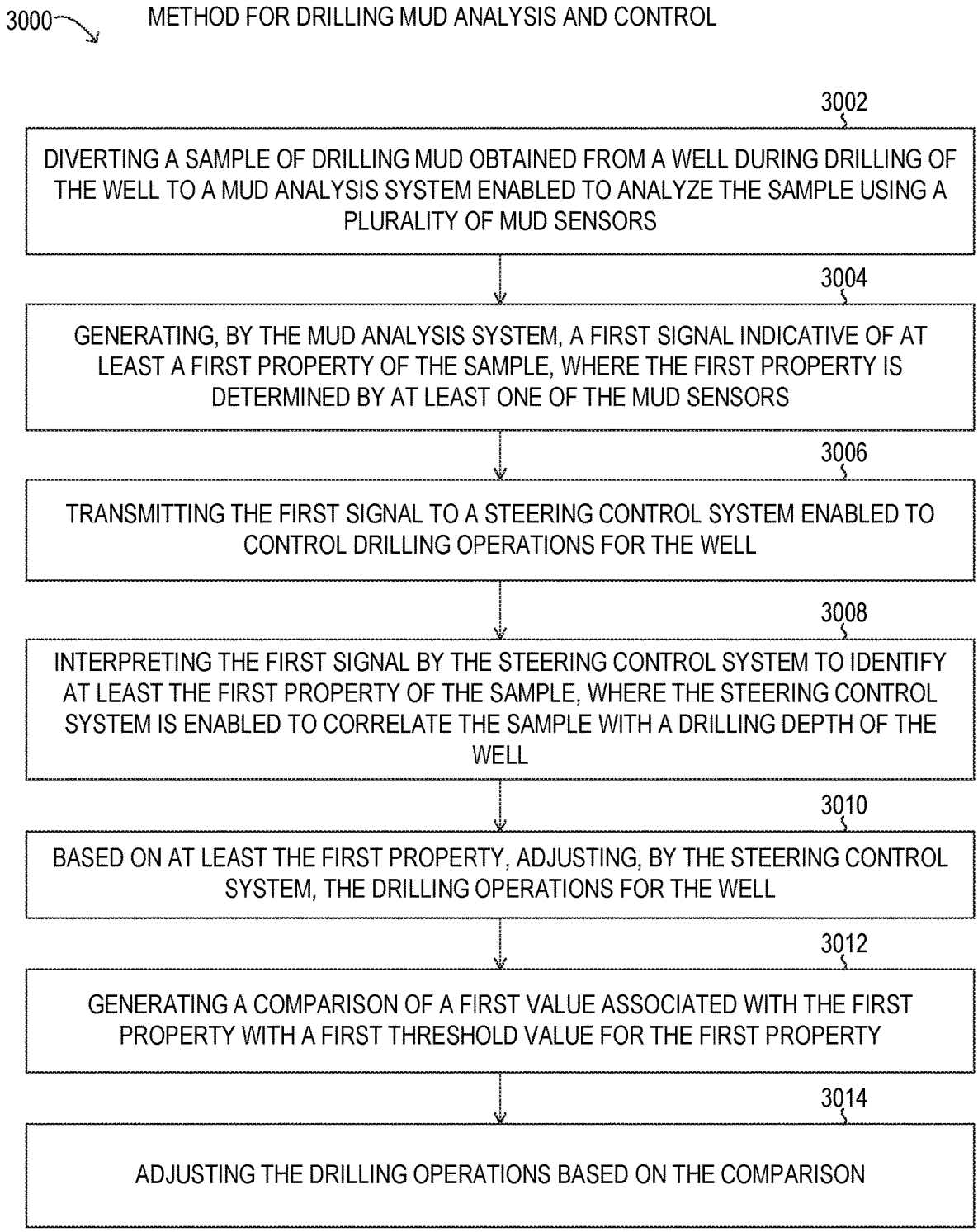
FIG. 30 is a flow diagram of an exemplary method for drilling mud analysis and control.

Referring now to FIG. 30, a flowchart of an embodiment of a method 3000 for drilling mud analysis and control, as disclosed herein, is depicted. Method 3000 may be performed using mud analysis and control system 2700, as described above. It is noted that certain operations described in method 3000 may be optional or may be rearranged in different embodiments.

Method 3000 in FIG. 30 may begin at step 3002 by diverting a sample of drilling mud obtained from a well during drilling of the well to a mud analysis system enabled to analyze the sample using a plurality of mud sensors. At step 3004, the mud analysis system generates a first signal indicative of at least a first property of the sample, where the first property is determined by at least one of the mud sensors. At step 3006, the first signal is transmitted to a steering control system enabled to control drilling operations for the well. At step 3008, the first signal is interpreted by the steering control system to identify at least the first property of the sample, where the steering control system is enabled to correlate the sample with a MD of the well. Based on at least the first property, at step 3010, the steering control system adjusts the drilling operations for the well. At step 3012, a comparison of a first value associated with the first property is compared with a first threshold value for the first property. At step 3014, the drilling operations are adjusted based on the comparison.

Figure 31:
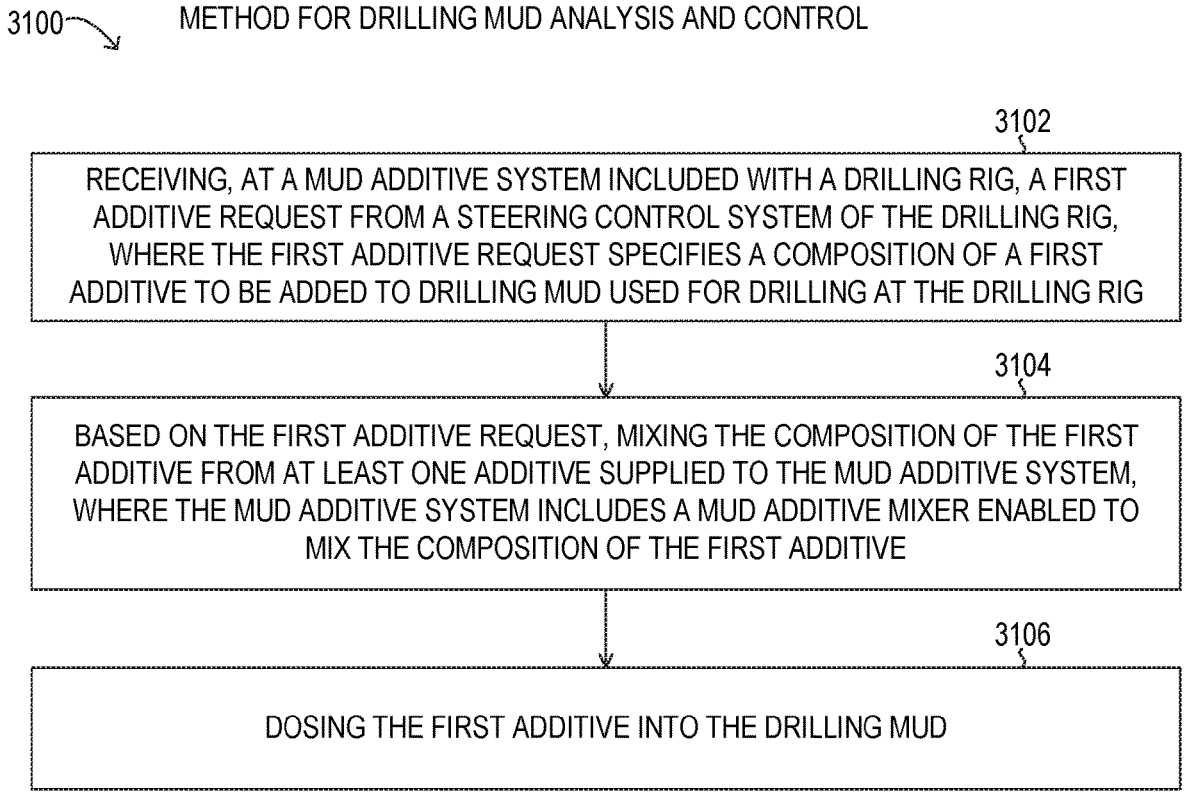
FIG. 31 is a flow diagram of an exemplary method for drilling mud analysis and control.

Referring now to FIG. 31, a flowchart of an embodiment of a method 3100 for drilling mud analysis and control, as disclosed herein, is depicted. Method 3100 may be performed using mud analysis and control system 2700, as described above. It is noted that certain operations described in method 3100 may be optional or may be rearranged in different embodiments.

Method 3100 in FIG. 31 may begin at step 3102 by a mud additive system included with a drilling rig receiving a first additive request from a steering control system of the drilling rig, where the first additive request specifies a composition of a first additive to be added to drilling mud used for drilling at the drilling rig. Based on the first additive request, at step 3104, the composition of the first additive is mixed from at least one additive supplied to the mud additive system, where the mud additive system includes a mud additive mixer enabled to mix the composition of the first additive. At step 3106, the first additive is dosed into the drilling mud.

As disclosed herein, analysis and control of drilling mud and additives is disclosed using a mud analysis system and a mud additive system that may automatically monitor and control the drilling mud during drilling of a well. The mud analysis system may acquire measurements on a sample of the drilling mud during drilling, and may send signals indicative of the drilling mud to a steering control system enabled to control the drilling. The steering control system may receive user input or may make decisions regarding additives to be added to the drilling mud and the timing thereof. The mud additive system may be enabled to receive commands from the steering control system and mix and add additives to the drilling mud.

As previously noted, computer vision, or video analytics, is one technology that may have promise for drilling operations. Examples of such technologies include those described in U.S. Published Patent Application 2016/0130889 A1, entitled "System and method for locating, measuring, counting, and aiding in the handling of drill pipes," U.S. Pat. No. 9,908,148, entitled "System and method for measuring fluid front position on shale shakers," U.S. Published Application 2016/0134843 A1, entitled "System and method for inhibiting or causing automated actions based on persons locations estimated from multiple video sources," and U.S. Published Patent Application 2016/0130917 A1, entitled "System and method for estimating rig state using computer vision for time and motion studies," all of which are incorporated by reference for all purposes as if fully set forth herein. Additional improvements to drilling operations are described in this disclosure.

In some embodiments, a system in accordance with the present disclosure includes one or more cameras positioned in a manner to observe the location and/or operation of oil drilling equipment and/or personnel. In some embodiments, cameras in accordance with the present disclosure can include grayscale, color, RGB, or other visible light cameras. In some embodiments, one or more cameras in accordance with the present disclosure can include cameras capable of observing light outside the visible spectrum, such as infrared, near-infrared, or ultraviolet cameras. In some embodiments, one or more cameras in accordance with the present disclosure can include cameras that are capable of recording distance or ranging information, such as time-of-flight cameras or LIDAR sensors. Such one or more time-of-flight or LIDAR sensors or cameras can be used to provide accurate distance, size, shape, dimensions, and other important physical information about a person or thing. The one or more cameras may be video cameras, or may be cameras taking still images, or a combination thereof. The computer vision system may include one or more cameras coupled to one or more computer systems, which in turn may be coupled to memory having computer program instructions stored therein, a database, and the computer systems may also be couple to one or more drilling rig systems or control systems for the drilling rig equipment and systems.

In some embodiments, one or more cameras may be connected to a computer system that may be located on or near the drilling rig, at a remote location (e.g. cloud-based), or combinations thereof for processing the data obtained by the one or more cameras in accordance with the present disclosure.

In some embodiments, one or more cameras can be used to observe the drilling rig floor and/or areas and/or equipment for the drilling rig. In some embodiments, one or more cameras can observe the positioning and/or operation of equipment or personnel. In some embodiments, one or more cameras can be oriented to observe pipes, tools, and other equipment connected to the drill string and placed down a borehole. In some embodiments, these cameras can identify the type of equipment affixed to the drill string, such as a borehole assembly, stabilizers, measuring-while-drilling (MWD), mud motors, and other types of equipment. In some embodiments, the system can identify each piece of equipment attached to the drill string and record the identity of the equipment and/or order that each was connected to the drill string in memory. In some embodiments, the sequence of tools can be compared to a desired or allowed list of equipment to verify that the correct tools have been placed downhole to confirm correct drilling operations, or to detect that an incompatible or undersigned arrangement or configuration of equipment is being placed into the borehole, causing an alert or an alarm. In some embodiments, the camera system can detect and identify particular measurements of equipment connected to the borehole, such as the bend angle and/or scribe line of a directional drilling bottom hole assembly (BHA), or the diameter of equipment, such as stabilizers.

In some embodiments, the camera system can detect and measure the total length of the drill string by identifying the lengths of pipe attached to the drill string, and adding each length to a cumulative total depth measurement. In some embodiments, this total depth measurement can be combined with other total depth measurements and associated well log data to confirm or improve the accuracy of depth measurements.

In some embodiments, the camera system can identify the scribe line of the BHA (which indicates the direction that the BHA will cause the borehole to change direction), and can monitor the direction of the scribe line based on the rotation of the remainder of the drill string. Additionally, the camera can assist in the connection of other elements to the BHA, such as MWD components, mud motors, and other devices that must be aligned with the BHA. Current methods of alignment typically involve adding a grease mark or some other type of marker on components as each one goes down the hole. Such methods are extremely prone to error, and can numerous problems, such as a misalignment between the scribe line of the BHA and sensors in MWD devices. By using a camera system to monitor the rotation of the drill string, subsequent components of the drill string can be attached, and rotated to correctly align them with the scribe line of the BHA.

In some embodiments, the camera system can also observe and measure the quality/integrity of the individual pipes and the connections therebetween. For example, the one or more cameras can observe one or more of the pipes as they rotate, and identify characteristics correlated with a fatigue or potential failure condition, such as the presence of cracks or warping/bending in the pipe. Additionally, the camera system can identify the joints between the pipes, and ensure that each pipe is fully screwed into and seated against each subsequent pipe. If a potentially dangerous condition is detected, such as a defective pipe or defective pipe connection, an alert or alarm can be triggered.

Some embodiments of the present technology can use computer vision to ensure that pipes are operating as intended, or are properly cleaned, such as using the methods described in U.S. Provisional Application 62/689,631, entitled "System and Method for Well Drilling Control Based on Borehole Cleaning," to ensure proper borehole cleaning. For example, an infrared camera can be positioned to view drill pipes prior to their insertion into the borehole. When the pipe is connected to the drill string, and warm drilling mud is pumped through the pipe, the camera can detect variations in thermal transfer into the pipe. That is, places that are thicker due to buildup of drilling residue or other occlusions will warm more slowly, and can be detected by the camera as a cooler region in the pipe. The same system can also be used to detect variations in pipe thickness as a result of damage to the interior surface of the drill pipe, caused by, for example, cavitation or occlusion. Even though such damage would not ordinarily be visible from outside the pipe, the infrared camera can detect warmer regions of the pipe caused by thinner wall thicknesses in damaged regions.

Drilling tasks like picking up tools and high siding the mud motor and MWD to synchronize them are examples of drilling operations that may benefit from the use of computer vision to automate some or all of such operations. Computer vision cameras can be used to track and accurately measure pipe lengths and pipe stand lengths as the pipe is tripped into the borehole. As the drillstring length is typically the basis for measured depth, which in turn is used to determine survey depth, this measurement may be a critical function. The computer vision system can determine such lengths, and send that information to a control system for the drilling rig, with the control system programmed to store, analyze and use such information. For example, the information sent from the computer vision system to the control system regarding the pipe tally and lengths of each pipe can be used by the control system to automatically update and display measured depth, and also to use the automatically updated measured depth value to determine survey depth, each of which can be done repeatedly as the borehole is being drilled, thereby helping to avoid incorrect measurements, such as happens with human-made measurements. In addition, the control system may also receive and use additional data, such as temperatures, hookload, and tension induced by borehole drag, to further increase the accuracy and precision of actual downhole sensor, BHA, drill bit, and borehole location during the drilling of the borehole.

A combination of a control system and a computer vision system can be used to establish high side when picking up the BHA, and can be used to automate some or all of the steps of doing so. This is often a key task that has to be done right when drilling and generally requires an experienced directional driller for conventional approaches to avoid errors. An example of an automated process for establishing the high side with a computer vision system coupled to a control system is as follows:

- Originate the laser pointer source on the rig floor (or attached to the doghouse)
- Tune the topdrive radial position to align the light on MWD or bend high side
- Lock the drive or record the topdrive encoder position accurately
- Move the BHA up or down to the MWD or Bend high side
- Adjust topdrive position until aligned and record offset All or any one or more of these steps can be automated and controlled by the control system coupled to the drilling rig system.

A combination of one or more cameras, time of flight sensors, or lidar can be used to capture the position of the bend in the motor and can adjust based on the highside offset of the tool. The MWD tool may need to provide a visual reference or other sensor feedback during the process to automatically measure the offset to correct for once the tools are torqued up. This indicator could be as simple as a visual mark or physical feature on the outside of the MWD collar or could be something that is inserted into the top of the tool that can be visually recorded by the computer vision system. For example, on a commonly used tensor type tool, the muleshoe in the UBHO sub is the reference for how the tool is oriented. Once the sub and muleshoe are installed, an orientation component can be put into the sub such that some form of visual reference can be seen out the top of the sub to capture the highside orientation by the computer vision system.

An alternative approach, as another example, is for the rig to provide a laser pointer reference for high side once the cameras/TOF/Lidar sensors have captured/determined the direction of the bend, and the rig can then maintain the orientation as the tools are added above it. Once the MWD orientation component is inserted into the BHA, the laser reference can be used to orient the tool or to measure the scribe line offset to the MWD tool highside.

In some embodiments, the one or more cameras in accordance with the present disclosure can observe auxiliary drilling equipment, such as mud shakers, mud storage tanks, and other equipment. In some embodiments, the one or more cameras can observe the mud shakers, and be used to determine the viscosity of the mud returning out of the borehole. For example, the one or more cameras can observe the mud as it passes across the mud shakers, and by observing the manner in which the fluid moves across the shaker, can determine the viscosity of the drilling mud. Based on the data received by the camera and the determination of one or more states, such as drilling mud viscosity, the types and/or volumes of cuttings, the size of the cuttings, and the like, the computer system can be programmed to determine if one or more corrective actions should be taken and, if so, send one or more control signals to add more drilling mud, increase flow rate, decrease flow rate, add more or stop adding drilling mud additives, or take other corrective action.

In some embodiments, one or more cameras in accordance with the present disclosure can be used to observe the interaction of drilling personnel and/or drilling equipment. For example, a camera can observe the drilling rig operator to determine whether he is present at his station. In some embodiments, the absence of a driller can generate an alert or alarm, or can cause moving equipment to shut off In some embodiments, the camera can observe drilling personnel, such as the drilling rig operator, and identify signs of fatigue or inattention, and trigger an alert or warning to prevent dangerous operation of the drilling rig.

Similarly, in some embodiments, one or more infrared cameras can be used to detect whether drilling personnel are performing their jobs safely and/or efficiently. For example, an infrared camera can monitor the body temperature of one or more drilling workers by observing their facial temperature. In hot weather operations, the system could trigger an alarm or an alert if it observes a drilling employee with an elevated body temperature, indicating illness, or a potential heat-related event (e.g., heat stroke). Likewise, one or more infrared cameras could be used to detect whether drilling personnel are utilizing proper personal protective equipment (PPE). For example, if the system detects heat signatures that appear to be an uncovered head, caused by a missing hardhat, or uncovered hands, indicating missing safety gloves, an alert or alarm can be triggered.

In some embodiments, the present disclosure can be used to observe drilling personnel on or near the drilling rig or ancillary equipment to ensure safe operation of equipment. For example, the drilling rig may have a pair of slips shaped like wedges that fit around the pipe to hold it in place. Pulling the slips out of drilling floor is typically a two-person operation, but occasionally can be attempted by a single person. A camera system in accordance with the present disclosure can identify and track the number of people in proximity to the slips, and either prevent or warn operators when only a single person is detected attempting to pull up the slips. For example, the system could have the ability to lock the slips in place, which would not disengage unless two people were observed near the slips. Alternatively, a single person could be observed attempting to pull the slips, and an alarm or alert could sound, warning of the dangerous operation. The example of pulling slips is only one example of a dangerous operation that may be performed by personnel. Computer vision systems in accordance with the present disclosure can be used to similarly detect or correct dangerous operations, either due to an incorrect ordering of operations (e.g., attempting to unscrew a drill pipe while under pressure), improper staffing (e.g., one person pulling up the slips), or use of the wrong equipment or tool in order to perform an operation. The computer vision system can also be used to monitor the volume(s) of one or more mud pits, waste pits, pools, etc., and to make sure that they do not fall below or exceed preset thresholds and, if they do, to provide an alert, alarm, or other corrective action. Similarly, the computer vision system can be programmed to monitor and detect off-gassing or other conditions, such as the freezing of mud pumps or other equipment, and determine if such conditions are acceptable or not, then send one or more control systems to automatically correct any unacceptable conditions or to provide one or more alerts or alarms if such actions are acceptable to take for the detected conditions.

Computer vision systems in accordance with the present disclosure can be used to similarly detect or correct dangerous operations, either due to an incorrect ordering of operations (e.g., attempting to unscrew a drill pipe while under pressure), improper staffing (e.g., one person pulling up the slips), or use of the wrong equipment or tool in order to perform an operation. The computer vision system can also be used to monitor the volume(s) of one or more mud pits, waste pits, pools, etc., and to make sure that they do not fall below or exceed preset thresholds and, if they do, to provide an alert, alarm, or other corrective action. Similarly, the computer vision system can be programmed to monitor and detect off-gassing or other conditions, such as the disruption of mud mixing systems or other equipment, and determine if such conditions are acceptable or not, then send one or more control systems to automatically correct any unacceptable conditions or to provide one or more alerts or alarms if such actions are acceptable to take for the detected conditions.

The data received by a computer system from the one or more cameras can be analyzed and used, such as by the computer system, to provide an alert, alarm, or to stop or alter one or more drilling parameters, including ceasing operation of given equipment or stopping drilling operations. In addition, the data received by the computer system can include data from the one or more cameras and from one or more sensors, including downhole sensors, surface sensors, or both. The computer system can be programmed so that the data received by the computer system is analyzed to determine a current state of one or more parameters, compared against one or more threshold limits or determined to be within one or more tolerance limits, and then to generate one or more appropriate signals to provide one or more of an appropriate display, alert, alarm, slow down of drilling, or cessation of one or more drilling activities. In addition, the data received by a computer system can be used to monitor one or more drilling parameters (such as measured depth as noted above), which can then be used to control drilling operations, such as for determining whether and when to begin a slide drilling operation or to continue rotary drilling, for updating a well plan, for increasing or decreasing rate or penetration, weight on bit, or otherwise altering one or more drilling parameters, and the like.

Figure 32:
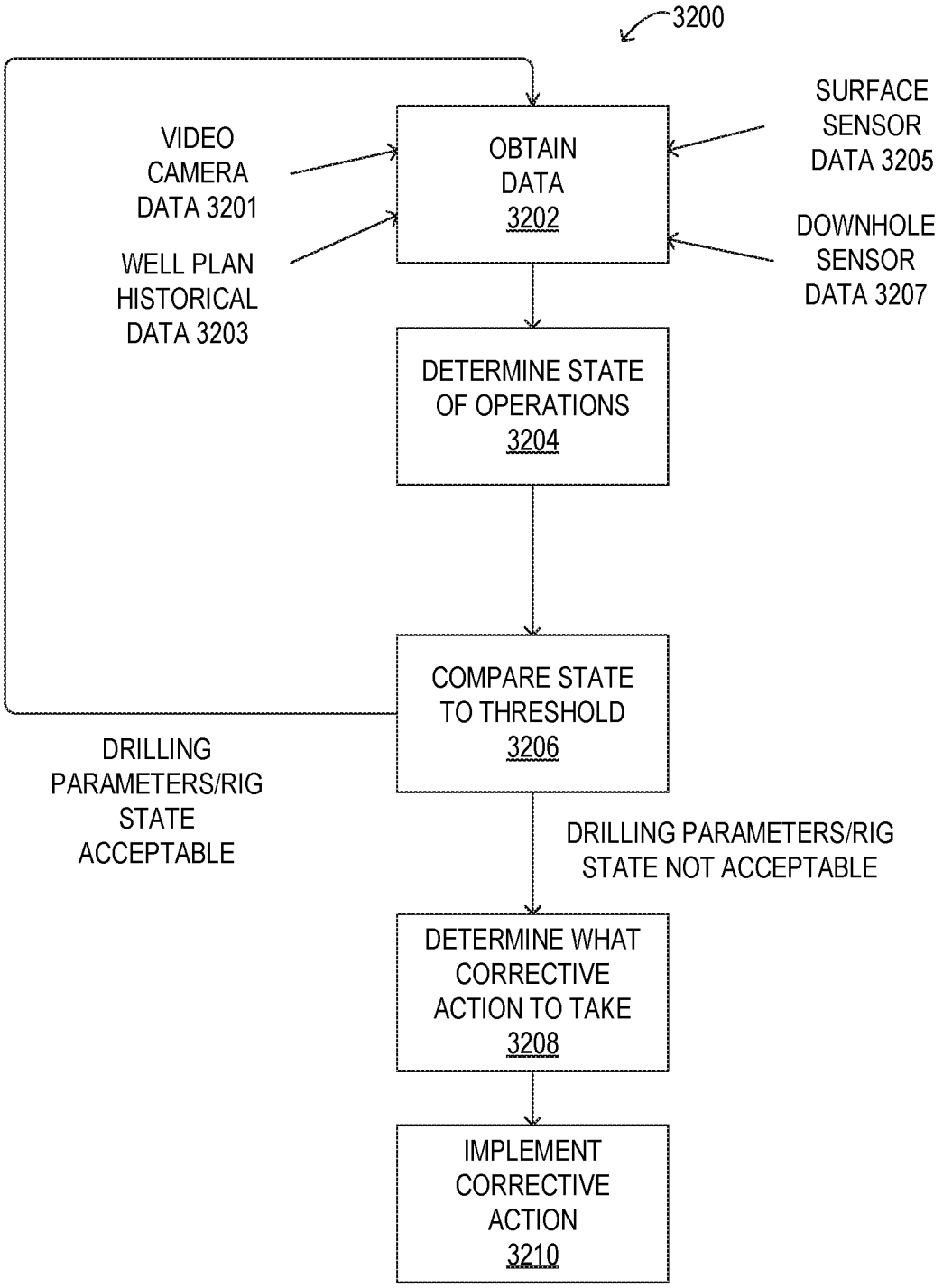
FIG. 32 is a flow diagram of an exemplary method for using computer vision imaging of one or more features of a drilling rig for controlling one or more drilling rig operations, activities, or drilling parameters.

FIG. 32 is an example of a flow chart of the steps that may be taken by a computer vision system in accordance with the present disclosure. The computer vision system in FIG. 2 may receive data from a number of sources, including one or more cameras like those described herein, as well as one or more surface and/or downhole sensors, a well plan, historical data, and the like, all of which may be received in real-time while the wellbore is being drilled. The system determines whether the data matches expected operational data, such as by comparing it to one or more preset thresholds or limits and determining whether the drilling rig operations are within acceptable limits. If the operations are within acceptable limits, the system may continue monitoring drilling operations. If one or more drilling operations are not within acceptable levels or limits, the system may determine what, if any, corrective action is appropriate and may then automatically take such action, such as by sending an alert, sounding or providing an audio and/or visual alarm, and/or by slowing or stopping one or more drilling operations or all drilling operations entirely.

FIG. 32 illustrates a method that may comprise the use of a computer vision system to monitor drilling operations, systems, and equipment during drilling, and determine if, based on the data received, including data from a computer vision system, whether and what corrective action may be needed, such as by adjusting one or more drilling parameters, ceasing drilling operations, providing one or more alerts or the like, and so forth, such as the corrective actions mentioned and described previously in this disclosure. In step 3202, a control system may receive data from a number of sources, which may include data 3207 from one or more downhole sensors, data 3205 from one or more surface sensors, data 3201 from one or more computer vision systems, such as one or more still or video cameras, and/or data 3203 from the well plan. At step 3204, the control system may determine whether the state of drilling operations, based on data 3201, 3203, 3205, and/or 3207, as well as data from drilling operations, such as whether the current mode of drilling is slide or rotary drilling, the equipment in use, such as the drill bit, the BHA, and so forth, is as may be desired or expected. In step 3206, the control system may determine whether any one or more of a plurality of drilling parameters, such as any of those mentioned above, are, based on the state of drilling operations, the equipment, the drill plan, etc., within a target range, do not exceed a threshold value, or do not fall below a threshold value, as may be appropriate for that drilling parameter under the circumstances. If the drilling parameter(s) is/are within acceptable ranges, then the control system may return to step 3202 and repeat the process described in order to continue monitoring drilling operations. If the control system determines that one or more drilling parameters are not within an acceptable range or fall below or exceed a threshold value, then the control system may proceed to step 3208, where the control system determines what corrective action should be taken. The control system may determine the appropriate corrective action in any number of ways, including by reference to instructions in the computer programming for the control system, such as by determining which corrective action in a lookup table in a database most closely matches the current data set and state of drilling operations. At step 3210, the control system then implements the corrective action as determined in step 3208, such as by sending one or more control signals to one or more drilling rig control systems. Although the foregoing description refers to corrective action in the singular, it should be noted that the control system of the present disclosure may analyze many different drilling parameters and data items, and the corrective action may involve adjusting or modifying a plurality of drilling parameters or operations at once.

It will be appreciated by those skilled in the art having the benefit of this disclosure that this system and method for surface steerable drilling provides a way to plan a drilling process and to correct the drilling process when either the process deviates from the plan or the plan is modified. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A control system for controlling drilling of a borehole by a drilling rig system, the system comprising:

a processor coupled to the drilling rig system; and a memory coupled to the processor, wherein the memory comprises instructions executable by the processor for performing the following:

a) obtaining, by the control system, data associated with fluid entering the borehole being drilled, fluid exiting the borehole, and a first value, the first value corresponding to a volume of solids exiting the borehole;

b) obtaining, by the control system, data associated with rate of penetration (ROP) of the borehole and a second value, the second value corresponding to a volume of rock drilled;

c) determining, by the control system, whether a difference between the first value and the second value exists and, if so, a value for the difference;

d) determining, by the control system, whether the value of the difference is within a target range therefor;

e) if the value of the difference between the volume of the solids exiting the borehole and the volume of rock drilled falls below the target range, then determining, by the control system, whether one or more first adjustments to one or more drilling parameters are indicated and, if so, sending one or more control signals to one or more components of the drilling rig system to make the one or more first adjustments to thereby increase the volume of the solids exiting the borehole relative to the volume of rock drilled; and f) if the value of the difference between the volume of the solids exiting the borehole and the volume of rock drilled exceeds the target range, then determining, by the control system, whether one or more second adjustments to one or more drilling parameters are indicated to increase the ROP and, if so, sending one or more control signals to the one or more components of the drilling rig system to make one or more second adjustments to thereby increase ROP.

2. The control system according to claim 1 further comprising instructions for repeating (a)-(f) a plurality of times during drilling of the borehole.

3. The control system according to claim 1 further comprising instructions for providing an alert signal if the value of the difference falls below a threshold value therefor.

4. The control system according to claim 1 further comprising instructions wherein the one or more first adjustments and the one or more second adjustments comprise instructions for adjusting at least one of ROP, WOB, mud flow rate, torque applied to a drill string, differential pressure, and adding one or more additives to drilling mud.

5. The control system according to claim 4 wherein the instructions further comprise instructions for causing at least one drilling parameter to be modified comprises stopping drilling operations or lifting a drill bit.

6. The control system according to claim 1 wherein the instructions further comprise instructions for determining whether the value of the difference falls within one of a plurality of target ranges.

7. The control system according to claim 1, wherein the instructions for determining whether a difference between the first value and the second value exists, and, if so, a value for the difference, further comprise instructions for determining a first flow rate or volume of the fluid entering the borehole during a specified time period, determining a second flow rate or volume of a combination of the fluid and the solids exiting the borehole during a time period that corresponds to the specified time period, determining the volume of rock drilled during the time period that corresponds to the specified time period, and comparing the difference between the volume of the solids exiting the borehole during the time period that corresponds to the specified time period and the volume of rock drilled during the time period that corresponds to the specified time period.

8. The control system according to claim 7 wherein the instructions further comprise instructions for determining a first time required for the fluid entering the borehole to reach a drill bit and a second time required for fluid and cuttings to travel from the drill bit to a surface location, and, responsive to the first time and the second time, determining the first flow rate or volume and the second flow rate or volume, wherein the first flow rate or volume and the second flow rate or volume correspond to the specified time period.

9. The control system according to claim 1 wherein the instructions for determining whether one or more first adjustments to one or more drilling parameters are indicated further comprise instructions for receiving data associated with a well plan for the borehole and, responsive to the data associated with the well plan, determining whether to continue drilling for a selected time or depth.

10. The control system according to claim 9 wherein the instructions for determining whether to continue drilling for the selected time or depth further comprise instructions for determining, responsive to an expected drilling operation or mode if no adjustment of drilling parameters is indicated.

11. The control system according to claim 10 wherein the expected drilling operation or mode comprises a slide drilling operation.

12. The control system according to claim 1, wherein the first and second values correspond to volumes per unit of time.

13. The control system according to claim 12, wherein the unit of time for the first and second values is the same, and wherein the first and second values are obtained at different times from one another, wherein the different times are associated with length of the borehole.

14. A method for controlling drilling of a well, the method comprising:

a) obtaining, by a control system, data associated with fluid entering a borehole being drilled, fluid exiting the borehole, and a first value, the first value corresponding to a volume of solids exiting the borehole;

b) obtaining, by the control system, data associated with rate of penetration (ROP) of the borehole and a second value, the second value corresponding to a volume of rock drilled;

c) determining, by the control system, whether a difference between the first value and the second value exists and, if so, a value for the difference;

d) determining, by the control system, whether the value of the difference is within a target range therefor;

e) if the value of the difference between the volume of the solids exiting the borehole and the volume of rock drilled falls below the target range, then determining, by the control system, one or more first adjustments to one or more drilling parameters, and sending one or more control signals to one or more components of a drilling rig system to make the one or more first adjustments to increase the volume of the solids exiting the borehole relative to the volume of rock drilled; and f) if the value of the difference between the volume of the solids exiting the borehole and the volume of rock drilled exceeds the target range, then determining, by the control system, one or more second adjustments to one or more drilling parameters to increase the ROP, and sending one or more control signals to the one or more components of the drilling rig system to make one or more second adjustments to increase ROP.

15. The method according to claim 14 further comprising the step of repeating steps (a)-(f) a plurality of time while drilling the borehole.

16. The method according to claim 14 further comprising the step of providing to the control system the target range.

17. The method according to claim 14, wherein the one or more control signals are sent to one or more drilling rig control systems, an autodriller system, one or more drilling rig component systems, or a combination thereof.

18. The method according to claim 14 further comprising a plurality of target ranges, each target range associated with one or more formations or borehole segments, and further comprising the step of determining, by the control system, the one or more formations or borehole segments in which a bottom hole assembly (BHA) is located.

19. The method according to claim 14 wherein a plurality of target ranges, each associated with one or more formations or borehole segments, are provided to the control system.

20. The method according to claim 14 further comprising comparing, by the control system, total volume of the fluid and the solids exiting the borehole and total volume of the fluid entering the borehole and rock drilled and, if the total volume of the fluid and the solids exiting the borehole is less than the total volume of the fluid entering the borehole and the rock drilled by a predetermined amount, sending, by the control system, one or more control signals to the one or more components of the drilling rig system to decrease the ROP.

* * * * *